US012569045B2

(12) United States Patent
Higgins et al.

(10) Patent No.: US 12,569,045 B2
(45) Date of Patent: Mar. 10, 2026

(54) HAIR CARE APPLIANCE

(71) Applicant: SharkNinja Operating LLC, Needham, MA (US)

(72) Inventors: Colby Jackson Higgins, Randolph, MA (US); Adam Udy, Eastbourne (GB); Stephen Murphy, Watertown, MA (US); Stephan James Godden, Woking (GB); Richard Mathias, Wellesley, MA (US); Nicholas James Sardar, London (GB); Joshua Thomas Richards, Hassocks (GB)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 18/168,324

(22) Filed: Feb. 13, 2023

(65) Prior Publication Data

US 2023/0180907 A1 Jun. 15, 2023

Related U.S. Application Data

(63) Continuation of application No. 17/737,565, filed on May 5, 2022, now Pat. No. 12,225,995.
(Continued)

(51) Int. Cl.
*A45D 1/04* (2006.01)
*A45D 20/12* (2006.01)
(Continued)

(52) U.S. Cl.
CPC ..... *A45D 20/12* (2013.01); *A45D 1/04* (2013.01); *A45D 20/122* (2013.01);
(Continued)

(58) Field of Classification Search
CPC . A45D 1/06; A45D 1/10; A45D 2/001; A45D 2/10
See application file for complete search history.

(56) References Cited

U.S. PATENT DOCUMENTS 2,041,687 A 5/1936 Benson
3,261,107 A 7/1966 Ponczek et al.
(Continued)

FOREIGN PATENT DOCUMENTS

AU 355722 S 5/2014
AU 355723 S 5/2014
(Continued)

OTHER PUBLICATIONS

Machine Translation of Zhang et al. (Year: 2021).*
(Continued)

*Primary Examiner* — Rachel R Steitz
(74) *Attorney, Agent, or Firm* — Mintz, Levin, Cohn, Ferris, Glovsky and Popeo, P.C.

(57) ABSTRACT

A hair care appliance is provided. The hair care appliance includes a handle and a body coupled to the handle via a rotational hinge joint. The body can be movable via the rotational hinge joint between a straight configuration in which the body is aligned with a longitudinal axis of the handle and a bent configuration in which the body extends along an axis transverse to the longitudinal axis of the handle. A fluid flow path extends between an inlet in the handle and an outlet in the body. The hair care appliance can be operated with minimal loss of fluid flow in either the straight configuration and the bent configuration. The hair care appliance includes a fan assembly in the handle and a heater assembly in the body that are positioned to create a balanced center of mass of the hair care appliance when operated by a user.

20 Claims, 77 Drawing Sheets

Related U.S. Application Data

(60) Provisional application No. 63/279,041, filed on Nov. 12, 2021.

(51) Int. Cl.
*A46B 5/00* (2006.01)
*A46B 9/02* (2006.01)
*A46B 15/00* (2006.01)

(52) U.S. Cl.
CPC ..... *A46B 5/0058* (2013.01); *A46B 9/023* (2013.01); *A46B 15/003* (2013.01); *A46B 15/0051* (2013.01); *A46B 2200/104* (2013.01)

(56) References Cited

U.S. PATENT DOCUMENTS 3,599,345 A 8/1971 Tolmie
3,846,047 A 11/1974 Wada et al.
4,122,329 A 10/1978 Godel
4,197,448 A 4/1980 Harigai
4,198,556 A 4/1980 Crowley et al.
4,198,558 A * 4/1980 Benty ..... A45D 20/30 132/212
4,260,875 A 4/1981 Walter et al.
4,570,651 A 2/1986 Adams
4,647,757 A 3/1987 Haastrup
4,721,121 A * 1/1988 Adams ..... A45D 20/10 392/383
4,904,847 A 2/1990 Kosaka et al.
4,926,027 A * 5/1990 Montagino ..... A45D 20/12 132/271
5,471,763 A 12/1995 McArthur
5,546,674 A 8/1996 Lange et al.
5,715,847 A 2/1998 Rolf et al.
6,775,922 B2 8/2004 Langley et al.
6,996,916 B2 2/2006 Cafaro
7,040,037 B2 5/2006 Keong
7,088,913 B1 * 8/2006 Verhoorn ..... F24H 3/0411 392/360
7,661,174 B2 2/2010 Park
8,066,017 B1 11/2011 Born et al.
8,146,605 B1 4/2012 Laaly
8,209,877 B2 7/2012 Smal
8,407,913 B2 4/2013 Langley et al.
8,533,916 B2 * 9/2013 Ahn ..... E05D 11/04 16/362
8,544,477 B1 10/2013 Laaly
8,602,038 B2 12/2013 Choi
8,607,470 B2 12/2013 Richmond et al.
8,607,804 B2 12/2013 De Benedictis
8,651,118 B2 2/2014 De Benedictis et al.
D715,995 S 10/2014 Dyson et al.
D715,996 S 10/2014 Dyson et al.
D716,492 S 10/2014 Dyson et al.
D729,447 S 5/2015 Gammack
D729,448 S 5/2015 Gammack
D729,978 S 5/2015 Bates et al.
D729,979 S 5/2015 Gammack
D730,575 S 5/2015 Bates et al.
D730,576 S 5/2015 Gammack
D731,117 S 6/2015 Bates et al.
9,144,286 B2 9/2015 Courtney et al.
D741,544 S 10/2015 Gammack
9,173,468 B2 11/2015 Moloney et al.
9,237,789 B2 1/2016 Prehodka
9,282,799 B2 3/2016 Courtney et al.
9,282,800 B2 3/2016 Courtney et al.
D757,361 S 5/2016 Gammack
D757,362 S 5/2016 Dyson et al.
D758,010 S 5/2016 Bates et al.
D758,011 S 5/2016 Gammack
D758,012 S 5/2016 Bates et al.
9,414,662 B2 8/2016 Moloney et al.
9,420,864 B2 8/2016 Gammack et al.
9,420,865 B2 8/2016 Gammack et al.
9,510,395 B2 11/2016 Coulton et al.
D775,419 S 12/2016 Stephens et al.
9,516,938 B2 12/2016 Richmond et al.
9,526,310 B2 12/2016 Courtney et al.
9,526,311 B1 12/2016 Schaefer et al.
9,578,943 B2 2/2017 Guy-rabi et al.
9,578,945 B2 2/2017 Han
D782,731 S 3/2017 Smith et al.
D782,732 S 3/2017 Smith et al.
D782,733 S 3/2017 Smith et al.
D782,735 S 3/2017 Stephens et al.
D782,736 S 3/2017 Stephens et al.
9,591,906 B2 3/2017 Guy-rabi et al.
9,596,916 B2 3/2017 Moloney et al.
D784,614 S 4/2017 Stephens et al.
D785,240 S 4/2017 Smith et al.
D785,241 S 4/2017 Stephens et al.
9,675,157 B2 6/2017 Courtney et al.
9,675,158 B2 6/2017 Soresina et al.
9,687,058 B2 6/2017 Atkinson
D791,407 S 7/2017 Smith et al.
D798,502 S 9/2017 Smith et al.
9,808,065 B2 11/2017 Moloney et al.
9,808,067 B2 11/2017 Sutter et al.
9,877,562 B2 1/2018 Guy-rabi et al.
D811,009 S 2/2018 Smith et al.
9,936,788 B2 4/2018 Stephens et al.
9,936,789 B2 4/2018 Stephens et al.
D817,007 S 5/2018 Guy-rabi et al.
9,986,810 B2 6/2018 Bobillier et al.
10,004,313 B2 6/2018 Atkinson
10,010,150 B2 7/2018 Courtney et al.
10,016,040 B2 7/2018 Courtney et al.
10,021,951 B2 7/2018 Bobillier et al.
10,028,574 B2 7/2018 Rennette
10,064,470 B2 9/2018 Warne
10,076,172 B2 9/2018 Stephens et al.
10,080,414 B2 9/2018 Douglas et al.
D830,630 S 10/2018 Chia et al.
10,085,537 B2 10/2018 Maclaine
10,085,538 B2 10/2018 Saunders et al.
10,117,491 B2 11/2018 Moloney et al.
10,143,285 B2 12/2018 Stephens et al.
10,165,843 B2 1/2019 Hedges
10,165,844 B2 1/2019 Stephens et al.
10,186,822 B2 1/2019 Hogan
10,194,728 B2 2/2019 Stephens et al.
10,213,001 B2 2/2019 Stephens et al.
D843,652 S 3/2019 Mcluckie et al.
D843,653 S 3/2019 Teyu et al.
D843,654 S 3/2019 Teyu et al.
10,226,112 B2 3/2019 Kerr et al.
10,238,199 B2 3/2019 Stephens et al.
D847,421 S 4/2019 Tappenden et al.
D847,422 S 4/2019 Tappenden et al.
D847,423 S 4/2019 Tappenden et al.
D847,424 S 4/2019 Tappenden et al.
D847,425 S 4/2019 Tappenden et al.
D847,426 S 4/2019 Tappenden et al.
D848,063 S 5/2019 Tappenden et al.
D848,064 S 5/2019 Tappenden et al.
D848,065 S 5/2019 Heffer et al.
D848,066 S 5/2019 Coulton et al.
D848,067 S 5/2019 Heffer et al.
D848,068 S 5/2019 Heffer et al.
D848,675 S 5/2019 Chia et al.
D850,001 S 5/2019 Coulton et al.
10,278,471 B2 5/2019 Shelton et al.
D852,415 S 6/2019 Coulton et al.
D852,416 S 6/2019 Coulton et al.
10,306,965 B2 6/2019 Wilkinson et al.
D853,637 S 7/2019 Coulton et al.
D853,638 S 7/2019 Tappenden et al.
D853,639 S 7/2019 Tappenden et al.
D853,640 S 7/2019 Tappenden et al.
D853,641 S 7/2019 Tappenden et al.
D853,642 S 7/2019 Coulton et al.
D854,745 S 7/2019 Chia et al.

(56) References Cited

U.S. PATENT DOCUMENTS

| | | | | |
|---|---|---|---|---|
| D855,252 | S | 7/2019 | Coulton et al. | |
| D856,579 | S | 8/2019 | Chia et al. | |
| D856,580 | S | 8/2019 | Chia et al. | |
| 10,383,422 | B2 | 8/2019 | Law et al. | |
| 10,390,599 | B1 | 8/2019 | James et al. | |
| D860,528 | S | 9/2019 | Atkinson et al. | |
| D860,529 | S | 9/2019 | Atkinson et al. | |
| D860,530 | S | 9/2019 | Atkinson et al. | |
| D860,531 | S | 9/2019 | Atkinson et al. | |
| D860,532 | S | 9/2019 | Atkinson et al. | |
| D865,286 | S | 10/2019 | Atkinson et al. | |
| 10,441,049 | B2 | 10/2019 | Douglas et al. | |
| 10,441,050 | B2 | 10/2019 | Blanc et al. | |
| 10,448,722 | B2 | 10/2019 | Mcluckie | |
| 10,470,545 | B2 | 11/2019 | Thiebaut et al. | |
| D869,763 | S | 12/2019 | Atkinson et al. | |
| D869,764 | S | 12/2019 | Atkinson et al. | |
| 10,575,617 | B2 | 3/2020 | Courtney et al. | |
| 10,582,751 | B2 | 3/2020 | Courtney | |
| 10,602,826 | B2 | 3/2020 | Wilkinson et al. | |
| 10,610,000 | B2 | 4/2020 | Courtney et al. | |
| D884,966 | S | 5/2020 | Flynn et al. | |
| D885,663 | S | 5/2020 | Flynn et al. | |
| 10,660,417 | B2 | 5/2020 | Bennett | |
| 10,660,418 | B2 | 5/2020 | Degrood et al. | |
| 10,687,595 | B2 | 6/2020 | Courtney et al. | |
| 10,729,218 | B2 | 8/2020 | Childe et al. | |
| 10,765,191 | B2 | 9/2020 | Stephens et al. | |
| 10,786,061 | B2 | 9/2020 | Thiebaut et al. | |
| 10,869,529 | B2 | 12/2020 | Chia et al. | |
| 10,874,186 | B2 | 12/2020 | Macpherson et al. | |
| D923,874 | S | 6/2021 | Kirkbride et al. | |
| 11,033,088 | B2 | 6/2021 | Atkinson et al. | |
| 11,044,979 | B2 | 6/2021 | Maclaine | |
| 11,071,365 | B2 | 7/2021 | Maclaine et al. | |
| 11,168,924 | B2 | 11/2021 | Naicker et al. | |
| 11,172,745 | B2 | 11/2021 | Tam et al. | |
| 2003/0192194 | A1 | 10/2003 | Evanyk | |
| 2005/0193584 | A1 | 9/2005 | McCambridge et al. | |
| 2006/0248744 | A1 | 11/2006 | Langley | |
| 2009/0000143 | A1 | 1/2009 | Bazzicalupo et al. | |
| 2010/0170104 | A1 | 7/2010 | Shami et al. | |
| 2013/0111777 | A1 | 5/2013 | Jeong | |
| 2013/0133218 | A1 | 5/2013 | Hadden | |
| 2013/0233336 | A1 | 9/2013 | Lazzaro et al. | |
| 2014/0216493 | A1* | 8/2014 | Hadden | A45D 2/001 132/223 |
| 2014/0230181 | A1 | 8/2014 | Yamaoka et al. | |
| 2015/0007444 | A1 | 1/2015 | Moloney et al. | |
| 2015/0089828 | A1 | 4/2015 | Moloney et al. | |
| 2015/0192325 | A1 | 7/2015 | Takemoto | |
| 2016/0037888 | A1 | 2/2016 | Richmond et al. | |
| 2016/0262518 | A1 | 9/2016 | Guy-rabi et al. | |
| 2016/0262520 | A1 | 9/2016 | Depoyian et al. | |
| 2017/0150796 | A1 | 6/2017 | Stephens et al. | |
| 2017/0150797 | A1* | 6/2017 | Imhasly | A45D 20/10 |
| 2017/0150798 | A1 | 6/2017 | Bobillier et al. | |
| 2017/0164709 | A1 | 6/2017 | Laveni et al. | |
| 2017/0231358 | A1 | 8/2017 | Jeong | |
| 2017/0273428 | A1 | 9/2017 | Nicolson et al. | |
| 2017/0273429 | A1 | 9/2017 | Nicolson et al. | |
| 2017/0310249 | A1 | 10/2017 | Zheng et al. | |
| 2018/0055182 | A1 | 3/2018 | Thompson et al. | |
| 2018/0172013 | A1 | 6/2018 | Dymond et al. | |
| 2018/0184779 | A1* | 7/2018 | Torres | A45D 20/12 |
| 2019/0075905 | A1 | 3/2019 | Kennedy et al. | |
| 2019/0223572 | A1 | 7/2019 | Ahrens | |
| 2019/0357653 | A1 | 11/2019 | Guerreiro et al. | |
| 2019/0380463 | A1 | 12/2019 | Guerreiro et al. | |
| 2020/0037725 | A1 | 2/2020 | Ahrens | |
| 2020/0085161 | A1 | 3/2020 | James et al. | |
| 2020/0085163 | A1 | 3/2020 | James et al. | |
| 2020/0128937 | A1 | 4/2020 | Chen et al. | |
| 2020/0237070 | A1 | 7/2020 | Degrood et al. | |
| 2020/0397111 | A1 | 12/2020 | Bouchar | |
| 2021/0267341 | A1 | 9/2021 | Yoo | |
| 2021/0285328 | A1 | 9/2021 | Mahmoodilari et al. | |
| 2021/0307473 | A1 | 10/2021 | Conrad | |
| 2021/0381527 | A1 | 12/2021 | Peet et al. | |
| 2022/0142326 | A1 | 5/2022 | Lei et al. | |
| 2023/0404236 | A1 | 12/2023 | Courtney et al. | |
| 2024/0358132 | A1 | 10/2024 | Crawford et al. | |

FOREIGN PATENT DOCUMENTS

| | | | |
|---|---|---|---|
| AU | 2013239504 | A1 | 9/2014 |
| AU | 2013239510 | A1 | 9/2014 |
| AU | 2013285200 | A1 | 1/2015 |
| AU | 2013285201 | A1 | 1/2015 |
| AU | 2013239504 | B2 | 4/2015 |
| AU | 2013239510 | B2 | 10/2015 |
| AU | 2013285200 | B2 | 11/2015 |
| AU | 365799 | S | 12/2015 |
| AU | 365800 | S | 12/2015 |
| AU | 365855 | S | 12/2015 |
| AU | 2014285903 | A1 | 12/2015 |
| AU | 366597 | S | 1/2016 |
| AU | 2013285201 | B2 | 1/2016 |
| AU | 367865 | S | 3/2016 |
| AU | 367880 | S | 3/2016 |
| AU | 2014389903 | A1 | 9/2016 |
| AU | 2015233175 | A1 | 9/2016 |
| AU | 2014285903 | B2 | 2/2017 |
| AU | 2014285903 | C1 | 5/2017 |
| AU | 2015233175 | B2 | 9/2017 |
| AU | 2017101822 | A4 | 2/2018 |
| AU | 2018201042 | A1 | 3/2018 |
| AU | 2017318546 | A1 | 2/2019 |
| AU | 2018201042 | B2 | 8/2019 |
| AU | 2017318546 | B2 | 7/2020 |
| CA | 2873465 | A1 | 11/2013 |
| CA | 155600 | S | 10/2014 |
| CA | 155601 | S | 10/2014 |
| CA | 155602 | S | 10/2014 |
| CA | 2943399 | A1 | 9/2015 |
| CA | 2943400 | A1 | 9/2015 |
| CA | 2943401 | A1 | 9/2015 |
| CA | 2788103 | C | 3/2016 |
| CA | 165648 | S | 6/2016 |
| CA | 165649 | S | 6/2016 |
| CA | 165650 | S | 6/2016 |
| CA | 163169 | S | 12/2016 |
| CA | 163170 | S | 12/2016 |
| CA | 163184 | S | 12/2016 |
| CA | 166089 | S | 12/2016 |
| CA | 166228 | S | 12/2016 |
| CA | 166229 | S | 12/2016 |
| CA | 3035152 | A1 | 3/2018 |
| CA | 177161 | S | 5/2018 |
| CA | 176864 | S | 6/2018 |
| CA | 179968 | S | 1/2019 |
| CA | 179969 | S | 1/2019 |
| CA | 178448 | S | 12/2019 |
| CA | 178449 | S | 12/2019 |
| CA | 178450 | S | 12/2019 |
| CA | 178451 | S | 12/2019 |
| CA | 178452 | S | 12/2019 |
| CA | 178454 | S | 12/2019 |
| CA | 178457 | S | 12/2019 |
| CA | 178458 | S | 12/2019 |
| CA | 178459 | S | 12/2019 |
| CA | 3109771 | A1 | 3/2020 |
| CN | 201243721 | Y | 5/2009 |
| CN | 203168302 | U | 9/2013 |
| CN | 203168303 | U | 9/2013 |
| CN | 203220053 | U | 10/2013 |
| CN | 203328162 | U | 12/2013 |
| CN | 203369521 | U | 1/2014 |
| CN | 203369522 | U | 1/2014 |
| CN | 204292438 | U | 4/2015 |
| CN | 204317818 | U | 5/2015 |
| CN | 204483371 | U | 7/2015 |
| CN | 204483372 | U | 7/2015 |
| CN | 204483373 | U | 7/2015 |

(56) References Cited

FOREIGN PATENT DOCUMENTS

| | | | |
|---|---|---|---|
| CN | 204499778 | U | 7/2015 |
| CN | 104921436 | A | 9/2015 |
| CN | 104921437 | A | 9/2015 |
| CN | 204742992 | U | 11/2015 |
| CN | 204796991 | U | 11/2015 |
| CN | 204796992 | U | 11/2015 |
| CN | 105231630 | A | 1/2016 |
| CN | 103355925 | B | 2/2016 |
| CN | 105433576 | A | 3/2016 |
| CN | 102665479 | B | 7/2016 |
| CN | 103355930 | B | 8/2016 |
| CN | 103519541 | B | 8/2016 |
| CN | 205456831 | U | 8/2016 |
| CN | 106256286 | A | 12/2016 |
| CN | 205963257 | U | 2/2017 |
| CN | 103355927 | B | 3/2017 |
| CN | 205993856 | U | 3/2017 |
| CN | 206043777 | U | 3/2017 |
| CN | 206043778 | U | 3/2017 |
| CN | 206043779 | U | 3/2017 |
| CN | 103355926 | B | 4/2017 |
| CN | 103355928 | B | 4/2017 |
| CN | 103355929 | B | 4/2017 |
| CN | 103519540 | B | 4/2017 |
| CN | 206150740 | U | 5/2017 |
| CN | 206338218 | U | 7/2017 |
| CN | 206354632 | U | 7/2017 |
| CN | 206517192 | U | 9/2017 |
| CN | 107224080 | A | 10/2017 |
| CN | 206651501 | U | 11/2017 |
| CN | 206699677 | U | 12/2017 |
| CN | 206744836 | U | 12/2017 |
| CN | 104337192 | B | 1/2018 |
| CN | 207023591 | U | 2/2018 |
| CN | 207023592 | U | 2/2018 |
| CN | 207168088 | U | 4/2018 |
| CN | 207322932 | U | 5/2018 |
| CN | 207322933 | U | 5/2018 |
| CN | 207355685 | U | 5/2018 |
| CN | 207544575 | U | 6/2018 |
| CN | 207544576 | U | 6/2018 |
| CN | 108402637 | A | 8/2018 |
| CN | 207767746 | U | 8/2018 |
| CN | 108567216 | A | 9/2018 |
| CN | 207803715 | U | 9/2018 |
| CN | 104273917 | B | 10/2018 |
| CN | 104273919 | B | 10/2018 |
| CN | 104510138 | B | 10/2018 |
| CN | 207939324 | U | 10/2018 |
| CN | 104273920 | B | 11/2018 |
| CN | 104510137 | B | 11/2018 |
| CN | 208144696 | U | 11/2018 |
| CN | 208144697 | U | 11/2018 |
| CN | 105392386 | B | 12/2018 |
| CN | 108991700 | A | 12/2018 |
| CN | 109090797 | A | 12/2018 |
| CN | 208339134 | U | 1/2019 |
| CN | 104273918 | B | 2/2019 |
| CN | 208524016 | U | 2/2019 |
| CN | 109497683 | A | 3/2019 |
| CN | 105559311 | B | 4/2019 |
| CN | 106989039 | B | 5/2019 |
| CN | 209073632 | U | 7/2019 |
| CN | 104921435 | B | 8/2019 |
| CN | 106256287 | B | 8/2019 |
| CN | 110074535 | A | 8/2019 |
| CN | 106333459 | B | 9/2019 |
| CN | 209573664 | U | 11/2019 |
| CN | 105473022 | B | 2/2020 |
| CN | 210055005 | U | 2/2020 |
| CN | 210055006 | U | 2/2020 |
| CN | 106256282 | B | 3/2020 |
| CN | 111140550 | A | 5/2020 |
| CN | 111140551 | A | 5/2020 |
| CN | 111202335 | A | 5/2020 |
| CN | 210471314 | U | 5/2020 |
| CN | 111248594 | A | 6/2020 |
| CN | 111374423 | A | 7/2020 |
| CN | 111387672 | A | 7/2020 |
| CN | 111432684 | A | 7/2020 |
| CN | 211039166 | U | 7/2020 |
| CN | 106820534 | B | 8/2020 |
| CN | 111520906 | A | 8/2020 |
| CN | 211154233 | U | 8/2020 |
| CN | 211459143 | U | 9/2020 |
| CN | 105407757 | B | 10/2020 |
| CN | 106880155 | B | 10/2020 |
| CN | 106974416 | B | 10/2020 |
| CN | 211672808 | U | 10/2020 |
| CN | 211820129 | U | 10/2020 |
| CN | 106974415 | B | 11/2020 |
| CN | 107847031 | B | 11/2020 |
| CN | 108206600 | B | 11/2020 |
| CN | 211984215 | U | 11/2020 |
| CN | 211984221 | U | 11/2020 |
| CN | 212185556 | U | 12/2020 |
| CN | 112315167 | A | 2/2021 |
| CN | 112336037 | A | 2/2021 |
| CN | 112352109 | A | 2/2021 |
| CN | 108618334 | B | 4/2021 |
| CN | 106963093 | B | 5/2021 |
| CN | 108618333 | B | 5/2021 |
| CN | 213096652 | U | 5/2021 |
| CN | 213215774 | U | 5/2021 |
| CN | 106165959 | B | 6/2021 |
| CN | 107224085 | B | 6/2021 |
| CN | 107317521 | B | 6/2021 |
| CN | 106256284 | B | 7/2021 |
| CN | 113080592 | A | 7/2021 |
| CN | 113080595 | A | 7/2021 |
| CN | 113180525 | * | 7/2021 |
| CN | 113180525 | A | 7/2021 |
| CN | 105407756 | B | 8/2021 |
| CN | 106901482 | B | 8/2021 |
| CN | 107224087 | B | 8/2021 |
| CN | 107224077 | B | 9/2021 |
| CN | 113437901 | A | 9/2021 |
| CN | 113572297 | A | 10/2021 |
| CN | 109788833 | B | 11/2021 |
| CN | 109674176 | B | 3/2022 |
| CN | 218791006 | U | 4/2023 |
| CN | 116114987 | A | 5/2023 |
| CN | 116685236 | A | 9/2023 |
| DE | 102012220756 | B4 | 2/2017 |
| DE | 202014011043 | U1 | 7/2017 |
| EP | 1334670 | B1 | 12/2004 |
| EP | 1779745 | B1 | 5/2008 |
| EP | 2138065 | A1 | 12/2009 |
| EP | 2745729 | B1 | 11/2015 |
| EP | 2656746 | B1 | 12/2015 |
| EP | 3119235 | A1 | 1/2017 |
| EP | 3119236 | A1 | 1/2017 |
| EP | 2830462 | B1 | 6/2018 |
| EP | 3016545 | B1 | 6/2018 |
| EP | 3158890 | B1 | 8/2018 |
| EP | 3024352 | B1 | 10/2018 |
| EP | 3386343 | A1 | 10/2018 |
| EP | 3206523 | B1 | 12/2018 |
| EP | 3016541 | B1 | 1/2019 |
| EP | 3235397 | B1 | 2/2019 |
| EP | 3310207 | B1 | 2/2019 |
| EP | 3172985 | B1 | 4/2019 |
| EP | 3232853 | B1 | 4/2019 |
| EP | 3016540 | B1 | 5/2019 |
| EP | 3048926 | B1 | 6/2019 |
| EP | 3048925 | B1 | 7/2019 |
| EP | 3506786 | A1 | 7/2019 |
| EP | 3512372 | A1 | 7/2019 |
| EP | 3516986 | A1 | 7/2019 |
| EP | 3364816 | B1 | 10/2019 |
| EP | 2830457 | B1 | 12/2019 |
| EP | 2830459 | B1 | 12/2019 |
| EP | 3622780 | A1 | 3/2020 |
| EP | 2869726 | B1 | 4/2020 |

(56) References Cited

FOREIGN PATENT DOCUMENTS

| | | | |
|---|---|---|---|
| EP | 2869727 | B1 | 4/2020 |
| EP | 3432759 | B1 | 6/2020 |
| EP | 3016544 | B1 | 7/2020 |
| EP | 3310204 | B1 | 7/2020 |
| EP | 3687335 | A1 | 8/2020 |
| EP | 3328237 | B1 | 11/2020 |
| EP | 3319473 | B1 | 2/2021 |
| EP | 3432757 | B1 | 2/2021 |
| EP | 3834654 | A1 | 6/2021 |
| EP | 3874171 | A1 | 9/2021 |
| EP | 3119234 | B1 | 11/2021 |
| ES | 2233765 | T3 | 6/2005 |
| ES | 2559438 | T3 | 2/2016 |
| ES | 2683041 | T3 | 9/2018 |
| ES | 2696900 | T3 | 1/2019 |
| ES | 2703203 | T3 | 3/2019 |
| ES | 2704856 | T3 | 3/2019 |
| ES | 2721185 | T3 | 7/2019 |
| ES | 2730412 | T3 | 11/2019 |
| ES | 2732428 | T3 | 11/2019 |
| ES | 2741441 | T3 | 2/2020 |
| ES | 2837131 | T3 | 6/2021 |
| FR | 3039377 | B1 | 9/2017 |
| GB | 2374801 | A | 10/2002 |
| GB | 2501175 | B | 4/2014 |
| GB | 2500798 | B | 5/2014 |
| GB | 2500800 | B | 5/2014 |
| GB | 2501379 | B | 5/2014 |
| GB | 2500801 | B | 7/2014 |
| GB | 2511219 | B | 5/2015 |
| GB | 2515809 | B | 8/2015 |
| GB | 2515810 | B | 11/2015 |
| GB | 2515811 | B | 11/2015 |
| GB | 2515812 | B | 2/2016 |
| GB | 2516478 | B | 3/2016 |
| GB | 2518639 | B | 3/2016 |
| GB | 2531431 | B | 11/2016 |
| GB | 2521144 | B | 12/2016 |
| GB | 2526768 | B | 2/2017 |
| GB | 2503683 | B | 4/2017 |
| GB | 2524304 | B | 4/2017 |
| GB | 2526049 | B | 4/2017 |
| GB | 2515813 | B | 7/2017 |
| GB | 2548813 | A | 10/2017 |
| GB | 2548817 | A | 10/2017 |
| GB | 2533324 | B | 12/2017 |
| GB | 2552445 | A | 1/2018 |
| GB | 2503687 | B | 2/2018 |
| GB | 2547138 | B | 3/2018 |
| GB | 2534379 | B | 5/2018 |
| GB | 2539439 | B | 5/2018 |
| GB | 2545412 | B | 6/2018 |
| GB | 2539437 | B | 7/2018 |
| GB | 2540203 | B | 7/2018 |
| GB | 2551852 | B | 9/2018 |
| GB | 2539432 | B | 1/2019 |
| GB | 2539441 | B | 1/2019 |
| GB | 2543536 | B | 1/2019 |
| GB | 2558415 | B | 2/2019 |
| GB | 2543751 | B | 4/2019 |
| GB | 2549740 | B | 4/2019 |
| GB | 2538560 | B | 5/2019 |
| GB | 2548816 | B | 9/2019 |
| GB | 2548812 | B | 10/2019 |
| GB | 2553516 | B | 1/2020 |
| GB | 2565698 | B | 1/2020 |
| GB | 2548616 | B | 2/2020 |
| GB | 2560888 | B | 4/2020 |
| GB | 2548819 | B | 5/2020 |
| GB | 2557958 | B | 5/2020 |
| GB | 2580416 | A | 7/2020 |
| GB | 2560889 | B | 9/2020 |
| GB | 2567661 | B | 9/2020 |
| GB | 202015444 | | 11/2020 |
| GB | 202015445 | | 11/2020 |
| GB | 2562276 | B | 4/2021 |
| GB | 2576017 | B | 4/2021 |
| GB | 2575297 | B | 5/2021 |
| GB | 2581371 | B | 9/2021 |
| GB | 2581372 | B | 12/2021 |
| HK | 1185235 | A1 | 9/2014 |
| HK | 1185236 | A1 | 9/2014 |
| HK | 1189471 | A1 | 9/2014 |
| HK | 1200671 | A1 | 3/2016 |
| HK | 1221617 | A1 | 6/2017 |
| IL | 236277 | | 2/2015 |
| IL | 236278 | | 2/2015 |
| IL | 247601 | | 11/2016 |
| IL | 247694 | | 11/2016 |
| IL | 252183 | | 7/2017 |
| IL | 236277 | A | 5/2018 |
| JP | S4910787 | U | 1/1974 |
| JP | S52152366 | A | 12/1977 |
| JP | S53099284 | U | 8/1978 |
| JP | S56153303 | U | 11/1981 |
| JP | 57140203 | U | 9/1982 |
| JP | S57211306 | A | 12/1982 |
| JP | H0640318 | U | 5/1994 |
| JP | H0893696 | A | 4/1996 |
| JP | H10257918 | A | 9/1998 |
| JP | 2013212383 | A | 10/2013 |
| JP | 2013212385 | A | 10/2013 |
| JP | 2013212387 | A | 10/2013 |
| JP | 2013212388 | A | 10/2013 |
| JP | 2014012142 | A | 1/2014 |
| JP | 2014012143 | A | 1/2014 |
| JP | 2014217770 | A | 11/2014 |
| JP | 5674852 | B2 | 1/2015 |
| JP | 2015013124 | A | 1/2015 |
| JP | 2015013125 | A | 1/2015 |
| JP | 2015013127 | A | 1/2015 |
| JP | 2015023798 | A | 2/2015 |
| JP | 2015024137 | A | 2/2015 |
| JP | 5709926 | B2 | 3/2015 |
| JP | 2015066446 | A | 4/2015 |
| JP | 2015066447 | A | 4/2015 |
| JP | 2015097941 | A | 5/2015 |
| JP | 5758944 | B2 | 6/2015 |
| JP | 5760030 | B2 | 6/2015 |
| JP | 2015181946 | A | 10/2015 |
| JP | 2015181947 | A | 10/2015 |
| JP | 2016040008 | A | 3/2016 |
| JP | 5913465 | B2 | 4/2016 |
| JP | 5923062 | B2 | 4/2016 |
| JP | 2016083586 | A | 5/2016 |
| JP | 5953642 | B2 | 6/2016 |
| JP | 2016112424 | A | 6/2016 |
| JP | 2016129688 | A | 7/2016 |
| JP | 2016129780 | A | 7/2016 |
| JP | 2016131890 | A | 7/2016 |
| JP | 5990839 | B2 | 8/2016 |
| JP | 2016523648 | A | 8/2016 |
| JP | 6008302 | B2 | 9/2016 |
| JP | 2016526429 | A | 9/2016 |
| JP | 6035635 | B2 | 11/2016 |
| JP | 2016214879 | A | 12/2016 |
| JP | 2017006664 | A | 1/2017 |
| JP | 2017006665 | A | 1/2017 |
| JP | 2017006666 | A | 1/2017 |
| JP | 2017006668 | A | 1/2017 |
| JP | 2017006669 | A | 1/2017 |
| JP | 2017018593 | A | 1/2017 |
| JP | 6085841 | B2 | 2/2017 |
| JP | 6129943 | B2 | 4/2017 |
| JP | 2017077470 | A | 4/2017 |
| JP | 2017077471 | A | 4/2017 |
| JP | 2017077472 | A | 4/2017 |
| JP | 2017079592 | A | 4/2017 |
| JP | 2017512589 | A | 5/2017 |
| JP | 6161762 | B2 | 6/2017 |
| JP | 2017094095 | A | 6/2017 |
| JP | 2017094096 | A | 6/2017 |
| JP | 2017140364 | A | 8/2017 |
| JP | 6208265 | B2 | 9/2017 |

(56) References Cited

FOREIGN PATENT DOCUMENTS

| | | | |
|---|---|---|---|
| JP | 2017170147 | A | 9/2017 |
| JP | 2017170149 | A | 9/2017 |
| JP | 2017170150 | A | 9/2017 |
| JP | 2017185217 | A | 10/2017 |
| JP | 2017200432 | A | 11/2017 |
| JP | 6278854 | B2 | 1/2018 |
| JP | 6291523 | B2 | 2/2018 |
| JP | 6297958 | B2 | 3/2018 |
| JP | 2018033968 | A | 3/2018 |
| JP | 1601521 | S | 4/2018 |
| JP | 1601704 | S | 4/2018 |
| JP | 6332918 | B2 | 5/2018 |
| JP | 6343633 | B2 | 5/2018 |
| JP | 1605735 | S | 6/2018 |
| JP | 1605795 | S | 6/2018 |
| JP | 1605796 | S | 6/2018 |
| JP | 6344570 | B2 | 6/2018 |
| JP | 2018086277 | A | 6/2018 |
| JP | 1608558 | S | 7/2018 |
| JP | 1608559 | S | 7/2018 |
| JP | 1608560 | S | 7/2018 |
| JP | 1608561 | S | 7/2018 |
| JP | 1608562 | S | 7/2018 |
| JP | 2018110514 | A | 7/2018 |
| JP | 1611708 | S | 8/2018 |
| JP | 1614327 | S | 9/2018 |
| JP | 1614374 | S | 9/2018 |
| JP | 1614531 | S | 9/2018 |
| JP | 1614547 | S | 9/2018 |
| JP | 6386547 | B2 | 9/2018 |
| JP | 6416155 | B2 | 10/2018 |
| JP | 6416173 | B2 | 10/2018 |
| JP | 2018158110 | A | 10/2018 |
| JP | 2018158111 | A | 10/2018 |
| JP | 1617128 | S | 11/2018 |
| JP | 1617131 | S | 11/2018 |
| JP | 1617132 | S | 11/2018 |
| JP | 1617133 | S | 11/2018 |
| JP | 1617384 | S | 11/2018 |
| JP | 1617385 | S | 11/2018 |
| JP | 1617386 | S | 11/2018 |
| JP | 1617387 | S | 11/2018 |
| JP | 1617388 | S | 11/2018 |
| JP | 1617389 | S | 11/2018 |
| JP | 1617390 | S | 11/2018 |
| JP | 1617391 | S | 11/2018 |
| JP | 1617392 | S | 11/2018 |
| JP | 1617398 | S | 11/2018 |
| JP | 1617399 | S | 11/2018 |
| JP | 1617400 | S | 11/2018 |
| JP | 1617401 | S | 11/2018 |
| JP | 1617402 | S | 11/2018 |
| JP | 1617403 | S | 11/2018 |
| JP | 1617404 | S | 11/2018 |
| JP | 1617405 | S | 11/2018 |
| JP | 1617406 | S | 11/2018 |
| JP | 1617407 | S | 11/2018 |
| JP | 1617408 | S | 11/2018 |
| JP | 1617409 | S | 11/2018 |
| JP | 1617410 | S | 11/2018 |
| JP | 1617411 | S | 11/2018 |
| JP | 1618289 | S | 11/2018 |
| JP | 1618303 | S | 11/2018 |
| JP | 1618610 | S | 11/2018 |
| JP | 6434452 | B2 | 11/2018 |
| JP | 2018190728 | A | 11/2018 |
| JP | 1619541 | S | 12/2018 |
| JP | 1620038 | S | 12/2018 |
| JP | 6444361 | B2 | 12/2018 |
| JP | 6453814 | B2 | 12/2018 |
| JP | 6453829 | B2 | 12/2018 |
| JP | 6456879 | B2 | 12/2018 |
| JP | 6475261 | B2 | 2/2019 |
| JP | 1625926 | S | 3/2019 |
| JP | 6511080 | B2 | 4/2019 |
| JP | 6512713 | B2 | 4/2019 |
| JP | 6518281 | B2 | 4/2019 |
| JP | 6522914 | B2 | 5/2019 |
| JP | 6523157 | B2 | 5/2019 |
| JP | 6533480 | B2 | 5/2019 |
| JP | 2019076720 | A | 5/2019 |
| JP | 1634971 | S | 6/2019 |
| JP | 1634972 | S | 6/2019 |
| JP | 1634973 | S | 6/2019 |
| JP | 6538010 | B2 | 6/2019 |
| JP | 6542180 | B2 | 6/2019 |
| JP | 1637643 | S | 7/2019 |
| JP | 6556183 | B2 | 7/2019 |
| JP | 6557650 | B2 | 7/2019 |
| JP | 6557695 | B2 | 7/2019 |
| JP | 6599917 | B2 | 10/2019 |
| JP | 2019193568 | A | 10/2019 |
| JP | 6625527 | B2 | 12/2019 |
| JP | 6634296 | B2 | 12/2019 |
| JP | 6662936 | B2 | 2/2020 |
| JP | 3225772 | U | 3/2020 |
| JP | 2020047605 | A | 3/2020 |
| JP | 3226032 | U | 4/2020 |
| JP | 6723287 | B2 | 7/2020 |
| JP | 6723961 | B2 | 7/2020 |
| JP | 6738839 | B2 | 8/2020 |
| JP | 6779198 | B2 | 11/2020 |
| JP | 6792318 | B2 | 11/2020 |
| JP | 6811290 | B2 | 1/2021 |
| JP | 6854109 | B2 | 4/2021 |
| JP | 6861790 | B2 | 4/2021 |
| JP | 6890571 | B2 | 5/2021 |
| JP | 6924442 | B2 | 8/2021 |
| KR | 20140129309 | A | 11/2014 |
| KR | 20140129310 | A | 11/2014 |
| KR | 20140129322 | A | 11/2014 |
| KR | 20140129323 | A | 11/2014 |
| KR | 20140129324 | A | 11/2014 |
| KR | 20140138797 | A | 12/2014 |
| KR | 20150023773 | A | 3/2015 |
| KR | 20150023774 | A | 3/2015 |
| KR | 20150065051 | A | 6/2015 |
| KR | 20160020555 | A | 2/2016 |
| KR | 20160020556 | A | 2/2016 |
| KR | 20160020557 | A | 2/2016 |
| KR | 20160020558 | A | 2/2016 |
| KR | 20160021265 | A | 2/2016 |
| KR | 20160021294 | A | 2/2016 |
| KR | 20160021862 | A | 2/2016 |
| KR | 20160052719 | A | 5/2016 |
| KR | 20160052720 | A | 5/2016 |
| KR | 20160052721 | A | 5/2016 |
| KR | 20160075829 | A | 6/2016 |
| KR | 20160075831 | A | 6/2016 |
| KR | 20160079142 | A | 7/2016 |
| KR | 20160079144 | A | 7/2016 |
| KR | 20160079146 | A | 7/2016 |
| KR | 101660347 | B1 | 9/2016 |
| KR | 20160126073 | A | 11/2016 |
| KR | 20160126074 | A | 11/2016 |
| KR | 20160004256 | U | 12/2016 |
| KR | 101693281 | B1 | 1/2017 |
| KR | 20170001743 | A | 1/2017 |
| KR | 101713997 | B1 | 3/2017 |
| KR | 101726280 | B1 | 4/2017 |
| KR | 20170001222 | U | 4/2017 |
| KR | 101761297 | B1 | 7/2017 |
| KR | 20170084313 | A | 7/2017 |
| KR | 101771206 | B1 | 8/2017 |
| KR | 20170105100 | A | 9/2017 |
| KR | 20170139700 | A | 12/2017 |
| KR | 20180010248 | A | 1/2018 |
| KR | 20180017193 | A | 2/2018 |
| KR | 20180017194 | A | 2/2018 |
| KR | 20180017196 | A | 2/2018 |
| KR | 20180017197 | A | 2/2018 |
| KR | 20180030620 | A | 3/2018 |
| KR | 101844912 | B1 | 4/2018 |
| KR | 20180033312 | A | 4/2018 |

(56) References Cited

FOREIGN PATENT DOCUMENTS

| | | | |
|---|---|---|---|
| KR | 101855222 | B1 | 5/2018 |
| KR | 101855223 | B1 | 5/2018 |
| KR | 20180069051 | A | 6/2018 |
| KR | 20180069894 | A | 6/2018 |
| KR | 20180071986 | A | 6/2018 |
| KR | 20180072754 | A | 6/2018 |
| KR | 20180086444 | A | 7/2018 |
| KR | 101900840 | B1 | 9/2018 |
| KR | 20180105275 | A | 9/2018 |
| KR | 101909949 | B1 | 10/2018 |
| KR | 20180110243 | A | 10/2018 |
| KR | 101921159 | B1 | 11/2018 |
| KR | 20180003187 | U | 11/2018 |
| KR | 20180003188 | U | 11/2018 |
| KR | 20180003197 | U | 11/2018 |
| KR | 20180120253 | A | 11/2018 |
| KR | 20180120254 | A | 11/2018 |
| KR | 20180120815 | A | 11/2018 |
| KR | 20180121607 | A | 11/2018 |
| KR | 20180121984 | A | 11/2018 |
| KR | 20180124165 | A | 11/2018 |
| KR | 20180128480 | A | 12/2018 |
| KR | 101946431 | B1 | 2/2019 |
| KR | 101949900 | B1 | 2/2019 |
| KR | 20190017075 | A | 2/2019 |
| KR | 101953713 | B1 | 3/2019 |
| KR | 101963674 | B1 | 3/2019 |
| KR | 101964103 | B1 | 4/2019 |
| KR | 101965272 | B1 | 4/2019 |
| KR | 20190037328 | A | 4/2019 |
| KR | 101953711 | B1 | 5/2019 |
| KR | 101978707 | B1 | 5/2019 |
| KR | 101983111 | B1 | 5/2019 |
| KR | 20190001036 | U | 5/2019 |
| KR | 101990944 | B1 | 6/2019 |
| KR | 101992734 | B1 | 6/2019 |
| KR | 102007214 | B1 | 8/2019 |
| KR | 102007215 | B1 | 8/2019 |
| KR | 200489784 | Y1 | 8/2019 |
| KR | 102018622 | B1 | 9/2019 |
| KR | 102018623 | B1 | 9/2019 |
| KR | 102010940 | B1 | 10/2019 |
| KR | 102030102 | B1 | 10/2019 |
| KR | 102030103 | B1 | 10/2019 |
| KR | 102031600 | B1 | 10/2019 |
| KR | 20190122864 | A | 10/2019 |
| KR | 102041173 | B1 | 11/2019 |
| KR | 20190126159 | A | 11/2019 |
| KR | 20190141227 | A | 12/2019 |
| KR | 200490784 | Y1 | 1/2020 |
| KR | 102074285 | B1 | 2/2020 |
| KR | 200491247 | Y1 | 3/2020 |
| KR | 102101642 | B1 | 4/2020 |
| KR | 102101643 | B1 | 4/2020 |
| KR | 102102243 | B1 | 4/2020 |
| KR | 102121904 | B1 | 6/2020 |
| KR | 20200068710 | A | 6/2020 |
| KR | 102158115 | B1 | 9/2020 |
| KR | 20200116277 | A | 10/2020 |
| KR | 102175883 | B1 | 11/2020 |
| KR | 102210212 | B1 | 1/2021 |
| KR | 20210012063 | A | 2/2021 |
| KR | 102328006 | B1 | 11/2021 |
| TW | M494533 | U | 2/2015 |
| WO | 8804542 | A1 | 6/1988 |
| WO | 2021078633 | A1 | 4/2021 |
| WO | WO 2021078633 | * | 4/2021 |
| WO | 2022069857 | A1 | 4/2022 |
| WO | 2022069858 | A1 | 4/2022 |
| WO | 2022069859 | A1 | 4/2022 |
| WO | 2022069860 | A1 | 4/2022 |
| WO | 2022069864 | A1 | 4/2022 |
| WO | 2022069865 | A1 | 4/2022 |
| WO | 2022069881 | A1 | 4/2022 |

OTHER PUBLICATIONS

Machine Translation of Fuin et al. (Year: 2021).*

Machine Translation of Han reference provided in IDS filed Jun. 17, 2024) (Year: 2020).*

European Search Report for Application No. EP 22184225.5, mailed on Nov. 16, 2022, 4 pages.

Invitation to Pay Additional Fees for Application No. PCT/US22/74663, mailed on Nov. 16, 2022, 19 pages.

U.S. Appl. No. 18/802,822, filed Aug. 13, 2024, Hair Care Appliance.

U.S. Appl. No. 18/298,770, filed Apr. 11, 2023, Hair Care Appliance.

U.S. Appl. No. 19/018,584, filed Jan. 13, 2025, Hair Care Appliance.

* cited by examiner

HAIR CARE APPLIANCE

CROSS-REFERENCE TO RELATED APPLICATIONS

This application is a continuation of U.S. patent Application Ser. No. 17/737,565 filed May 5, 2022 and entitled "Hair Care Appliance," which claims priority under 35 U.S.C. § 119(e) to U.S. Provisional Application No. 63/279,041, filed Nov. 12, 2021, entitled "Hair Care Appliance," the entire contents of which are hereby expressly incorporated by reference herein.

BACKGROUND

Hair care appliances are devices used for drying and styling of hair. Hair care appliances can include a variety of components operable to provide a fluid flow via a fluid flow path extending through the device. The fluid flow path receives ambient air and directs the ambient air through the hair care appliance via a motor and fan assembly. The fluid flow path is directed across a heating assembly to generate heated air at an outlet of the hair care appliance. Air is expelled from the hair care appliance via the fluid flow path to enable a user to dry or style hair. One or more attachments are often used with the hair care appliance depending on the user's hair styling or treatment needs.

SUMMARY

In general, hair care devices and accessories are provided for use in drying and/or styling hair. In one embodiment, a hair care appliance is provided and can include a handle and a body movably coupled to one another at a joint such that the body can be movable between a straight configuration in which the body can be longitudinally aligned with a longitudinal axis of the handle and a bent configuration in which the body can extend along an axis transverse to the longitudinal axis of the handle. The handle and the body can have a fluid flow path extending there through from an inlet in the handle to an outlet in the body, and a first diverter disposed in the body and configured to partition fluid in the fluid flow path in both the straight and bent configurations.

In another embodiment, the diverter can extend in a plane transverse to the longitudinal axis of the body. In another embodiment, the hair care appliance can include a second diverted in the handle. The second diverter can distribute the fluid flow in a uniformly radial manner in the handle. In another embodiment, at least a portion of the joint can extend into the fluid flow path such that fluid flow is non-linear through the joint. In another embodiment, the joint can include a rotation joint rotatable about a plane extending at an angle relative to the longitudinal axis of the handle. In an exemplary embodiment, the angle can have a range of about 30 to 50 degrees. In another embodiment, the hair care appliance can include a heater positioned between the diverter and the outlet. In another embodiment, the hair care appliance can include a heater positioned between the first diverter and the outlet, the first diverter being configured to direct the fluid flow in a radially uniform manner through the heater. The first diverter can be configured to distribute the fluid flow equally into an upper portion and a lower portion through the heater and the outlet. In another embodiment, the first diverter can include rounded edges reducing turbulence of the fluid flow over the diverter. In another embodiment, the fluid flow path can be sealed within the handle and the body.

In another aspect a hair care appliance is provided and can include a housing including a handle having an inlet, a body coupled to the handle and having an outlet, and a fluid flow path through the housing between the inlet and the outlet. The body can be movable between a straight configuration in which the body extends along a longitudinal axis of the handle, and a bent configuration in which the body extends along an axis transverse to the longitudinal axis of the handle. The hair care appliance can also include a fan assembly disposed within the housing and configured to generate a flow of fluid at a flow rate from the inlet along the fluid flow path to the outlet. The flow rate in the bent configuration can be no more than 11 percent less than the flow rate in the straight configuration.

In another embodiment, the body can extend obliquely to the handle in the bent configuration. In another embodiment, the handle can have a length that is greater than a length of the body. In another embodiment, the flow rate in the bent configuration can be in a range of about 18.0 m/s to 31.5 m/s, and the flow rate in the straight configuration can be in a range of about 18.5 m/s to 35.5 m/s. A ratio of a maximum flow rate to a minimum flow rate can be used to demonstrate the consistency of flow rate provided by the hair care appliance in the bent and straight configurations. For example, in an embodiment, a max:min ratio of the flow rate in the bent configuration can be about 1.7, and a max:min ratio of the flow rate in the straight configuration can be about 1.6. In another embodiment, the fan assembly can be disposed within the handle adjacent to a pivot joint formed between the handle and the body.

In another aspect a hair care appliance is provided and can include a handle and a body movably coupled to one another at a joint. The handle and the body can have a fluid flow path extending there through between an inlet in the handle and an outlet in the body. The handle can have a printed circuit board (PCB), a fan assembly having a central shaft and a plurality of vanes extending radially outward from the central shaft, and a hub disposed between the PCB and the fan assembly. The hub can include a central dome configured to direct fluid flowing around the PCB radially outward toward the plurality of vanes.

DESCRIPTION OF DRAWINGS

These and other features will be more readily understood from the following detailed description taken in conjunction with the accompanying drawings, in which:

FIG. 61 is a cross-sectional view of the diffuser attachment of FIG. 58 showing a fluid flow path there through;

It is noted that the drawings are not necessarily to scale. The drawings are intended to depict only typical aspects of the subject matter disclosed herein, and therefore should not be considered as limiting the scope of the disclosure.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments.

Such modifications and variations are intended to be included within the scope of the present invention.

Various exemplary hair care appliances and accessories for use with a hair care appliance are provided herein. In general, the hair care appliance is in the form of a hair dryer that has an elongate generally cylindrical configuration with a handle and a body that are movably coupled to one another. The handle is configured to move relative to the body to transition the appliance from a straight configuration to a bent configuration, thus allowing a user to select a desired configured based on an intended use. The hair care appliance also includes various internal components that facilitate use and operation of the hair care appliance. Various accessories are also provided for use with the hair care appliance, and the configuration of the appliance can be varied based on the type of accessory mated to the hair care appliance. In certain embodiments, the accessory can limit a configuration of the hair care appliance. For example, at least one accessory is provided that mates to the hair dryer in the straight configuration, and prevents movement of the hair care appliance to the bent configuration. Other accessories, on the other hand, can mate in a manner that enables use of the hair dryer in a selected configuration. In some embodiments, the accessories can be attached the hair care appliance in permanently fixed positions. In other aspects, a hair care appliance is provided that lacks a rotational hinge joint. In such embodiments, one hair care appliance can be provided having a straight configuration, and a second hair care appliance can be provided having an angled configuration. The accessories described herein can be used with any of the aforementioned hair care appliances, or with any other hair care appliance known in the art.

Figure 2:
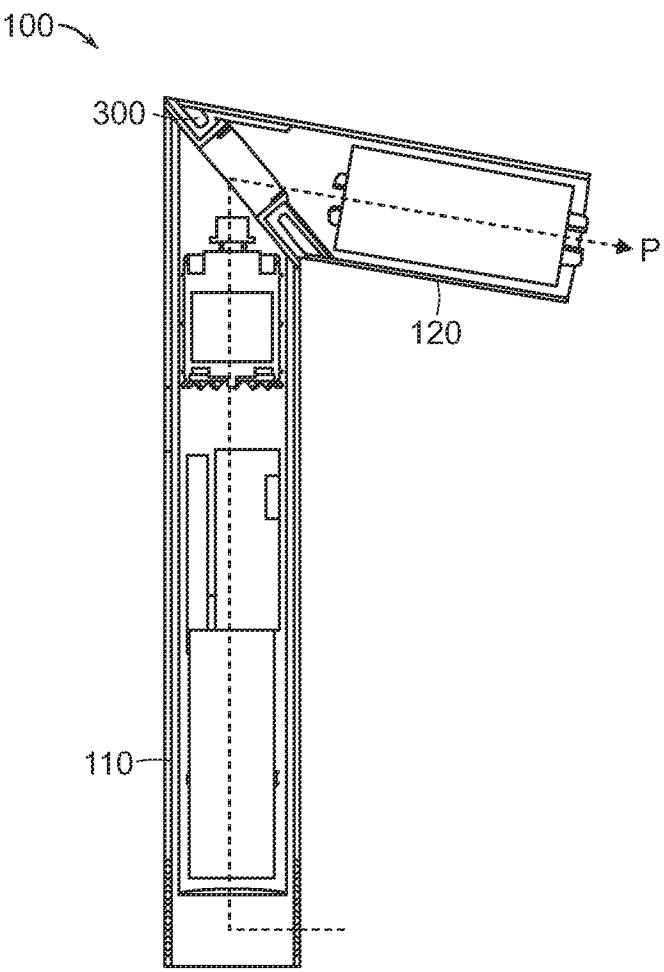
FIG. 2 is a side cross-sectional view of the hair care appliance of FIG. 1 shown in an angled or bent configuration.
Figure 1:
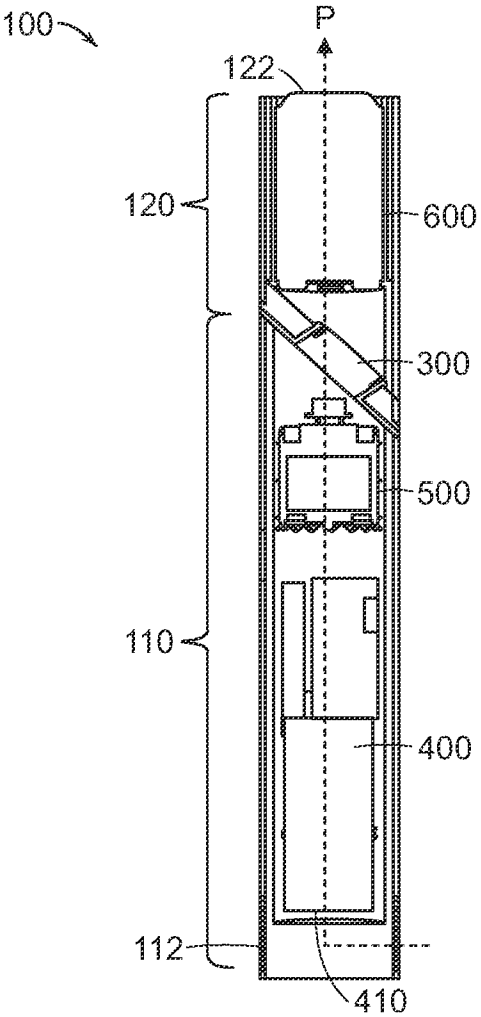
FIG. 1 is a side cross-sectional view of one exemplary embodiment of a hair care appliance shown in a straight configuration.

FIGS. 1 and 2 illustrate one exemplary embodiment of a hair care appliance 100 shown in a straight configuration and a bent configuration, respectively. As shown, the hair care appliance 100 generally includes a handle 110 movably coupled to a body 120 by a rotational hinge joint 300. In the straight configuration, shown in FIG. 1, the appliance 100 has a generally elongate cylindrical shape. The handle 110 has an inlet 112 at a first end of the appliance 100 and the body has an outlet 122 at a second end of the appliance. A fluid flow path P shown as a dashed line is formed between the inlet 112 and the outlet 122. The rotational hinge joint 300 formed between the handle 110 and the body 120 can articulate via user operation to alter the configuration of the hair care appliance 100 and the fluid flow path P from the straight configuration to the bent or angled configuration. As shown in FIG. 2, the handle 110 and the body 120 are angled relative to one another as a result of articulation of the rotational hinge joint 300. As a result, the fluid flow path P shown by a dashed line is angled between the handle 110 and the body 120.

A person skilled in the art will appreciate that the hair care appliance 100 can be operated while the rotational hinge joint 300 is unlatched, and/or while the rotational hinge joint 300 is rotated to any position that is between the position of the rotational hinge joint 300 in the straight configuration and the angled configuration. In other aspects, the hair care appliance 100 and the rotational hinge joint 300 can be configured to prevent over-rotation of the rotational hinge joint 300 beyond its position in the angled configuration. The hair care appliance 100 can be configured in a fully straight configuration, as shown in FIG. 1, in which the rotational hinge joint locks the body so as to be longitudinally aligned with the handle. The hair care appliance 100 can be configured in a fully bent configuration, as shown in FIG. 2, in which the rotational hinge joint locks the body at an angle relative to the handle. The hair care appliance 100 can also be configured in a rotated configuration in which the rotational hinge joint positions the body relative to the handle in a range of angled positions that are in between those of the fully straight configuration and the fully bent configuration.

The handle 110 can include various internal electrical components 400 for operating the appliance. In general, the handle can include electrical components 400 that can control operation of a fan assembly 500 disposed within the handle 110 and a heater assembly 600 disposed in the body 120. In an exemplary embodiment, as shown, the fan assembly 500 can be placed downstream of the rotational hinge joint 300 and in proximity of the heater assembly 600, which is disposed upstream of the rotational hinge joint 300. This can help improve fluid flow within the hair care appliance 100. The fan assembly 500 can generate a fluid flow along the fluid flow path P such that air is drawn into the inlet 112, passes through the handle 110, and into the body 120 to be exhausted via the outlet 122. As the air passes through the body 120, the air can be heated via the heater assembly 600.

Figure 3:
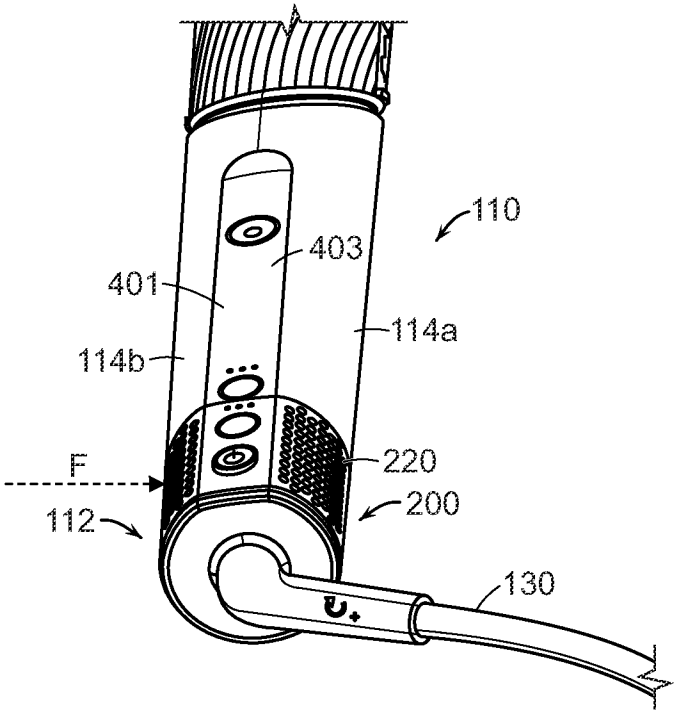
FIG. 3 is a perspective end view of a handle of the hair care appliance of FIG. 1.

The electrical components 400 can be configured to couple to a power supply 410. FIG. 3 illustrates a power supply cord 130 extending from a base of the handle 110. The power supply cord 130 can have a terminal end (not shown) configured to couple to a power source, e.g., the terminal end can be configured to plug into an electrical outlet. The power supply cord 130 can include internal electrical wiring for delivering power to the electronics in the handle 110. The power supply cord 130 may be connected to an electronics housing containing at least one controller or PCB. As further shown in FIG. 3, the handle 110 can include a scalloped portion 403 where the user interface 401 can be located.

Figure 4:
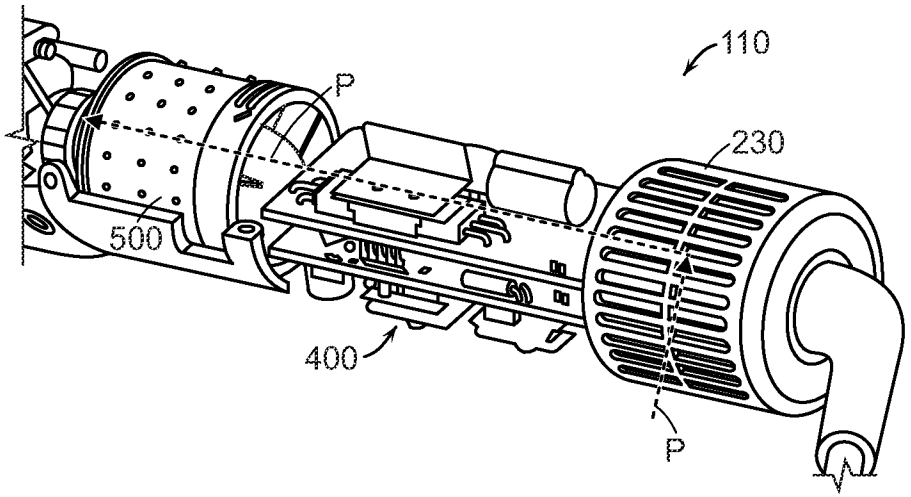
FIG. 4 is a perspective view of the handle of FIG. 1 shown with the inlet housing removed.

As further shown in FIG. 3, the end of the handle 110 can include a filter assembly 200 for filtering air drawn in through the inlet 112. In the illustrated embodiment, the filter extends around the proximal end portion of the handle 110, but is not formed in the end wall of the handle 110. Thus, fluid D is drawn in circumferentially around the sidewalls of the handle 110. The illustrated filter assembly 200 includes an inlet housing 220 that is generally C-shaped and that is flexible for allowing the inlet housing 220 to be removed for cleaning. A user interface 401 can intersect the inlet housing 220. The inlet housing 220 has a plurality of holes through which the fluid can flow into the fluid flow path. The holes can have any configuration and can be arranged in any pattern. The inlet housing 220 can cover a filter 230 positioned behind the inlet housing, as shown in FIG. 4 in which the inlet housing 220 is removed. The filter 230 can be a porous element configured to block debris and hair that may have entered the inlet housing 220, thus preventing debris from entering the fluid flow path P. As further shown in FIG. 4, the electrical components 400 can be positioned just downstream of the filter, but upstream of the fan assembly 500, thus the fluid flow path P flows over and around the electrical components 400 as the fluid is drawn toward and into the fan assembly 500 in operation. This can aid in cooling the electrical components 400.

Appliance Housings

The remainder of the handle 110 is formed from a first handle housing 114*a* and a second handle housing 114*b* which mate together in a clam-shell type configuration to enclose the internal components. In some embodiments, the handle 110 can include a single handle housing such as a sleeve. The first and second handle housings 114*a*, 114*b* can be snap fit together, although other attachment mechanisms are envisioned. The inlet housing 220 can be snap fit with the first housing handle 114*a* and the second handle housing 114*b*. The hair care appliance 100 also includes a body housing 124. In some embodiments, the body 120 can be formed from multiple housings that mate to one another.

Figure 5:
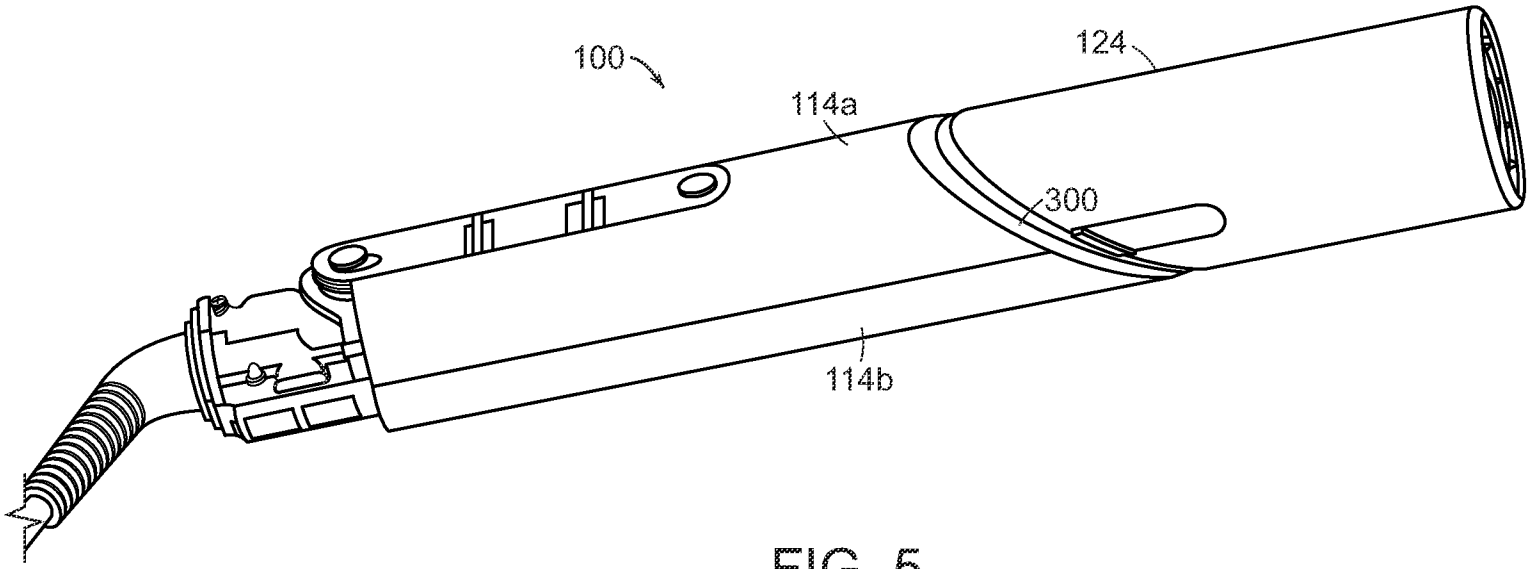
FIG. 5 is a side perspective view of the hair care appliance of FIG. 1 with the inlet housing and filter removed.

The handle housings 114*a*, 114*b* and the body housing 124 can include a surface treatment configured to aid a user in gripping the hair care appliance 100 and/or rotating the rotational hinge joint 300 to change the configuration of the hair care appliance 100 from the straight configuration to the bent configuration, or vice versa. In some embodiments, as shown in FIG. 5, the surface treatment can include fluting, such as spiral-shaped fluting, on the body housing 124. In some embodiments, the surface treatment can include a painted or similarly applied surface treatment.

Figure 7:
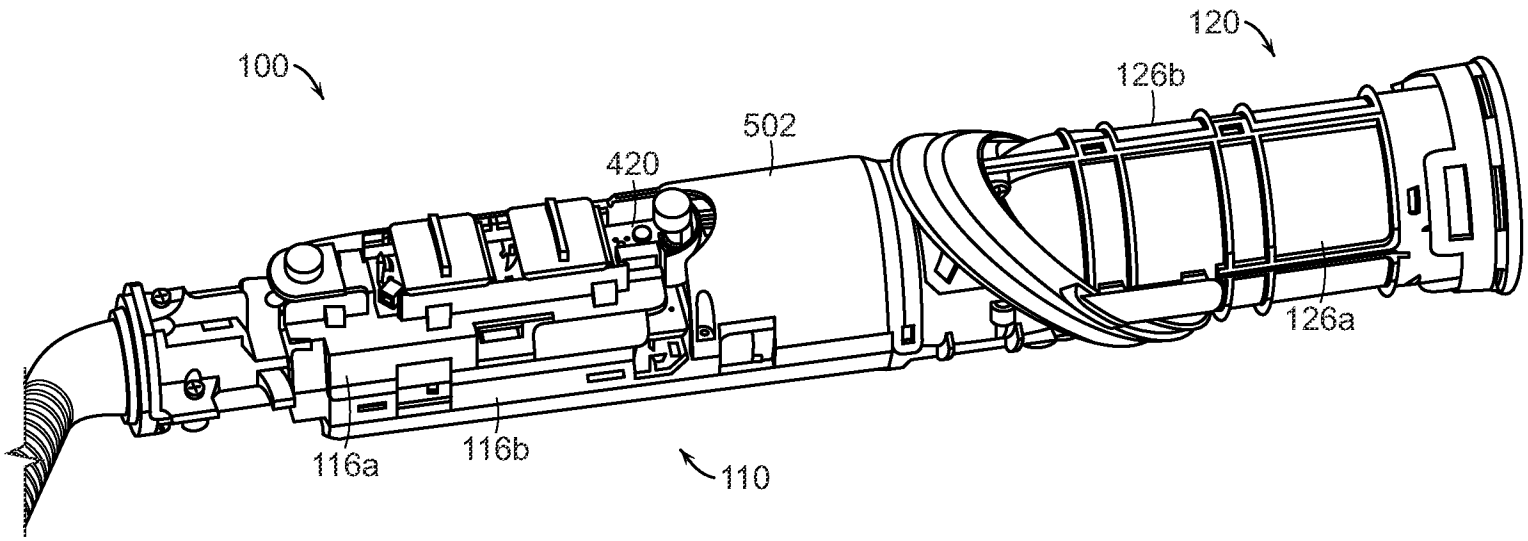
FIG. 7 is a top side perspective view of the hair care appliance of FIG. 1 with the outer housings removed to show internal components of the appliance.

The appliance can also include a number of internal housings or frames. As shown in FIG. 7, in which the external housings 114*a*, 114*b*, 124 are removed, the hair care appliance 100 includes a first handle frame 116*a* and a second handle frame 116*b* configured within the handle 110. The first and second handle frames 116*a*, 116*b* can be mated to another via snap-fit or similar attachment methods or mechanisms such as friction fitting, screws, or rivets. The hair care appliance 100 can also include a first body frame 126*a* and a second body frame 126*b* disposed within the body 120. The first and second body frames 126*a*, 126*b* can be mated to another via snap-fit or similar attachment methods or mechanisms such as friction fitting, screws, or rivets.

Figure 8:
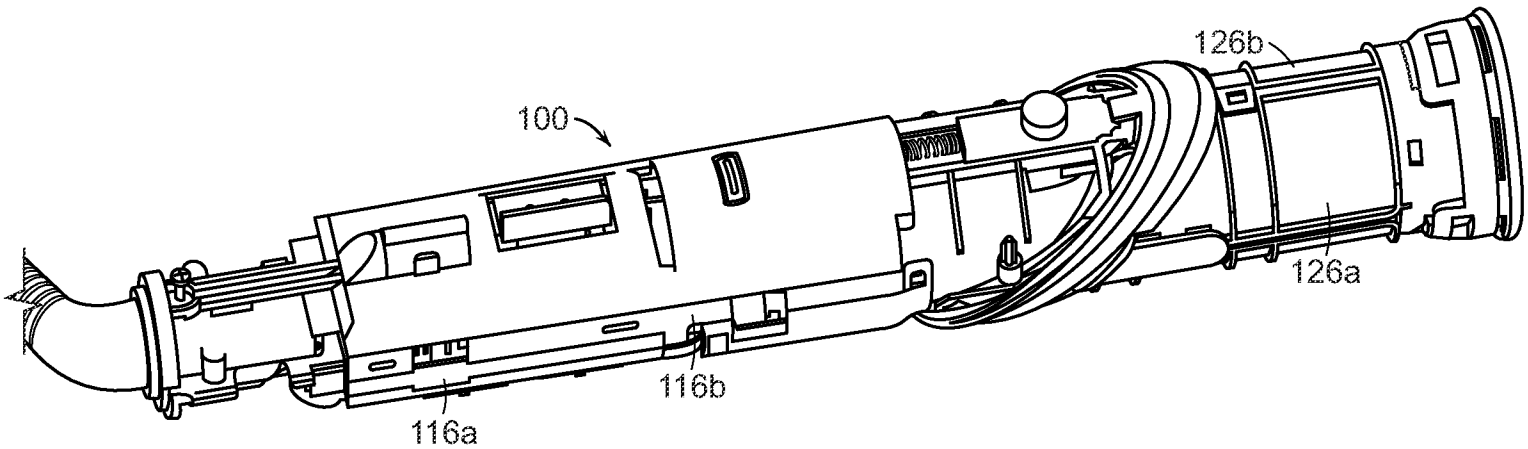
FIG. 8 is a bottom side perspective view of the hair care appliance shown in FIG. 7.

A fan assembly cover 502 can be arranged within the handle 110 and can be mounted to the second handle frame 116*b*. In some embodiments, the first handle frame 116*a* can extend to form a fan assembly cover, rather than having a separate cover. The electrical components 420 can be arranged between the first handle frame 116*a* and the second handle frame 116*b*. The electrical components 400 can be coupled to either of the first handle frame 116*a*, the second handle frame 116*b*, of both of the first and second handle frames 116*a*, 116*b*. As shown in FIG. 8, the second handle frame 116*b* can be arranged along the bottom of the hair care appliance 100.

Hinge Joint

Figure 9:
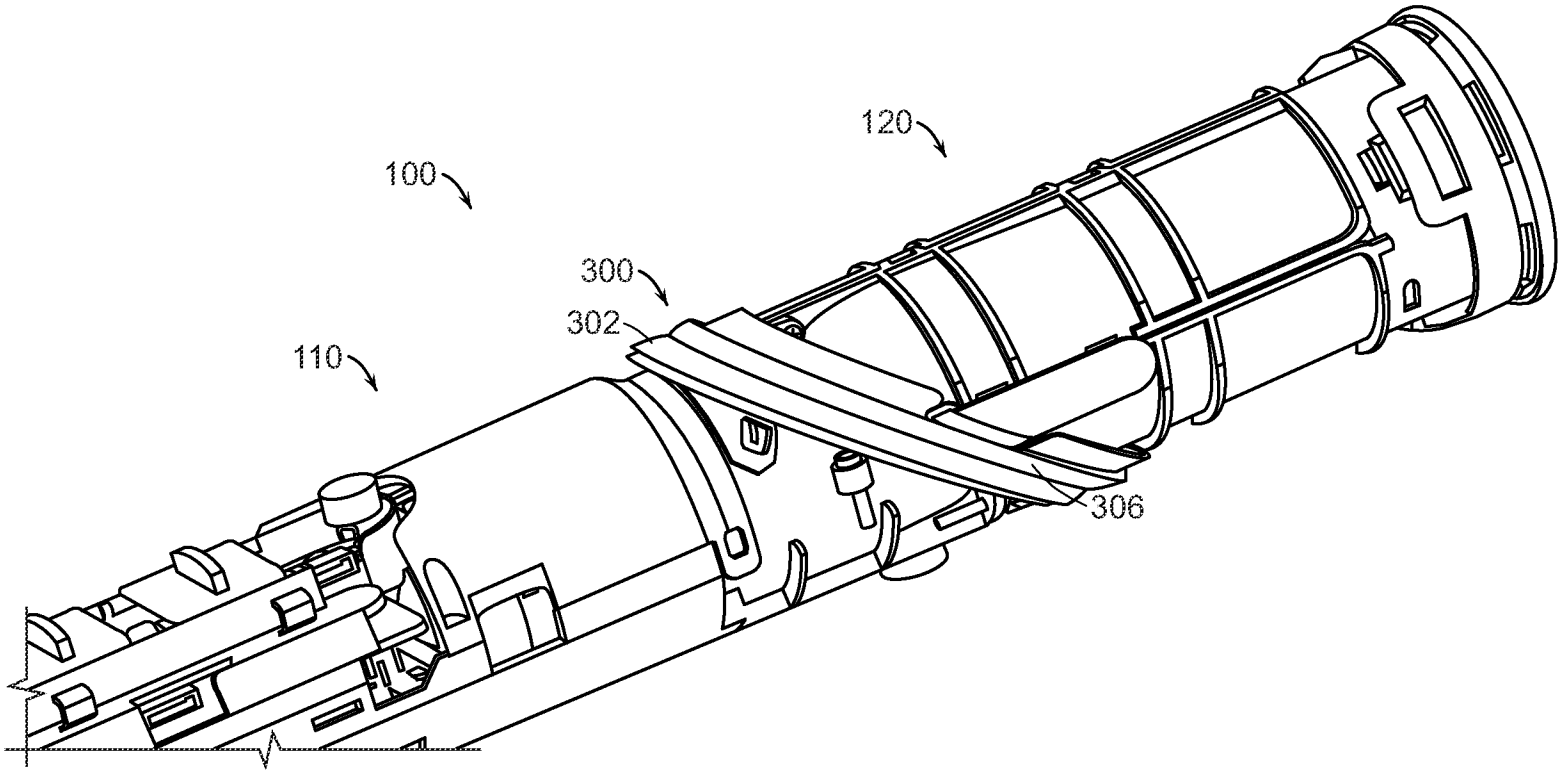
FIG. 9 is a side perspective view of the hair care appliance shown in FIG. 7, showing a rotational hinge joint.

As indicated above, the body 120 and handle 110 are mated to one another at the rotational hinge joint 300. The rotational hinge joint 300 can have a variety of configurations, but in the illustrated embodiment, as shown in FIG. 9, it includes a handle hinge plate 302 configured with respect to the handle 110 and a body hinge plate 306 configured with respect to the body 120. The handle and body hinge plates 302, 306 can be separated by a gap so that the handle 110 and body 120 can rotate with respect to one another in a smooth, unimpeded manner. In some embodiments, the handle and body hinge plates 302, 306 can include a surface finish or applied material. In some embodiments, the rotational hinge joint 300 can be configured at an angle between 30 to 50 degrees relative to the longitudinal axis of the handle. The rotational hinge joint 300 can be rotated to the angled configuration in a first direction and rotated in a second direction to return to the straight configuration.

The rotational hinge joint 300 is shown in more detail in FIGS. 10-17. As shown, the hinge joint 300 is formed between the second handle frame 116*b* of the handle, shown in part in FIGS. 10-17, and the first body frame 126*a*. In other embodiments, the rotational hinge joint 300 can be a separately formed element that can be coupled to the second handle frame 116*b* and the first body frame 126*a*. The second handle frame 116*b* can provide a structural mating surface for mating to a first body frame 126*a*, which when coupled together can form the rotational hinge joint described herein.

Figure 10:
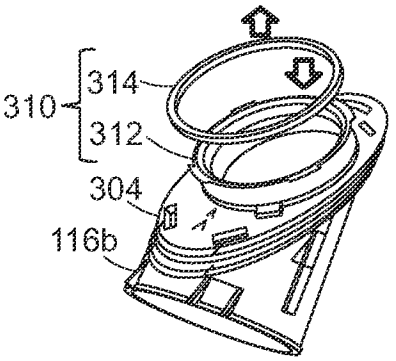
FIG. 10 is a side perspective exploded view of a handle hinge portion, a retainer, and a gasket included in the rotational hinge joint of FIG. 9.
Figure 11:
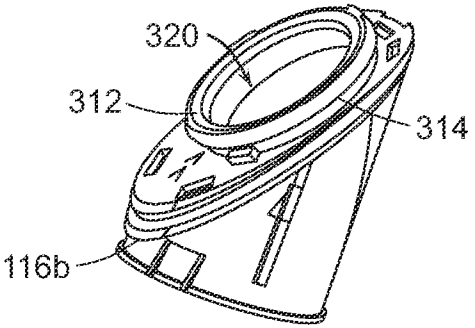
FIG. 11 is a side perspective view of a partially assembled configuration of the rotational hinge joint of FIG. 10.

As further shown in FIG. 10, the rotational hinge joint can include a snap hinge assembly 310. The snap hinge assembly 310 can include a retainer 312 and a gasket 314 fitted on to and around the retainer 312. The retainer 312 can be snap fit or friction fit into the second handle frame 116*b* by seating the retainer within the opening 320 forming the fluid flow path in the rotational hinge joint 300 between the handle 110 and the body 120, as shown in FIG. 11. The retainer 312 can be formed from a low friction material such as nylon, Teflon, or a similar plastic material to enable rotation of the handle 110 and body 120 with minimal effort. As further shown in FIG. 11, the gasket 314 can be secured onto the retainer 312. The second handle frame 116*b* can include a plurality of snap fit features 304.

Figure 12:
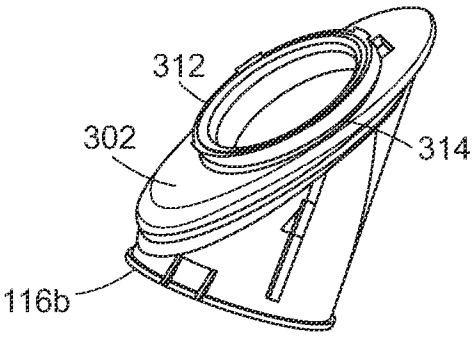
FIG. 12 is a side perspective view of the partially assembled configuration of the rotational hinge joint of FIG. 11 further including a handle hinge plate mated thereto.

As shown in FIG. 12, the handle hinge plate 302 can be coupled to the second handle frame 116*b* via the snap fit features 304. The handle hinge plate 302 can include corresponding snap fit features on a surface opposing the snap fit features 304 to secure the handle hinge plate 302 to the second handle frame 116*b*.

Figure 13:
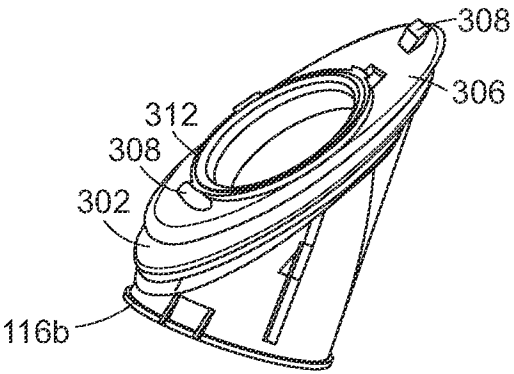
FIG. 13 is a side perspective view of the partially assembled configuration of the rotational hinge joint of FIG. 12 further including a body hinge plate mated thereto.

As shown in FIG. 13, the body hinge plate 306 can be configured to couple to the first and/or second body frames 720, 725. The body hinge plate 306 can be formed of similar materials as the handle hinge plate 302. The body hinge plate 306 can include a plurality of snap fit features 308 configured to couple with one or more body frames.

Figure 15:
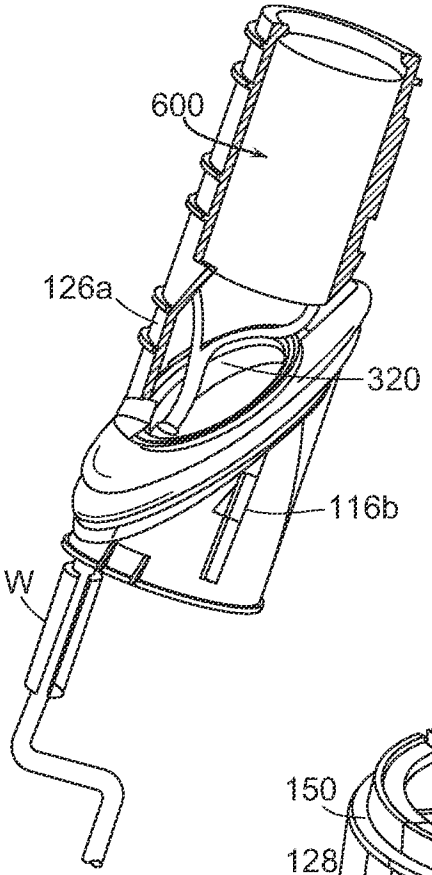
FIG. 15 is a side perspective view of the partially assembled configuration of the rotational hinge joint of FIG. 14 further including a heater assembly and wiring mated thereto.
Figure 14:
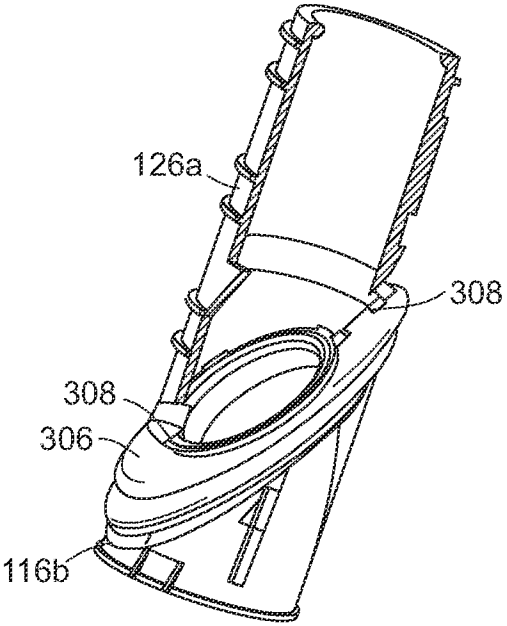
FIG. 14 is a side perspective view of the partially assembled configuration of the rotational hinge joint of FIG. 13 further including a first body frame mated thereto.

As shown in FIG. 14, a first body frame 126*a* can be coupled to the body hinge plate 306 via the one or more snap fit features 308. As shown in FIG. 15, wiring W can be routed through the second handle frame 116*b* and through the opening 320 to couple with the heater assembly 600 arranged within the body of the hair care appliance. The wiring W can advantageously be routed peripherally of the fluid flow path traversing through the second handle frame 116*b*, the opening 320, and the first body frame 126*a* (as well as the second body frame 126*b*). In this way, obstruction of the fluid flow within the fluid flow path can be minimized or reduced. The wiring W can be located directly on or in immediate proximity of the second handle frame 116*b* and the first body frame 126*a* (or a second body frame 126*b*).

Figure 17:
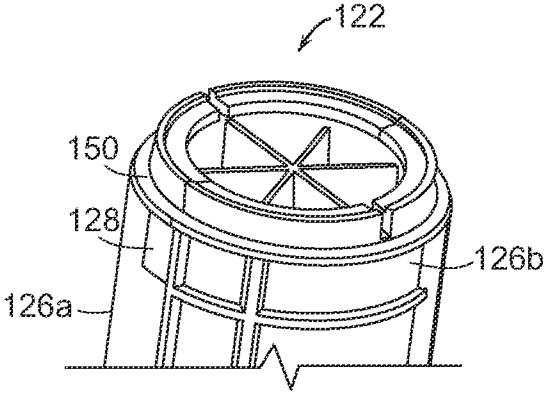
FIG. 17 is a side perspective view of an outlet of the partially assembled configuration of the rotational hinge joint of FIG. 16 further including an O-ring mated thereto.
Figure 16:
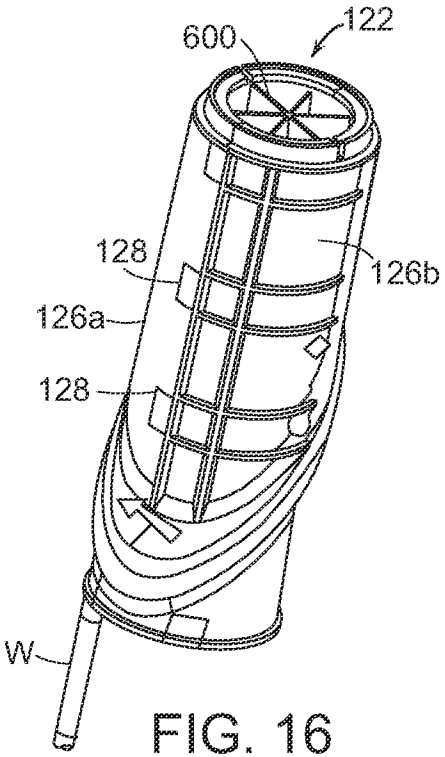
FIG. 16 is a side perspective of the partially assembled configuration of the rotational hinge joint of FIG. 15 further including a second body frame mounted thereto.

As shown in FIG. 16, the second body frame 126*b* can be coupled to the first body frame 126*a* via a plurality of snap fit features 128. In this way, the first and second body frames 126*a*, 126*b* can form the outlet 122 at a distal end of the body (and the hair care appliance 100). As shown in FIG. 17, an O-ring 150 or similar ring-shaped flexible element can be applied to the terminal end of the coupled first and second body frames 126*a*, 126*b* to secure their engagement with one another. The O-ring 150 can also provide a flexible interface for an outlet frame structure configured to couple to the first and second body frames 126*a*, 126*b* at the outlet end of the hair care appliance 100.

Figure 19:
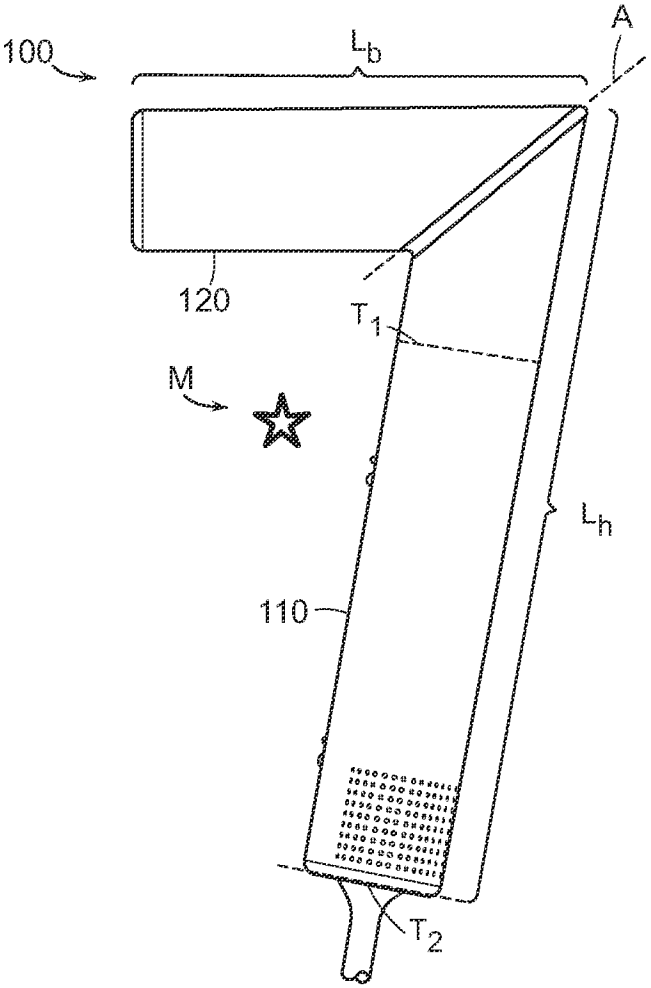
FIG. 19 is a side view of the hair care appliance of FIG. 1 showing a center of mass and a tapered handle shape of the hair care appliance.

The appliance can also have a shape that facilitates grasping. As shown in FIG. 19, the body 120 of the appliance is cylindrical, however the handle 110 can have a tapered cylindrical shape along the entire handle length $L_h$. In particular, the profile or the diameter of the handle 110 can change from a first location $T_1$, a distance from the hinge joint 300, to a second location $T_2$ at the terminal end of the handle 110, such that the second location $T_2$ has a smaller diameter than the first location $T_1$. This can allow a user to more easily grasp the appliance, while providing a larger profile or diameter at the joint 300 and in the body for internal components, such as the heater assembly.

Figure 6:
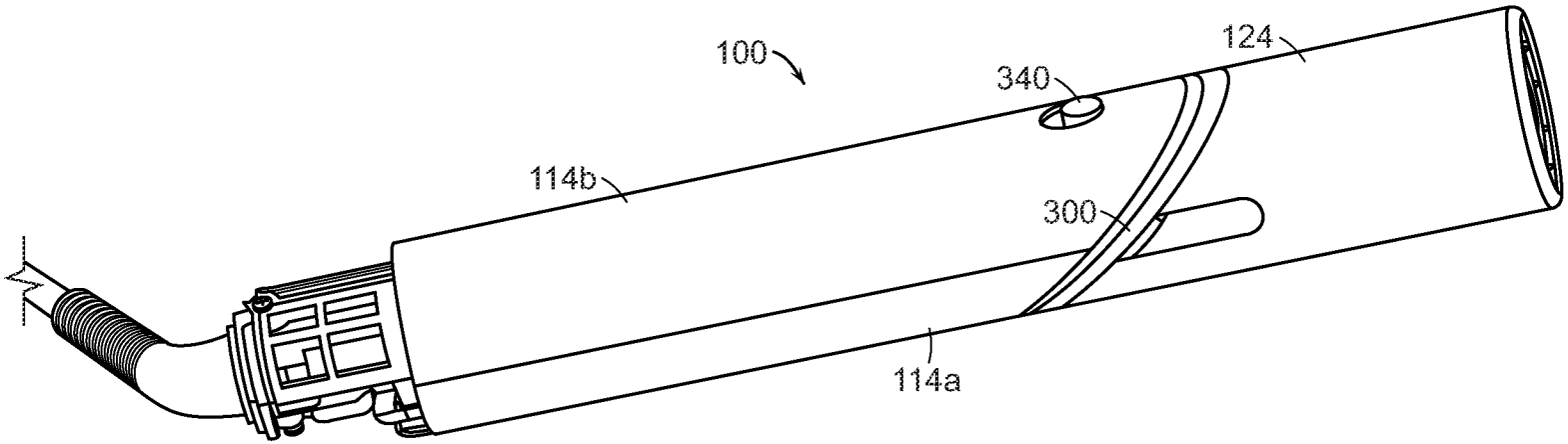
FIG. 6 is another side perspective side of the hair care appliance of FIG. 1 with the inlet housing and filter removed.

In use, the rotational hinge joint allows a user to easily transform the hair care appliance from a straight configuration to an angled configuration with minimal to no reduction in flow velocity or pressure. This can be advantageous when performing different styling treatments in rapidly in sequence or when using attachments of the hair care appliance. In order to facilitate movement between the straight and angled or bent configurations, the hair care appliance 100 can include an actuation mechanism 340 shown in FIG. 6. In the illustrated embodiment, the actuation mechanism 340 is in the form of slidable button that is disposed against a spring of the actuation mechanism, such that retracting the actuation mechanism 340 loads the spring and releases latching mechanisms of the rotational hinge joint 300 so that the rotational hinge joint can rotate between the straight and bent configurations, as will be discussed in more detail below. Once the user has rotated the rotational hinge joint 300 to the second configuration, the user can release the actuation mechanism 340 and the latching mechanism of the rotational hinge joint 300 can re-engage to secure the rotational hinge joint 300 in the second configuration.

In certain exemplary embodiments, the amount of force required to release the hair care appliance 100 from the straight configuration and to allow rotation to the angled configuration can vary. For example, the amount of force for releasing the body 120 from the handle 110 in the straight configuration to initiate rotation of the hinge joint 300 into an angled configuration can be 3.1 N-3.6 N. The amount of force required for rotating the body 120 relative to the handle 110 in angled configurations can be 3.6 N-4.0 N. The rotational hinge joint 300 of the hair care appliance 100 can also be configured to require a certain amount of force to release the appliance from the angled configuration to allow rotation into the straight configuration. The amount of force for releasing the body 120 from the handle 110 in the angled configuration to initiate rotation of the hinge joint 300 into a straight configuration can be 5.1 N-5.3 N. The rotational hinge joint 300 can also be configured to require a certain amount of force to move the appliance into the straight configuration or the angled configuration from rotated positions. For example, the amount of force for moving the body 120 into a straight configuration with the handle 110 can be 4.5 N-5.3 N. The amount of force for moving the body 120 into an angled configuration with the handle 110 can be 6.2 N-6.7 N. The torque necessary to rotate the rotational hinge joint 300 can vary, but in an exemplary embodiment it can be between about 0.1 and 0.7 N. In other aspects, the rotational hinge joint 300 can be configured to release, rotate, and move the body 120 relative to the handle 110 to provide consistent tactile feedback when adjusting the body 120 into the straight or the angled configuration.

Figure 18:
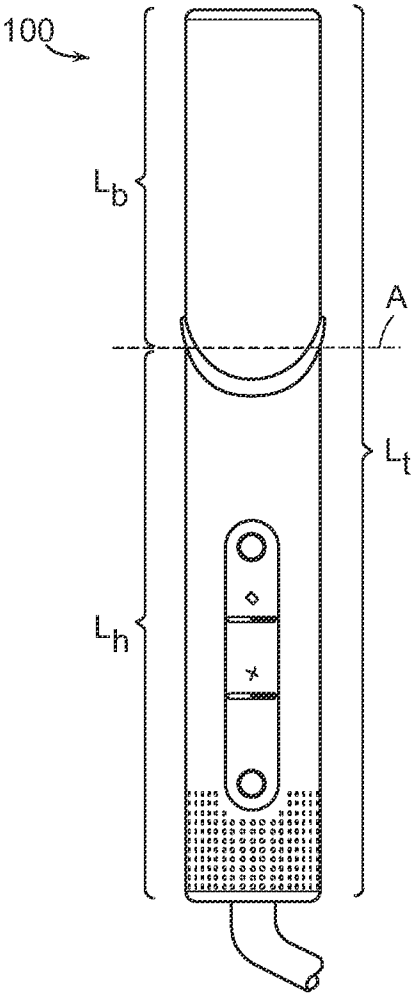
FIG. 18 is a side view of the hair care appliance of FIG. 1 showing a ratio of handle and body dimensions.

As previously indicated, with the appliance fully assembled, the appliance 100 can have a generally elongate cylindrical configuration. While the cross-sectional shape and dimensions of the handle 110 and body 120 can vary, in an exemplary embodiment the handle 110 is longer than the body 120. As shown in FIG. 18, with the hair care appliance 100 in a straight configuration, the appliance can have a total length $L_t$. The rotational hinge joint axis A can separate the device 100 into a handle length $L_h$ and a body length $L_b$. In an exemplary embodiment, the handle length $L_h$ is about ⅔ of the total length $L_t$, and the body length $L_b$ is about ⅓ of the total length $L_t$. However, the ratio of the handle length $L_h$ and the body length $L_t$ can vary. In some embodiments, the total length $L_t$ of the appliance 100 in the straight configuration is in the range of about 26.0 cm to 31.0 cm. In an exemplary embodiment, the total length $L_t$ of the appliance 100 in the straight configuration is 28.5 cm. As shown in FIG. 19, in the bent or angled configuration, the handle length $L_h$ is in the range of about 19.5 cm to 24.5 cm, and the body length $L_b$ is in the range of about 8.5 cm to 13.5 cm. In an exemplary embodiment, the handle length $L_h$ is 22.0 cm. In an exemplary embodiment, the body length $L_b$ is 11.0 cm.

The appliance 100 can also be configured to have a center of mass that properly balances the appliance in a user's hand in the bent configuration. The center of mass of the appliance 100 can be the location at which the distribution of mass is equal in all directions and does not depend on the gravitational field. In an exemplary embodiment, shown in FIG. 19, the hair care appliance 100 has a center of mass M that is in front of the handle 110 and below the body 120. The arrangement of the components in the handle 110 and the body 120 can cause the center of mass M to be advantageously arranged as shown to provide an enhanced user experience holding and operating the hair care appliance 100 while exerting minimal effort by a user to secure the hair care appliance in their hand. In particular, the center of mass can be located forward of the handle and below the body to ensure neutral anatomical handling and reduced user fatigue when holding the hair care appliance in a user's hand. The motor 520 can be aligned with the heater assembly 600 to balance the center of mass M.

Figure 87B:
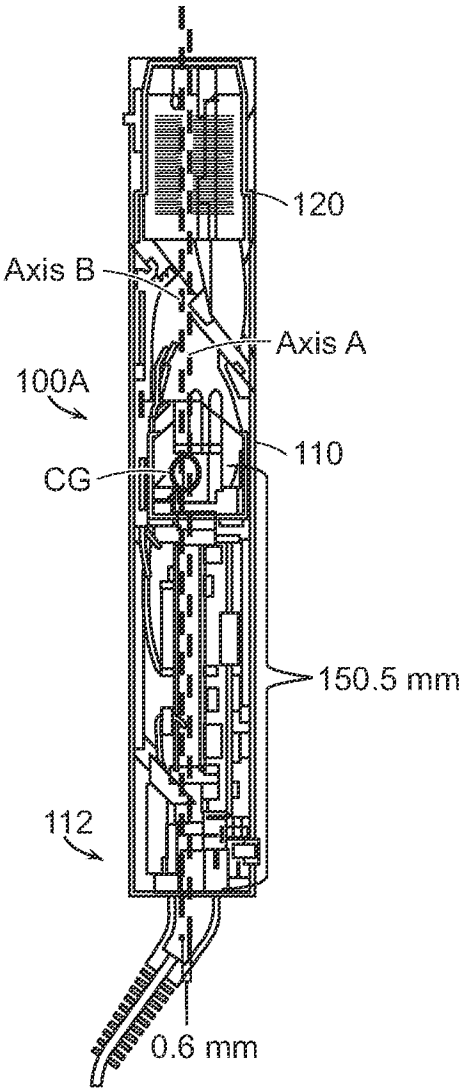
FIG. 87B is a side view of the hair care appliance of FIG. 87A showing a location of the center of gravity of the hair care appliance described herein in the straight configuration.
Figure 87A:
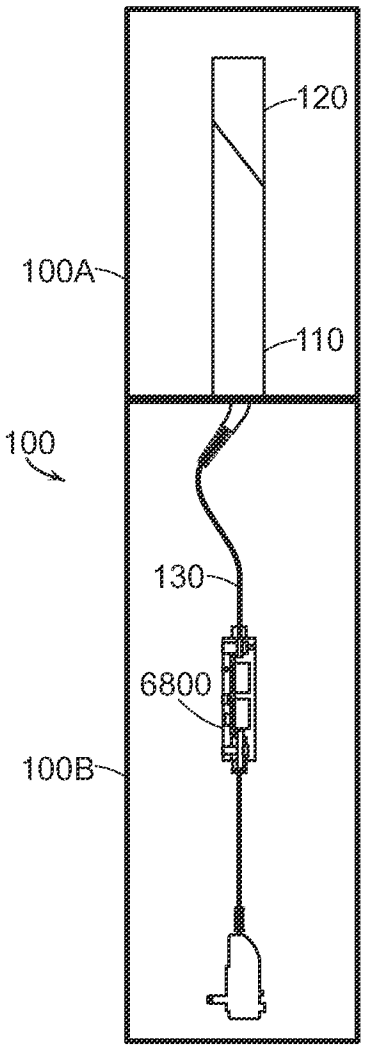
FIG. 87A is side view of a hair care appliance showing an experimental approach for determining a center of gravity of the hair care appliance described herein in a straight configuration.

FIGS. 87A-88B illustrate an exemplary method for determining the center of gravity. The center of gravity (CG) of the appliance 100 depends on the gravitational field and is the location at which the distribution of mass is equal in all directions. As shown in FIG. 87A, the hair care appliance 100 can be separated into an appliance portion 100A and a power supply portion 100B. The CG can be determined in the appliance portion 100A by measuring the mass and the location of the components included in the handle 110 and the body 120. The CG was determined using computer-aided design software configured with a center of gravity function in which component locations are defined based on design parameters and component masses are assigned based on component material types.

In the illustrated embodiment, the location of the CG of the appliance portion 100A is shown in FIG. 87B with the appliance 100 in the straight configuration. The illustrated CG is located 150.5 mm from the base of the handle 110 (e.g., where the inlet 112 is located) as measured along Axis A extending through the center of the appliance portion 100A. The CG is shifted radially outward from Axis A by 0.6 mm and thus is positioned on Axis B extending through the CG.

Figure 88B:
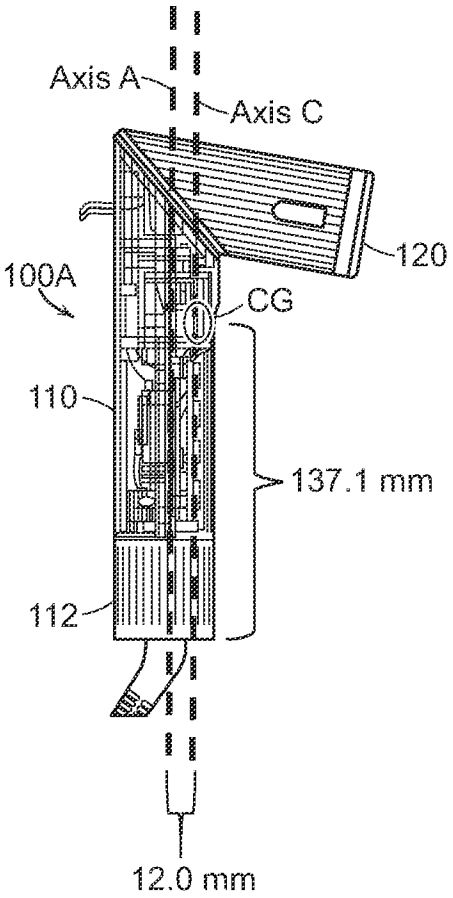
FIG. 88B is a side view of the hair care appliance of FIG. 88A showing a location of the center of gravity of the hair care appliance described herein in the bent configuration.
Figure 88A:
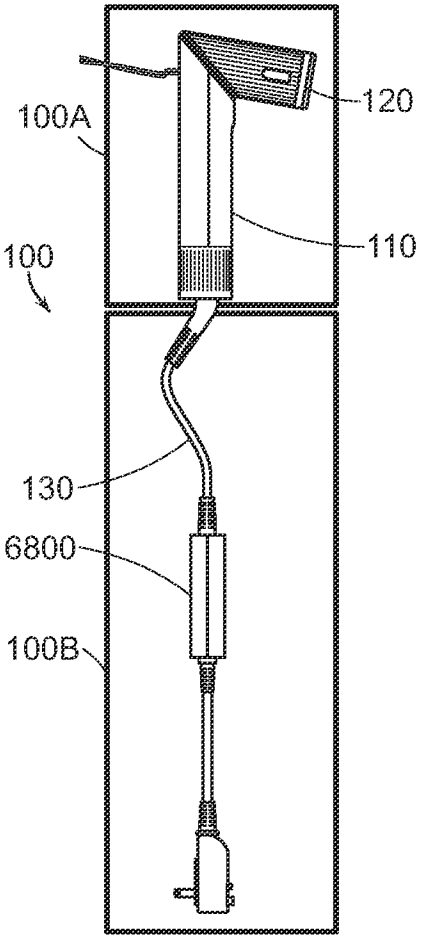
FIG. 88A is a side view of a hair care appliance showing an experimental approach for determining a center of gravity of the hair care appliance described herein in a bent configuration.

In FIG. 88A, the hair care appliance 100 is shown in the angled configuration. In FIG. 88B, the CG of the appliance portion 100A is located 137.1 mm from the base of the handle 110 (e.g., where the inlet 112 is located) as measured along Axis A extending through the center of the appliance portion 100A. The CG is shifted radially outward from Axis A and is located 12.0 mm from Axis A as shown by Axis C extending through the CG.

Figure 89C:
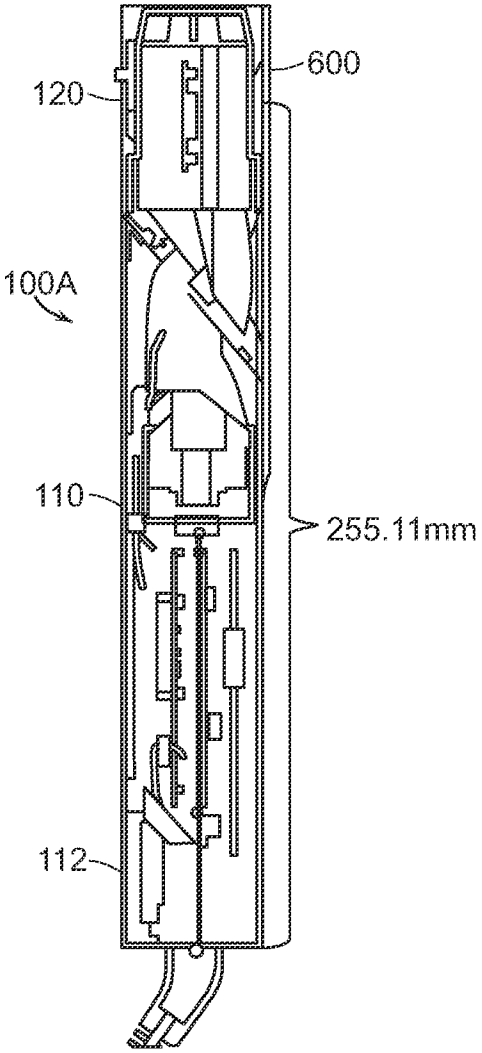
FIG. 89C is a cross-sectional view of a hair care appliance showing a location of a heater of the hair care appliance in the straight configuration.
Figure 89B:
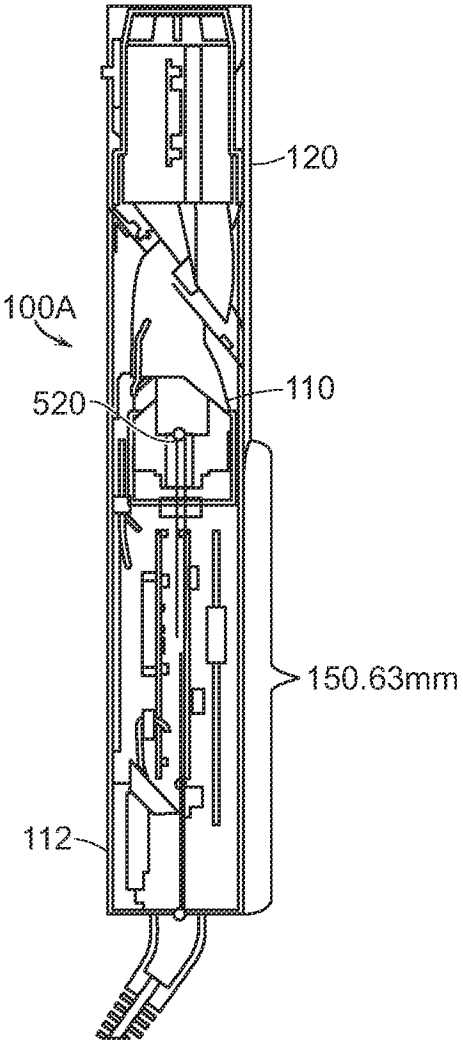
FIG. 89B is a cross-sectional view of a hair care appliance showing a location of a motor of the hair care appliance in the straight configuration.
Figure 89A:
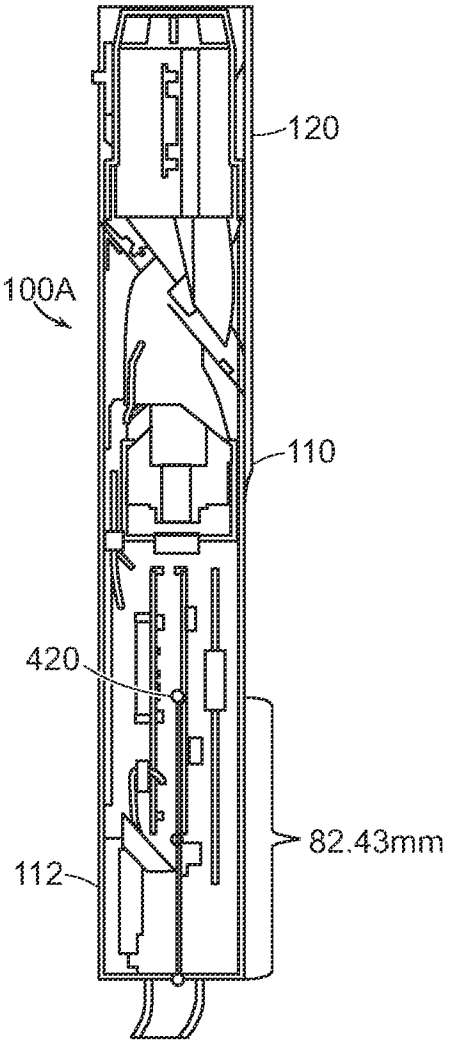
FIG. 89A is a cross-sectional view of a hair care appliance showing a location of a printed circuit board of the hair care appliance in the straight configuration.
Figure 90:
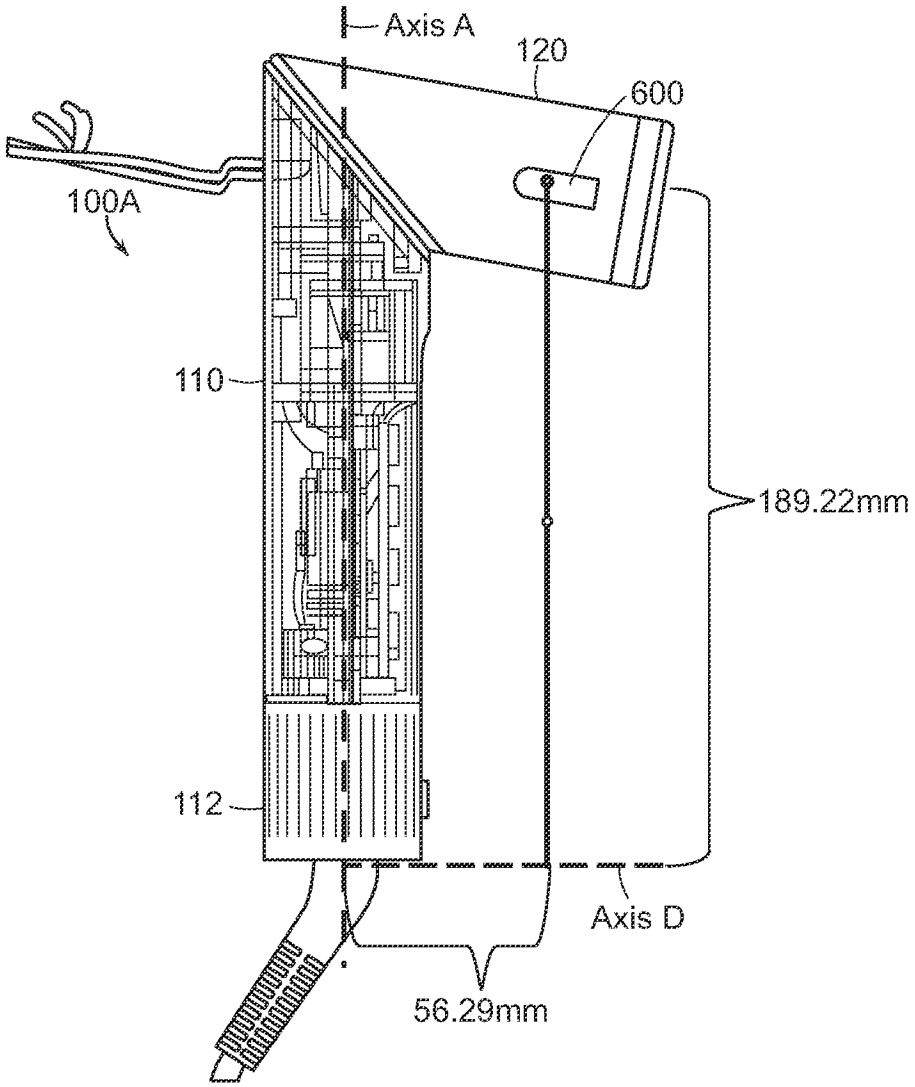
FIG. 90 is a partially transparent view of a hair care appliance showing a location of the heater of the hair care appliance in the bent configuration.

In FIGS. 89A-89C, the locations of the PCB 420, the motor 520, and the heating assembly 600 are shown measured from the base of the handle 110 (e.g., where the inlet 112 is located) of the appliance portion 100A in the straight configuration. As shown in FIG. 89A, the center of the PCB 420 is located 82.43 mm from the base of the handle 110. As shown in FIG. 89B, the center of the motor 520 is 150.63 mm from the base of the handle 110. As shown in FIG. 89C, the center of the heating assembly 600 is 255.11 mm from the base of the handle 110. In FIG. 90, the location of a center of the heating assembly 600 is shown for the appliance portion 100A in the angled configuration. The location of the heating assembly 600 can be measured from Axis A extending from the base of the handle 110 (e.g., where the inlet 112 configured) through the center of the handle 110 and body 120. In the angled configuration, the heater assembly can be 56.29 mm from Axis A and 189.22 mm from Axis D corresponding to the base of the handle 110. The location of the PCB 420 and the motor 520 in the angled configuration can be the same as described in relation to FIGS. 89A-89C corresponding to their location in the straight configuration of the appliance portion 100A.

User Interface

Figure 20:
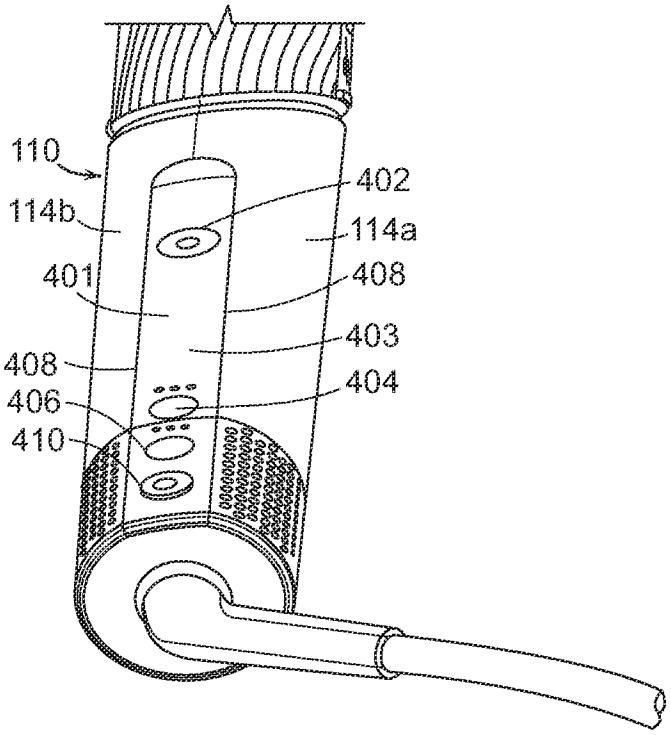
FIG. 20 is a perspective end view of a user interface of the hair care appliance of FIG. 1.

The handle can also include a user interface 401 for enabling the user to provide inputs for operating the appliance, as shown in FIG. 20. In particular, the user interface can include one or more buttons or switches for powering the hair care appliance on and off, adjusting a temperature setting of the heater assembly (and thus adjusting the temperature of the fluid heated by the heater assembly), and adjusting a fan speed of the fan assembly (and thus, adjusting the velocity of the fluid expelled via the outlet). The user interface can also provide a button or switch for disengaging the heating assembly thus providing a cool, non-heated fluid from the outlet.

While the user interface can be positioned at various locations, in an exemplary embodiment, the user interface 401 extends longitudinally along at least a portion of the handle 110. As shown in FIG. 20, it extends from base of the handle, i.e., the terminal most end, and it intersects the filter assembly 200 as shown, and can extend toward the rotational hinge 300 joint, terminating a small distance from the rotational hinge joint 300. The user interface 401 can be provided on a scalloped portion of the handle having raised edges along opposed sides of the user interface 401 to facilitate gripping of the handle 110 by a user. The user interface 401 can extend between first handle housing 114*a* and the second handle housing 114*b*. In another embodiment, the user interface 401 can intersect the filter 230.

The wiring coupling the user interface to the electrical components (e.g., the printed circuit boards) can be routed to the sides of the user interface, and not directly under the user interface, to ensure the fluid flow path is not restricted or limits fluid flow.

As indicated above, the user interface 401 can include one or more buttons or engagement features configured to control operation of the hair care appliance based on user inputs. For example, the user interface 401 can include a blow-out feature 402. The blow-out feature 402 can cause the heater assembly 600 to shut off so that only non-heated air is exhausted through the outlet. In some embodiments, the blow-out feature 402 can be located remotely from the user interface 401 or within the user interface 401 but remotely from other features of the user interface.

The user interface 401 can also include a fan setting feature 404. The fan setting feature 404 can be configured to control a speed of the fan assembly 500. The fan setting feature 404 can be repeatedly selectable to generate high, medium, and low velocity fluid flow by the fan assembly 500.

The user interface 401 can also include a temperature setting feature 406. The temperature setting feature 406 can be configured to control a temperature of the heater assembly 600 and thus the fluid flow exiting the outlet 122 of the hair care appliance 100. The temperature setting feature 406 can be repeatedly selectable to heat the fluid flow to very high, high, medium, or low temperatures. In some embodiments, the high temperature setting can cause the heater assembly to heat the fluid flow to 100 degrees C.

As further shown in FIG. 20, the user interface 401 can include a power feature 410. The power feature 410 can be configured to control provision of power from the power supply to the electrical components of the hair care appliance. The user interface 401 can include one or more tactile features 408, as indicated above. The tactile features 408 can be raised edges or gripping features configured to improve the users grip and manual dexterity when holding or operating the hair care appliance.

In some embodiments, the features of the user interface 401 can be configured to avoid accidental engagement by the user. For example, the features can be recessed and require explicit engagement to trigger a particular user engagement feature. The low-profile or recessed design of the buttons or switches of the user interface can enable a user to operate the hair care appliance without mistakenly contacting an unintended button or switch. In some embodiments, any of the features of the user interface 401 described herein can be configured with lighting or illuminated elements that can illuminate a button, switch, or surface of the user interface 401, such as an inner or under surface of the user interface. The arrangement and styling of the user interface features described herein can be provided in a variety of non-limiting configurations on the handle of the hair care appliance described herein.

Electronics

As previously indicated, the hair care appliance can include a power supply coupled to the inlet end (e.g., the proximal end) of the handle. The power supply can penetrate the inlet end and can provide power to electrical components configured within the handle and the body. The electrical components can be coupled to the power supply via cables or wiring. The electrical components can include portions of the fan assembly (e.g., the motor), and the heater assembly (e.g., the heating elements), as well as one or more printed circuit boards (PCBs). The PCBs can be arranged in the fluid flow path within the handle, and can be arranged relative to one another so as to provide a gap between the PCBs to allow fluid to flow more readily through the fluid flow path in the handle. For example a first PCB can be arranged above or below a second PCB and a gap can separate the two PCBs. Advantageously, the placement of the PCBs in the fluid flow path can also enable cooling of the components configured on the PCBs.

The PCBs can include components, such as resistors and capacitors that can be arranged on the PCBs. The arrangement of the PCB components can be configured to maximize the fluid flow across the PCB. For example, the PCB components can be aligned with the longitudinal axis of the fluid flow path, rather than aligned transverse to the fluid flow path to provide more efficient fluid flow within the fluid flow path across the PCB.

The electrical components of the hair care appliance can be coupled to one another and to the power supply via one or more connectors. The connectors can join portions of wire and electrically couple the electrical components. The arrangement of the connectors can be provided to ensure fluid flow is maintained through the fluid flow path and that fluid flow is not reduced. For example, connectors can be positioned inferiorly on the PCB as close as possible to the power supply. In some embodiments, the connectors associated with the motor and heater assembly can be arranged at the distal end of a PCB (e.g., an edge of a PCB that is closest to the motor and heater assembly) and can include longitudinally oriented wiring that is parallel to the fluid flow path. The wiring between connectors can also be arranged in parallel with the longitudinal axis of the handle, the body, and the fluid flow path extending between the inlet and the outlet. In some embodiments, the user interface (UI) PCB assembly may be separated from the main PCB assembly to reduce hair ingress from the UI.

Figure 21:
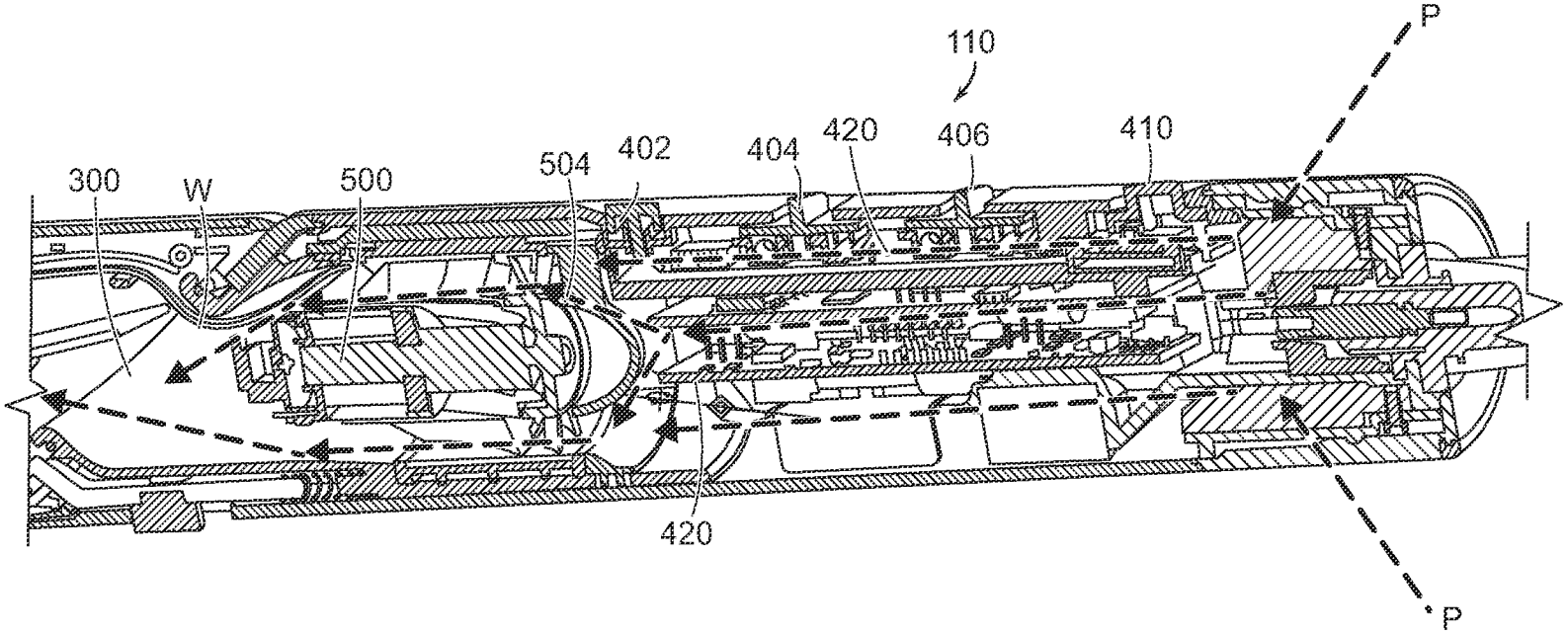
FIG. 21 is a cross-sectional perspective view of the hair care appliance of FIG. 1 with the handle housings removed to show internal electrical components.

FIG. 21 shows the internal electrical components of the hair care appliance. As shown, the handle 110 can receive a power supply that can be electrically coupled to one or more PCBs 420. The PCBs 420 can be further electrically coupled to one or more features 402, 404, 406, 410 of the user interface 401 described in relation to FIG. 20. The PCBs 420 can also be electrically coupled to the fan assembly 500 and the heater assembly 600 located in the body 120 of the hair care appliance 100. The electrical coupling between the PCBs and the power supply 410, the user interface features 402, 404, 406, 410, the fan assembly 500, and the heater assembly 600 can be achieved via one or more connectors and one or more wires. For example, wiring W can be configured to couple the PCBs 420 to the heater assembly 600. The wiring W can be configured peripherally with respect to the opening extending through the rotational hinge joint 300 so that the fluid flow passing through the handle 110 and the rotational hinge joint 300 into the body 120 is not obstructed or reduced.

FIG. 21 shows the fluid flow path P illustrated with dashed lines flowing over and through the electrical components. The arrangement of the PCBs 420, the user interface features 402, 404, 406, 410, and the wiring W can be configured to maximize the flow of fluid with minimal reductions in velocity or pressure as the fluid passes along the fluid flow path F. A diverter 504 can further aid efficient fluid flow distribution to the fan assembly 500.

Figure 22:
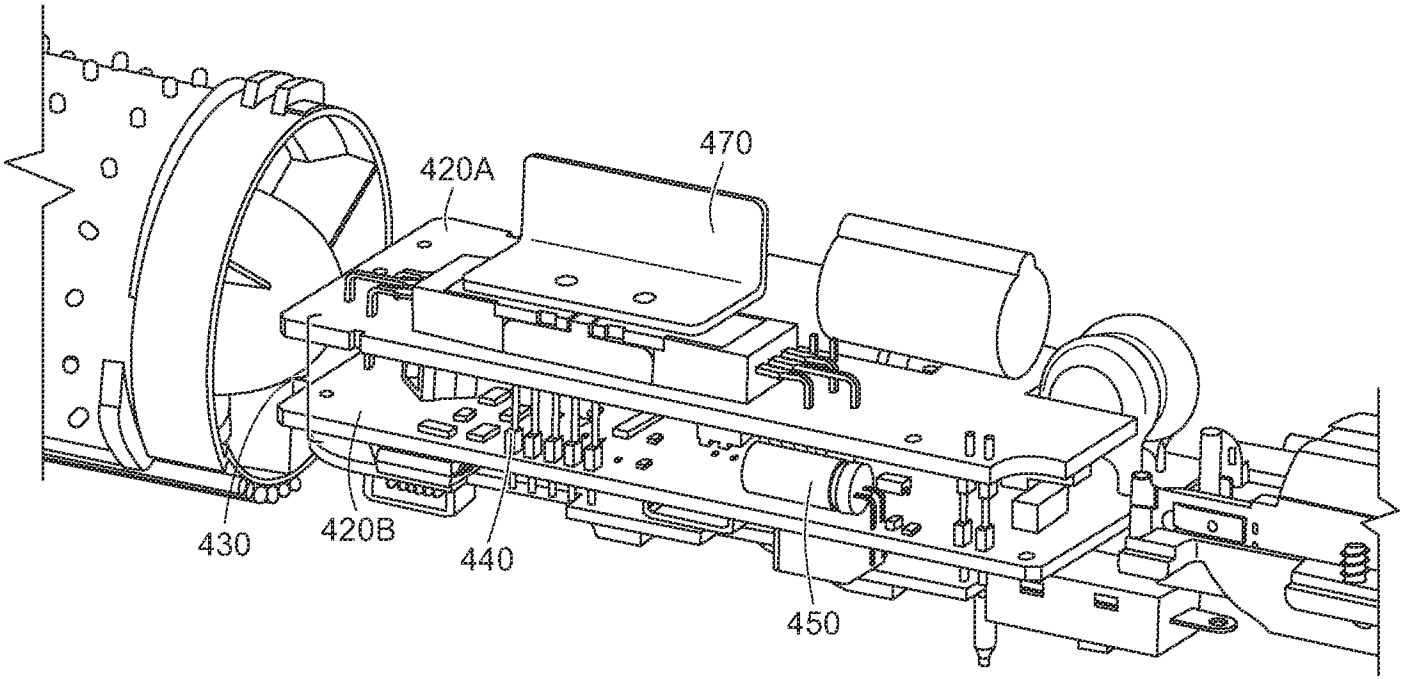
FIG. 22 is a side perspective view of a bottom portion of the electrical components shown in FIG. 21.

As shown in FIG. 22, a first PCB 420*a* and a second PCB 420*b* can be separated from one another by a gap or space 430. The height or size of the gap or space 430 can be configured to maximize fluid flow within the fluid flow path extending through the handle and over/around the PCBs 420. In some embodiments, the gap can be 1.5-2.0 mm. In certain exemplary embodiments, the gap can be 1.84 mm. The second PCB 420*b* may be configured to control the user interface and external controls. The second PCB 420*b* may be positioned such that it limits hair ingress to the first PCB 420A. As further shown in FIG. 22, the PCBs 420 can include several different electrical elements including but not limited to a connector 440, a capacitor 450, a processor 460, as well as resistors, transistors, diodes, circuits, sensors, or electromechanical elements. A heat sink or shield 470 can also be configured with respect to one or more of the PCBs 420. In some embodiments, the electrical components 400 can weight 46.1 g.

Figure 23:
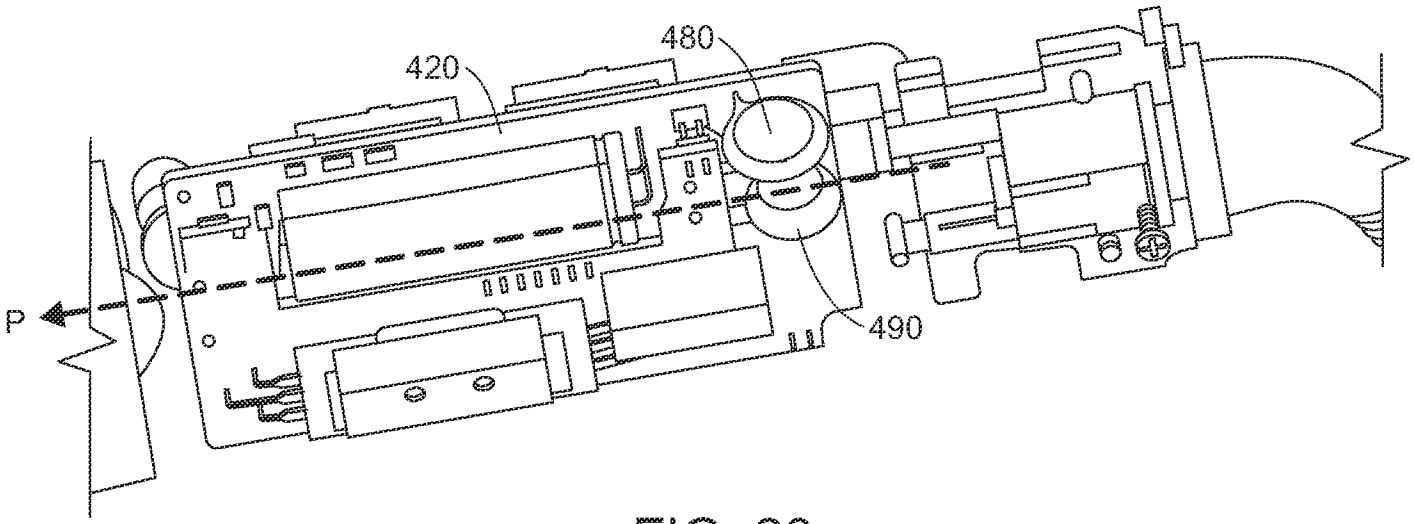
FIG. 23 is another side perspective view of the electrical components of FIG. 21.

As shown in FIG. 23, the PCBs 420 can include a metal-oxide varistor (MOV) 480. The PCBs 420 can also include a negative temperature coefficient (NTC) sensor 490. The arrangement of the MOV 480 and the NTC sensor 490 can be provided on the PCBs 420 to reduce fluid flow resistance caused by the shape of the MOV 480 and the NTC sensor 490. For example, the MOV 480 and the NTC sensor 490 can be mounted vertically as shown in FIG. 23 so that a narrower cross-section of each component interfaces with the fluid flow passing through the fluid flow path P.

Figure 68:
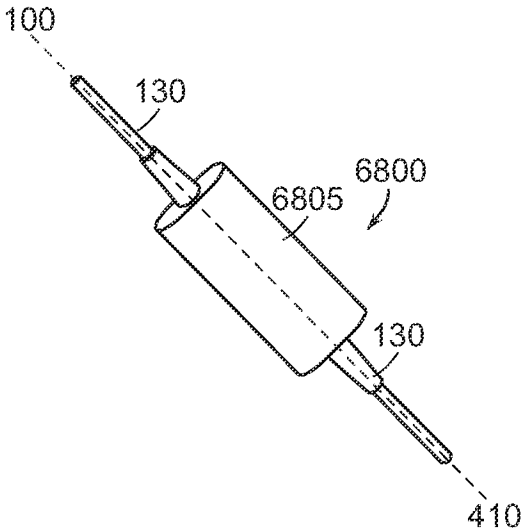
FIG. 68 is a perspective view of an electromagnetic compatibility (EMC) enclosure configured for use with the hair care appliance described herein.
Figure 70:
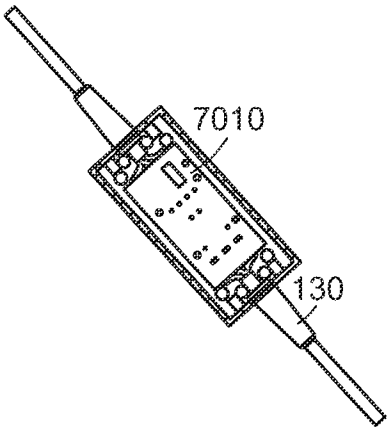
FIG. 70 is a rear perspective view of the contents of the EMC enclosure of FIG. 68.
Figure 69:
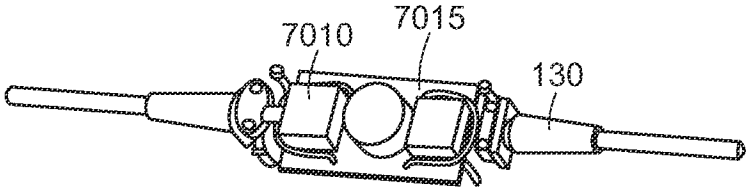
FIG. 69 is a front perspective view of contents of the EMC enclosure of FIG. 68

The electrical components 400 can be coupled to a power supply 410. As shown in FIG. 68, the power supply 410 can couple to a power supply cord 130. The power supply cord 130 can include an EMC enclosure 6800 configured between a terminal end of the power supply cord 130 and the hair care appliance 100. The EMC enclosure 6800 can include a cover or housing 6805. As shown in FIG. 69, the housing 6805 has been removed to illustrate a front view of the electrical components 6810 that can be arranged on a PCB 6815 within the EMC enclosure 6800. The rear of the PCB 6815 can be seen FIG. 70.

As explained above, the placement of electrical components on the PCBs is optimized to maintain fluid flow along the fluid flow path. Similarly, the PCBs can include a space or gap between two PCBs so that fluid can flow through the gap and around each of the PCBs. In this way, electrical components on the PCBs receive a cooling effect from the fluid flow and the fluid flow path is not obstructed so that fluid flow is maintained with minimal reduction in fluid velocity.

Fan Assembly

As previously indicated, the fan assembly 500 is positioned downstream of the electrical components. The position of the fan assembly 500 is designed to be balanced within the handle 110 and also to be in proximity of the rotational hinge joint 300 to improve fluid flow. The fan assembly generally includes a motor coupled to an impeller or fan having a plurality of blades. Positioning the motor in the handle at the location where the user would grip the hair care appliance can advantageously reduce vibration of the motor during operation. In operation, the motor can cause the fan to rotate to draw fluid into the inlet of the handle and into the fluid flow pathway. The fluid can be drawn toward the fan and expelled over the heater assembly and out of the hair care appliance via the outlet.

Figure 24:
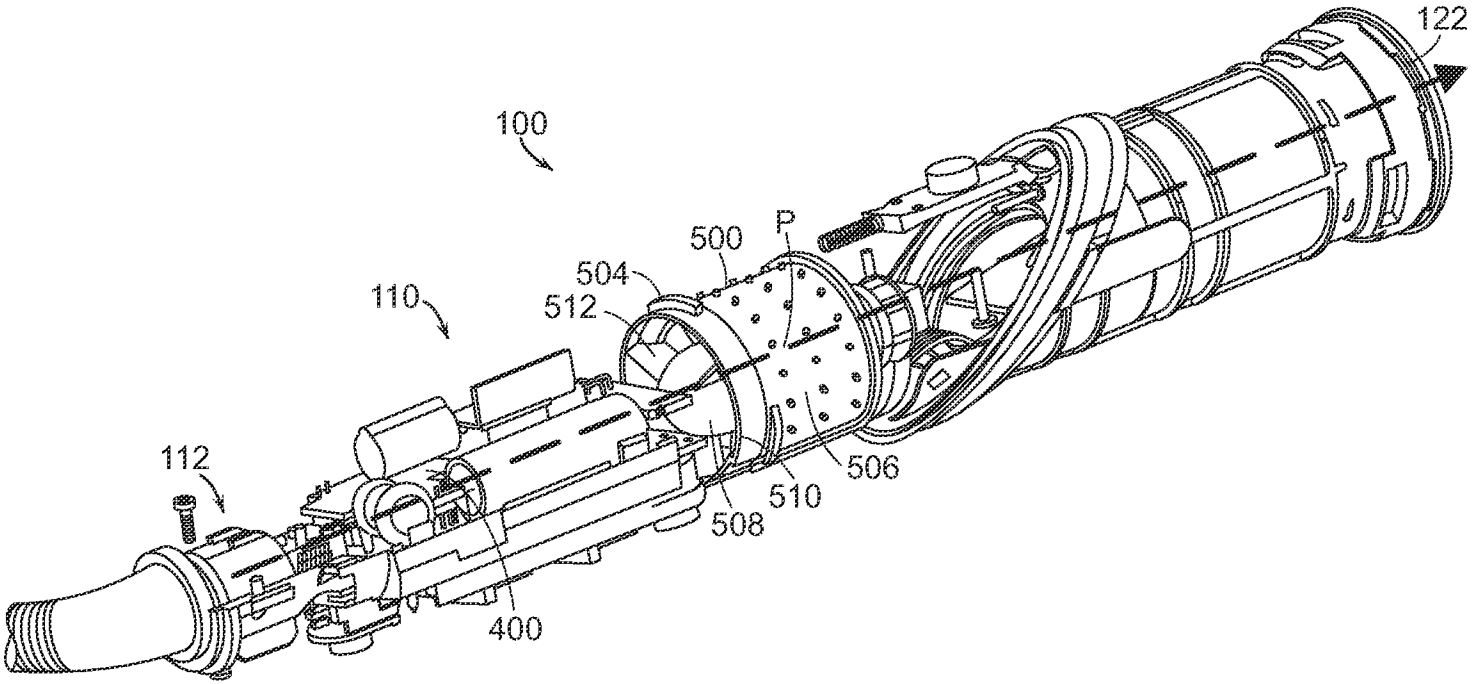
FIG. 24 is a side perspective view of the hair care appliance of FIG. 1 with the handle and body housings removed to shown an internal fan assembly.

As shown in FIG. 24, fan assembly 500 is located along the fluid flow path P forward of the electrical components 400, and at the distal end of the handle along the fluid flow path immediately downstream of the rotational hinge joint. In this way, the fan assembly can provide an improved fluid flow through the rotational hinge joint, such as in the angled configuration, into the heater assembly and the outlet in the body with minimal reduction in fluid flow. The placement of the fan assembly 500 in the handle 110 can also advantageously reduce vibration of the fan assembly 500 when in operation as a result of the insulative effect of the user's hand. In some embodiments, the fan assembly 500 can weigh 71.6 g.

As shown, the fan assembly 500 has include a housing 506 covering the motor and fan blades of the fan assembly 500. In some embodiments, the fan assembly housing 506 can be a rubber isolation damper. The fan assembly 500 can also include a diverter 504. The diverter 504 can be configured in the fluid flow path P extending from the inlet 112 to the outlet 122. In particular, the diverter 504 can include a dome-shaped portion 508 coupled to an annular frame 510 by one or more dome supports 512. The dome-shaped portion 508 can be configured to distribute the fluid flow radially through the fan assembly housing 506 and on to the peripheral edges of the fan blades. In this way, the fan blades of the fan contained within the fan housing 506 can receive an even distribution of fluid flow allowing the fan to generate an even fluid flow distribution downstream (e.g., toward the outlet 122) of the fan assembly 500.

Figure 25:
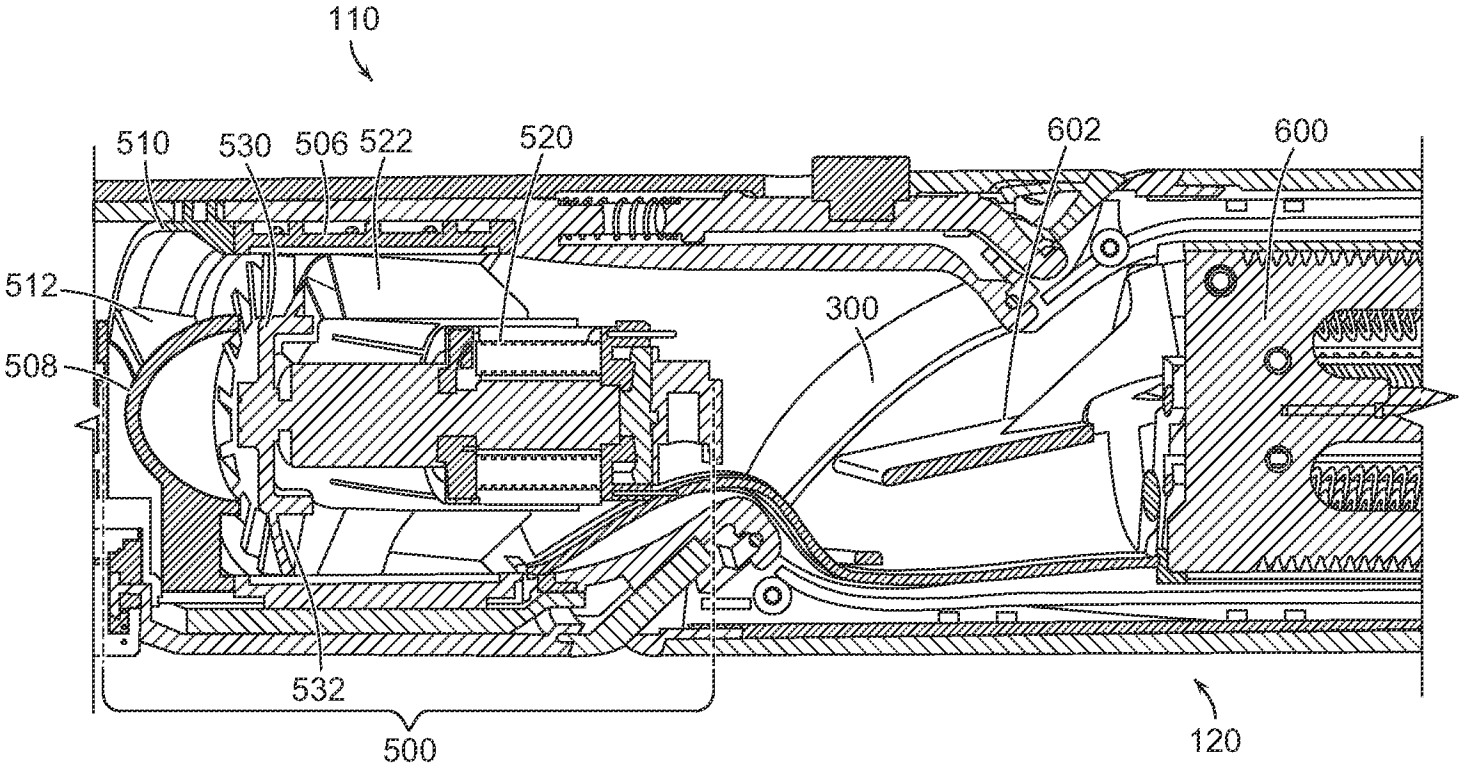
FIG. 25 is a side cross-sectional view of the hair care appliance of FIG. 24.

As shown in FIG. 25, the fan assembly 500 can include a motor 520 and a fan 530. The fan 530 can be coupled to a central shaft extending from the motor 520. The fan 530 can include a plurality of fan blades 532. In operation, the motor 520 can cause the fan 530 to rotate and draw fluid into an inlet of the handle 110 and along the fluid flow path toward the diverter 504. The dome-shaped portion 508 can distribute the fluid flow to the outer edges of the fan blades 532 so that the volume of the fluid and the velocity of the fluid can be efficiently maintained. The fluid flow can pass from the fan blades 532 into a motor frame 522. The motor frame 522 can include curved vanes that are arranged downstream of the fan to smooth and straighten the fluid flow exiting the fan. The fan assembly 500 can direct the fluid flow through the rotational hinge joint 300 and toward a diverter 602 located upstream (e.g., toward the fan assembly 500) of a heater assembly 600 located in the body 120. In some embodiments, the fan assembly can generate a fluid flow at a velocity between 25-35 m/s.

Heater Assembly

Figure 71:
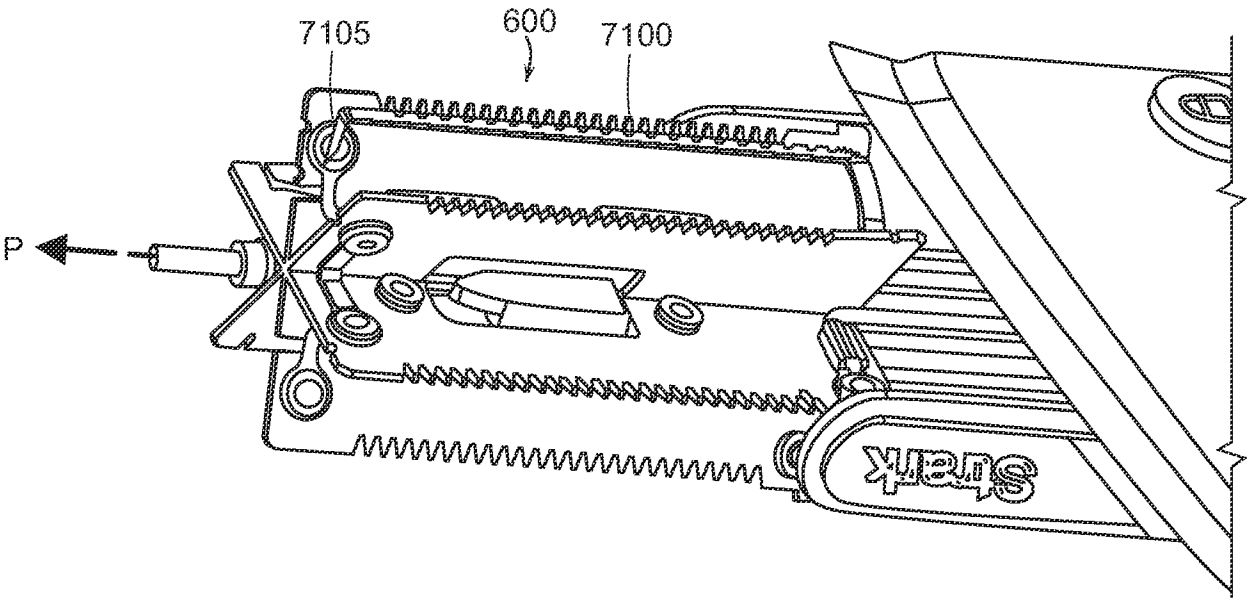
FIG. 71 is a perspective view of an ionizer arranged with the heater assembly of the hair care appliance described herein.

As indicated above, the hair care appliance can include a heater assembly in the body 120. The heater assembly can be configured to control a temperature of the fluid flow between 60-100 degrees Celsius. The heater assembly can be spaced apart from the rotational hinge joint to provide a smooth, even fluid flow of the fluid entering the heater assembly. The heater assembly can be positioned in the fluid flow path extending through the body and can heat the fluid as it is provided to the outlet of the body. The heater assembly can include an inner support structure including a central shaft and a plurality of planar segments extending along and radially from the central shaft. The planar segments can have cut-out portions therein to ensure that the fluid flow is maximized as it passes through the heater assembly. One or more heating elements can be arranged on the planar segments and can be coupled to the PCBs in the handle via cables or wiring. The heating assembly wiring can be located immediately adjacent to and along the inner surface of the handle, rotational hinge joint, and body so that the fluid flow path is not obstructed and fluid flow reduced. The heating assembly 600 may further contain an ionizer 7100 shown in FIG. 71. The ionizer 7100 can include an ionizer emitter 7105 that is in the heated fluid flow path P. In some embodiments, the heater assembly 600 can weigh 29.9 g.

The heater assembly can also include at least one thermistor and at least one fuse that can each be electrically coupled to the PCBs via wires. The thermistor can be configured to measure temperature data of the fluid flowing through the heater assembly. The fuse can be configured as a safety switch or electrical cut-off, that when faulted will disconnect the electrical current provided to the heating elements to prevent overheating of the heater assembly. The thermistor and the fuse can be located at the outlet end of the body and can be positioned on an upper aspect of the heater assembly to further ensure the fluid flow through the heater assembly is evenly distributed between the upper and lower aspects of the heater assembly and evenly distributed radially within the body. In some embodiments, the thermistor and the fuse can be located on the same planar segment. In other embodiments, the thermistor and the fuse can be located on different planar segments. In some embodiments, the heater assembly can include a thermal cut-off (TCO) configured on a planar segment and electrically coupled to the thermistor and the fuse. The TCO can be a resettable thermal control component that can be programmed to shut-off power to the heating elements when the temperature of the fluid exceeds a pre-determined threshold.

Figure 26:
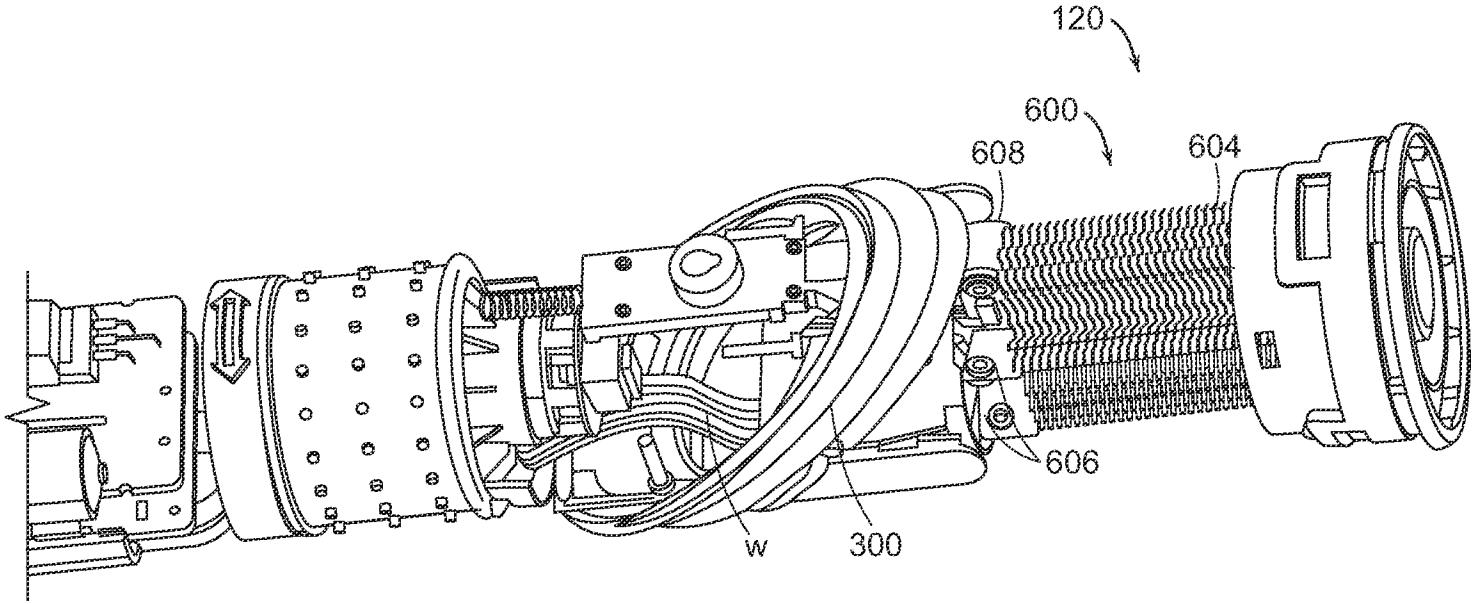
FIG. 26 is a side perspective view of a portion of the hair care appliance of FIG. 1 with the outer housings removed to show an internal heater assembly.

FIG. 26 illustrates the heater assembly 600 in more detail. As shown, the heater assembly includes a plurality of heating elements 604 configured on one or more planar segments 606 of an inner support structure 608. Wiring W can electrically couple the heater assembly 600 to the electrical components 400 and the power supply 410 described in relation to FIG. 21 to provide power to the heater assembly 600. The wiring W can be routed through the rotational hinge joint 155 along an inner surface of the body frames forming a periphery of the rotational hinge joint 300. In this way, disruption of the fluid flow within the fluid flow path passing through the rotational hinge joint 300 can be minimized and flow velocity and pressure can be maintained in an evenly distributed flow pattern provided to the heater assembly 600.

Figure 27:
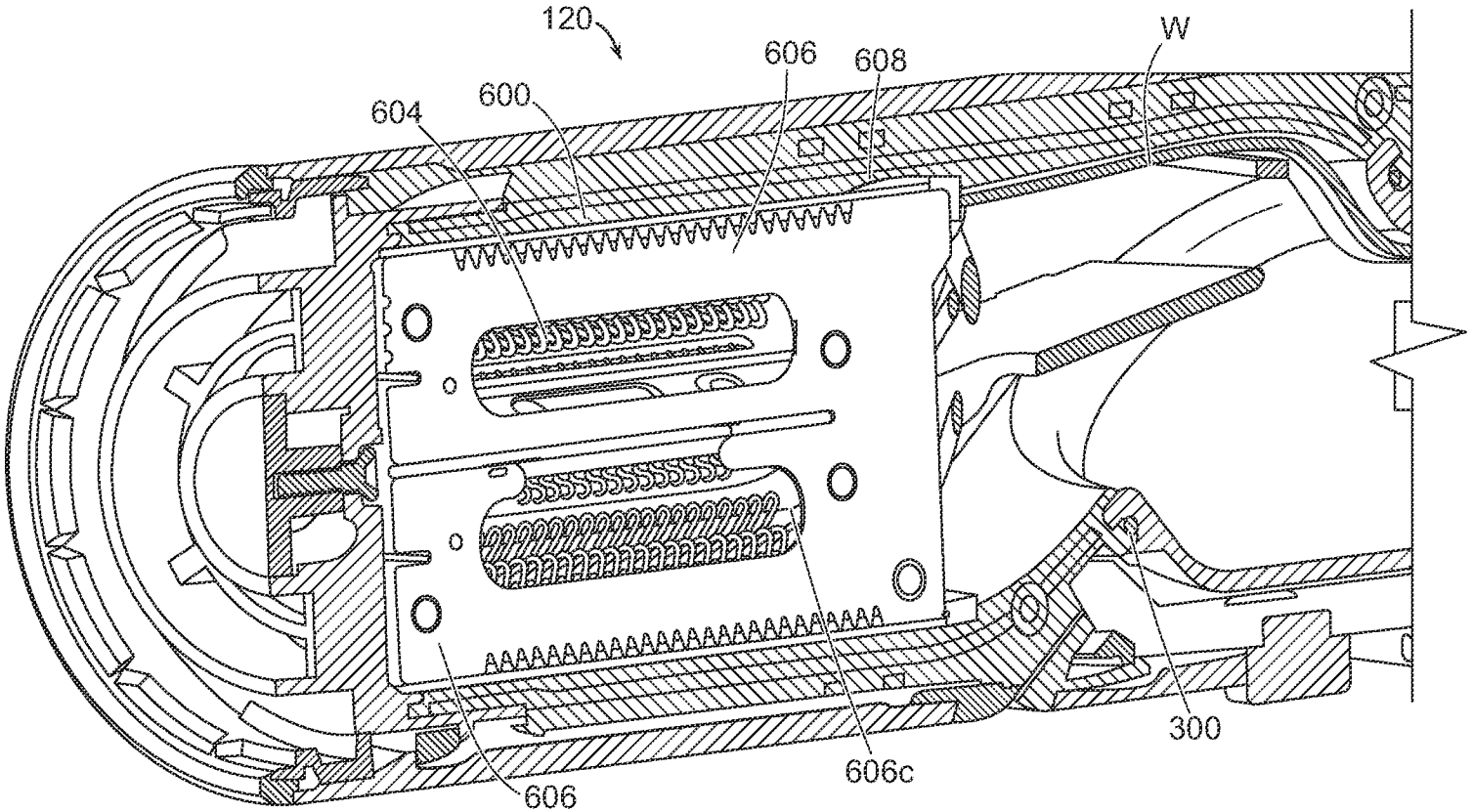
FIG. 27 is a cross-sectional view of the hair care appliance shown in FIG. 26.

As shown in FIG. 27, one or more of the planar segments 606 can include a cut-out portion 606*c* configured to equalize fluid flow through the heater assembly 600. The cut-out portions 606*c* can allow the fluid flow to equalize in a uniform manner while flowing through the heater assembly 600. The cut-out portions 606*c* allow can enable the planar segments 606 to support the heating elements 604 while also creating a space for the fluid flow to equalize and be evenly distributed as it flows through the heater assembly 600. The cut-out portions 606*c* can have a variety of non-limiting shapes and sizes. For example, the cut-out portions 606*c* can include rectangular shapes, square shapes, circular shapes, geometric shapes, or ellipsoid shapes. In some embodiments, the cut-out portions 606*c* can extend longitudinally along a majority of the planar segments 606. In some embodiments, the cut-out portions 606*c* can extend radially on the planar segments 606. In some embodiments, the cut-out portions 606*c* can extend in curved patterns on the planar segments.

In some embodiments, the planar segments 606 can be configured in a variety of non-limiting configurations with respect to a central portion of the inner support structure 608. For example, a plurality of planar segments can be arranged as spokes extending radially outward from the central portion of the inner support structure 608. In some embodiments, the inner support structure 608 can include additional configurations of the planar segments 606 which may not be formed with respect to a central portion of the inner support structure 608, such as a helical-shaped arrangement of planar segments 606, a box-shaped arrangement of planar segments 606, or a cylindrical arrangement of planar segments 606. The ionizer 7100 can be coupled to a planar segment 606.

Figure 28:
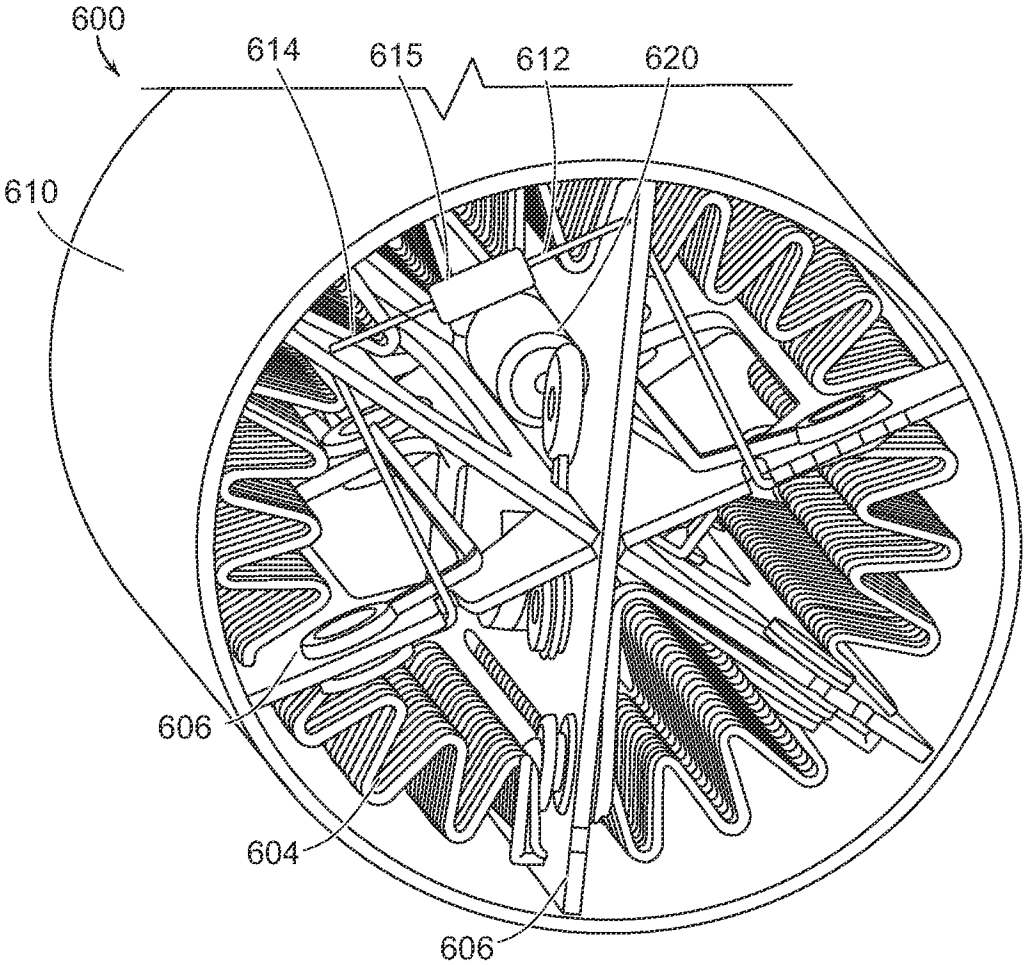
FIG. 28 is a perspective end view of the heater assembly of FIG. 26.
Figure 29:
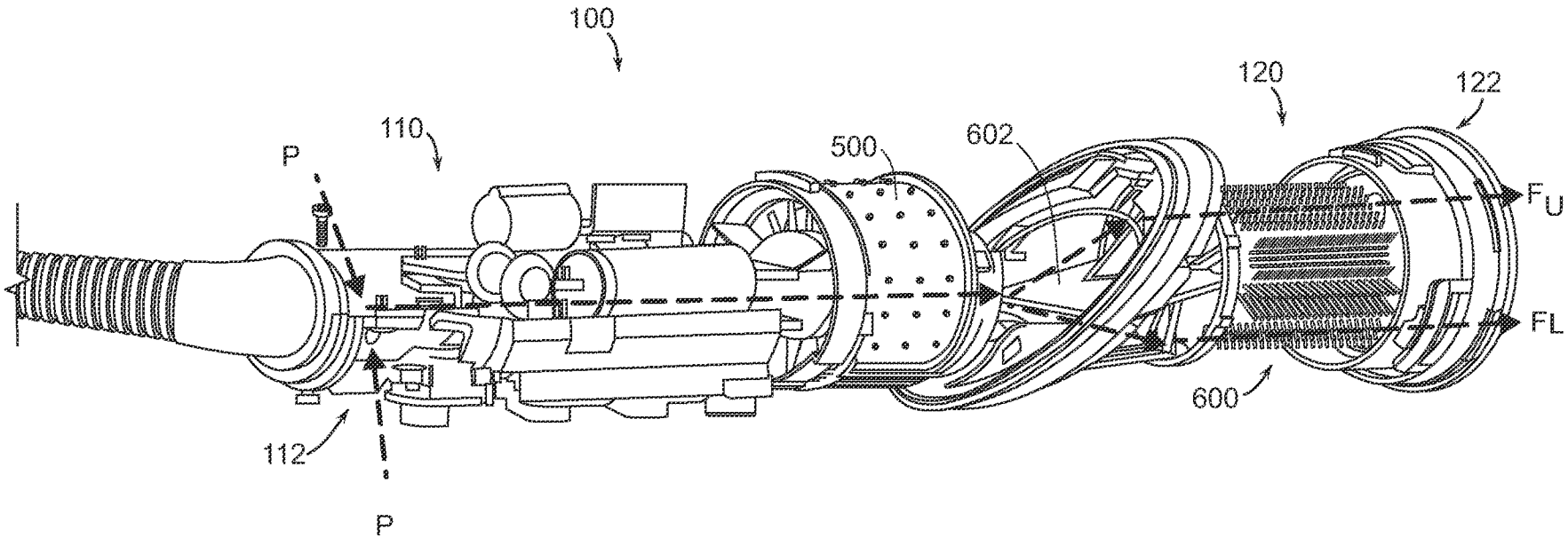
FIG. 29 is a side perspective view of the hair care appliance of FIG. 1 with the outer housings removed and showing a flow path in a straight configuration.

As shown in FIG. 28, the plurality of heating elements 604 can be arranged on and extending around the plurality of planar segments 606. A variety of non-limiting shapes or arrangements of the heating elements 604 can be envisioned. The heating elements 604 can be electrically coupled to the wiring W, such that when power is received the heating elements 604 can radiate heat that can be transferred to the fluid flowing through the heater assembly 600. An outer cylindrical housing 610 can surround the heater assembly.

One or more electrical components can also be included in the heater assembly 600. For example, a thermistor 615 can be arranged in the fluid flow path and can be electrically coupled to the wiring W via wires 612 and 614. The wires 612 and 614 can form a U-shaped configuration with respect to the thermistor 615. Other shaped wiring configuration is envisioned. The heater assembly 600 can also include a fuse 620 that can be electrically coupled to the wiring W. The fuse 620 can provide a safety mechanism by which the heater assembly (and the hair care appliance) is shut off in the event a temperature of the heater assembly exceeds a predetermined temperature threshold. The heater assembly can also include a thermal cut-off component electrically coupled to the wiring W. The thermal cut-off can be a programmable and resettable electrical safety components that can allow modification of the predetermined temperature threshold.

In use, the heater assembly 600 is configured to maintain optimal fluid flow through the heating elements to the outlet. The arrangement of the thermistor and the fuse can be provided to ensure even radial distribution of the fluid flow. The planar segments of the inner support structure can have cut-out portion to ensure maximal fluid flow across and over the heating elements.

Fluid Flow Path

As indicated above, the hair care appliance 100 has a fluid flow path P extending between the inlet 120 of the handle 110 and the outlet 125 of the body 120. As previously indicated, a first diverter 504 is positioned in the handle 110, and a second diverter 602 is positioned in the body 120.

Figure 30:
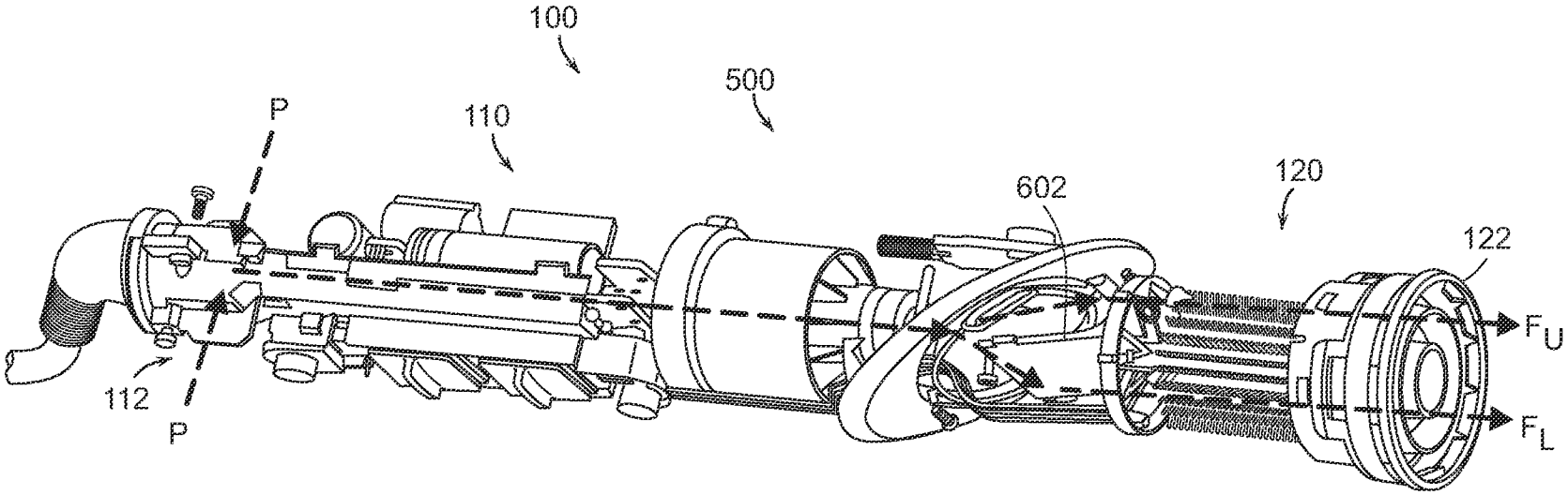
FIG. 30 is a another side perspective view of the hair care appliance of FIG. 1 with the outer housings removed and showing the fluid flow path.

The diverter 602 can be configured as a baffle structure and can partition the fluid flow exiting the fan assembly 500 into separate and uniform upper and lower flow paths $F_U$, $F_L$ entering the heater assembly 600. Without the diverter 602, the fluid flow would tend to accumulate in the upper portions of the heater assembly 600 and less fluid flow would pass through the lower portions of the heater assembly 600. The diverter 602 can address this problem by causing equal volumes of fluid can enter the heater assembly 600 so that a uniform distribution of heat can be transferred to the equal volumes of fluid. Advantageously, the diverter 602 can produce a minimal reduction of fluid flow for the fluid entering the heater assembly 600. In an exemplary embodiment, the diverter 602 includes rounded, non-sharp edges so that the fluid flow is free of turbulence as the flow passes over and around the diverter 602. Further, the diverter 602 can maintain flow velocity, static flow pressure, and top-to-bottom pressure gradients between the upper and lower portions of the heater assembly 600 in both the straight configuration and the angled configuration of the hair care appliance described herein. As shown in FIG. 30, the fan assembly cover has been removed from the fan assembly 500 for illustration of the fluid flow path P. In some embodiments, the fluid flow path P can be a sealed fluid flow path such that loss of fluid flow from the appliance to the environment is minimized.

In an exemplary embodiment, in the angled configuration the hair care appliance described herein can achieve a max:min flow rate ratio of 1.7 with a pressure drop of 1700 Pa along the length of the fluid flow path, and in the straight configuration, the hair care appliance can achieve a max:min flow rate ratio of 1.6 with a pressure drop of 1900 Pa along the length of the fluid flow path. Thus, the flow rate ratio at maximal and minimal flow rates for the angled configuration relative to the straight configuration is 94-95%. As such, the fluid flow rate in the angled configuration is only 5-6% less than the fluid flow rate in the straight configuration. The hair care appliance can advantageously maintain and provide sufficiently equal flow rates in either the straight configuration or the angled configuration with minimal reduction in flow rate in the angled configuration.

Figure 31:
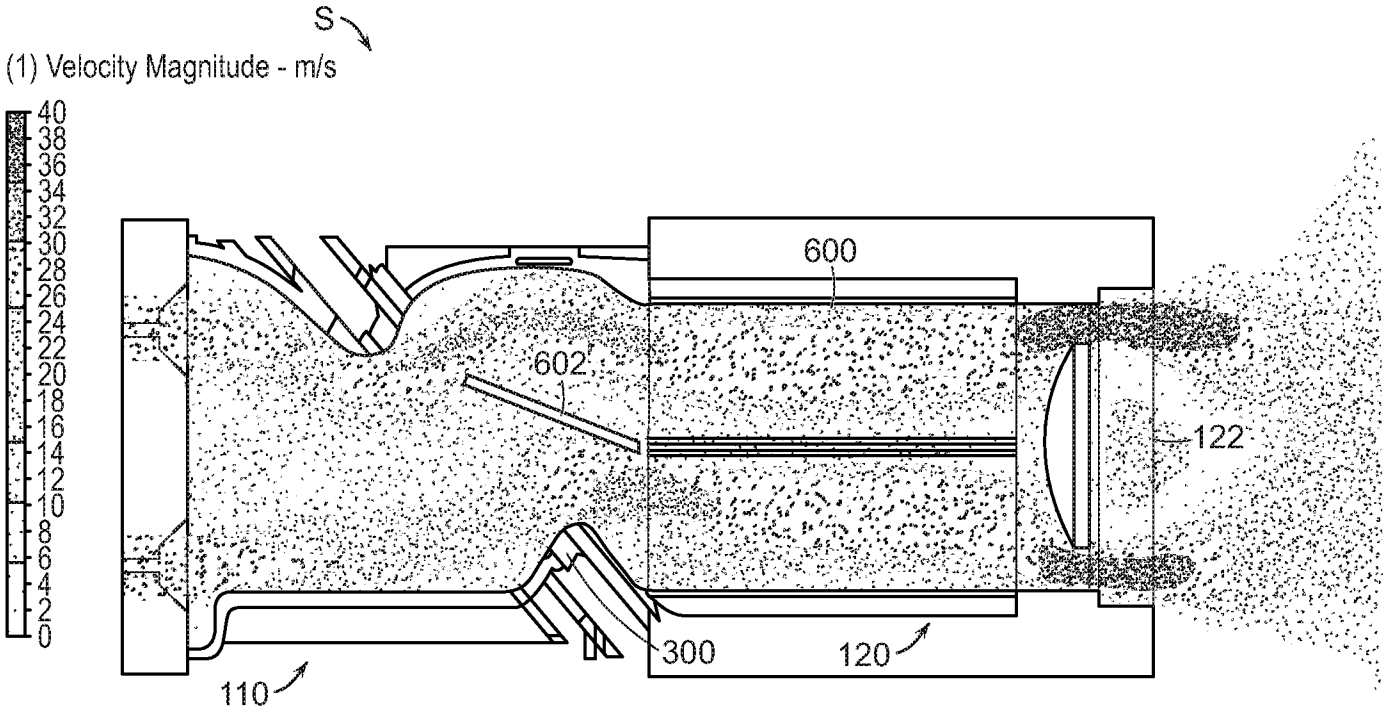
FIG. 31 is a plot illustrating flow path testing data for the hair care appliance of FIG. 1 in a straight configuration.

As shown in FIG. 31, plot S illustrates velocity (m/s) data of a fluid flow flowing through the hair care appliance in a straight configuration. As shown, the velocity of the fluid flow exhibits minimal changes as the fluid flow passes from the handle 110 through the rotational hinge joint 300 and into contact with the diverter 602. Advantageously, the diverter 602 allows a generally equal distribution of upper and lower portions of the fluid flow to pass into the heater assembly 600 of the body 120 with minimal to no changes in fluid velocity in the straight configuration of the hair care appliance. The generally equal distribution of the fluid flow prevents overheating within the heater and consistent heat output. The resultant flow output at the outlet 122 further illustrates the consistent and substantially equal fluid velocity exiting the upper and lower portions of the outlet 122 due to the configuration of the diverter 602. In the straight configuration, the velocity (m/s) was measured at 1" from the outlet 122 and 4" from the outlet 122 at high, medium, and low speed settings of the fan assembly 500. The results are shown in Table 1.

TABLE 1

| | Velocity (m/s) @ 1" from Outlet 122 | Velocity (m/s) @ 4" from Outlet 122 |
|---|---|---|
| High | 35.6 | 27.8 |
| Medium | 24.8 | 20.8 |
| Low | 22.7 | 18.9 |

Figure 32:
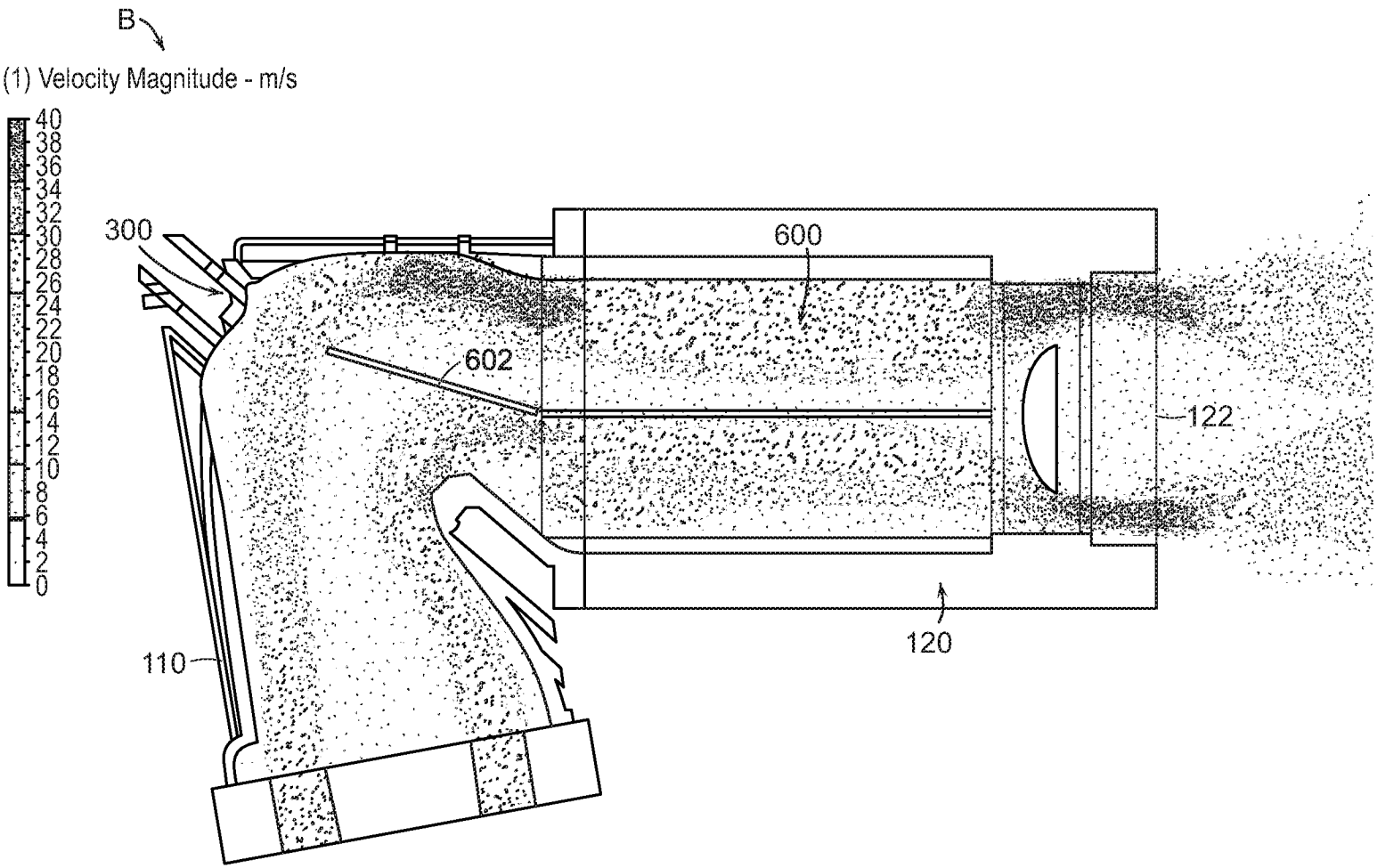
FIG. 32 is a plot illustrating flow path testing data for the hair care appliance of FIG. 1 in an angled configuration.

As shown in FIG. 32, plot B illustrates velocity (m/s) data of a fluid flow flowing through the hair care appliance described herein in angled configuration. As shown, the velocity of the fluid flow exhibits minimal changes as the fluid flow passes from the handle 110 through the rotational hinge joint 300 and into contact with the diverter 602. Advantageously, the diverter 602 allows an equal distribution of upper and lower portions of the fluid flow to pass into the heater assembly 600 of the body 120 with minimal to no changes in fluid velocity in the angled configuration of the hair care appliance. The resultant flow output at the outlet 122 further illustrates the consistent and substantially equal fluid velocity exiting the upper and lower portions of the outlet 122 due to the configuration of the diverter 602. In the angled configuration, the velocity (m/s) was measured at 1" from the outlet 122 and 4" from the outlet 122 at high, medium, and low speed settings of the fan assembly 500. The results are shown in Table 2.

TABLE 2

| | Velocity (m/s) @ 1" from Outlet 122 | Velocity (m/s) @ 4" from Outlet 122 |
|---|---|---|
| High | 31.8 | 25.9 |
| Medium | 25.5 | 20.0 |
| Low | 20.9 | 17.4 |

Comparing the velocity data associated with the straight configuration and the velocity data associated with the angled configuration, angling the fluid flow path causes only a minimal reduction in the velocity of the fluid flow at each speed setting. For example, at the high speed setting in the angled configuration, the velocity of the fluid flow measured 1" from the outlet 122 is 89% (e.g., 31.8 vs. 35.6) of the fluid flow observed in the straight configuration. At the high speed setting in the angled configuration, the velocity of the fluid flow measured 4" from the outlet 122 is 93% (e.g., 25.9 vs. 27.8) of the fluid flow in the straight configuration. At the medium speed setting in the angled configuration, the velocity of the fluid flow measured 1" from the outlet 122 is 103% (e.g., 25.5 vs. 24.8) of the fluid flow in the straight configuration. At the medium speed setting in the angled configuration, the velocity of the fluid flow measured 4" from the outlet 122 is 96% (e.g., 20.0 vs. 20.8) of the fluid flow in the straight configuration. At the low speed setting in the angled configuration, the velocity of the fluid flow measured at 1" rom the outlet 122 is 92% (e.g., 20.9 vs. 22.7) of the fluid flow in the straight configuration. At the low speed setting in the angled configuration, the velocity of the fluid flow at 4" from the outlet 122 is 92% (e.g., 17.4 vs. 18.9) of the fluid flow in the straight configuration. Advantageously, at the medium speed setting, the velocity of the fluid flow through the hair appliance in the angled configuration is greater than the velocity of the fluid flow in the straight configuration as measured at 1" from the outlet 122 (e.g., 25.5 m/s vs. 24.8 m/s).

Accordingly, the configuration of the appliance and the various internal components allow for a fluid flow path that has an even, consistent fluid flow throughout the diameter of the handle and the body between the inlet and the outlet in the straight configuration and the angled configuration. The configuration of the first diverter 504 can provide a uniformly, radially distributed fluid flow through the handle and to the blades of the fan assembly so that the fan does not accelerate the fluid flow unevenly into the heater assembly of the body. The configuration of the second diverter 602 can provide a balanced fluid flow to upper and lower aspects of the heater assembly such that a uniform distribution of fluid is provided through the heater assembly and out of the hair care appliance via the outlet in the body. The heater may operate at a higher temperature due to the evenly spaced airflow preventing any heat buildup on the side of the heater during use.

Accessory Mating

As previously indicated, the hair care appliance can further be configured to mate to one or more accessories for user-selected hair styling or hair treatment. The one or more attachments can have any configuration, such as a concentrator, a diffuser, a curling iron, a curling brush, a round brush, a flat brush, a comb, etc. The attachments can removably couple to the outlet in the body of the hair care appliance and can be secured in place via one or more mating mechanisms configured at the outlet of the body and/or on a mating portion of an individual attachment.

In some embodiments, the hair care appliance can include an attachment that is not removable and is permanently attached to the hair care appliance. For example a brush can be permanently attached and the hair care appliance can be a "hot" brush configuration. The "hot" brush configuration can include a non-detachable brush that is affixed to the hair care appliance described herein.

In some embodiments, the attachment can be configured to sleeve over the body of the hair care appliance, thereby covering the outlet. The sleeved attachment can further extend over the rotational hinge joint in the straight configuration to prevent rotation of the appliance. The sleeve over the rotational hinge joint may provide additional structural support to the hinge during use. The sleeve over the rotational hinge may further prevent the appliance from changing configuration during use. For instance, the hair care appliance may have a latch or button that allows rotation of the body relative to the handle. In some embodiments, the sleeve over attachment might cover the latch or button such that it cannot be actuated during use of the attachment.

Figure 33:
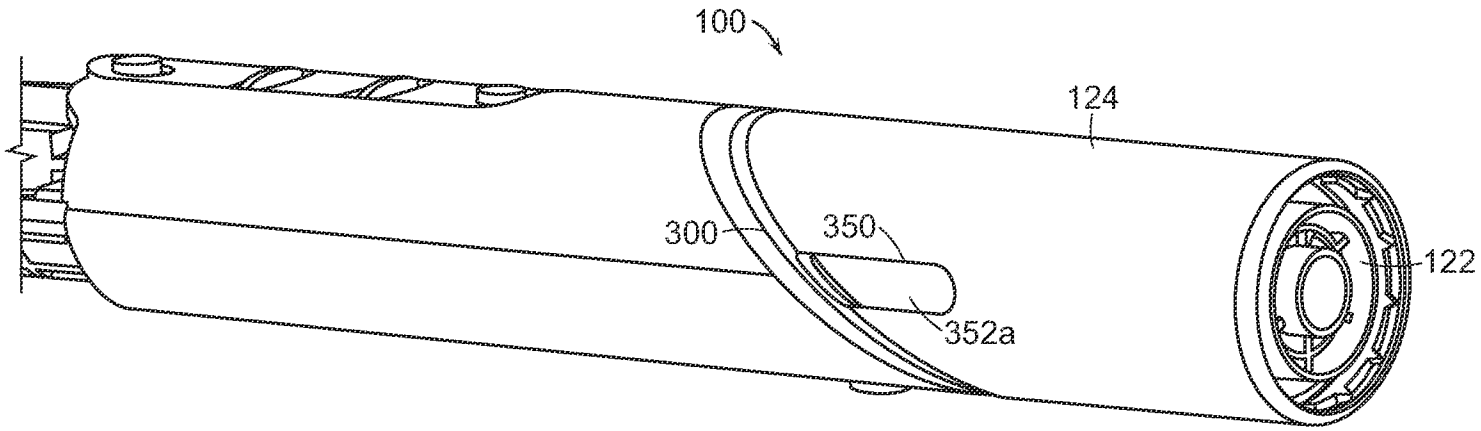
FIG. 33 is a perspective side view of the hair care appliance of FIG. 1 showing an attachment mating assembly on an end thereof.
Figure 34:
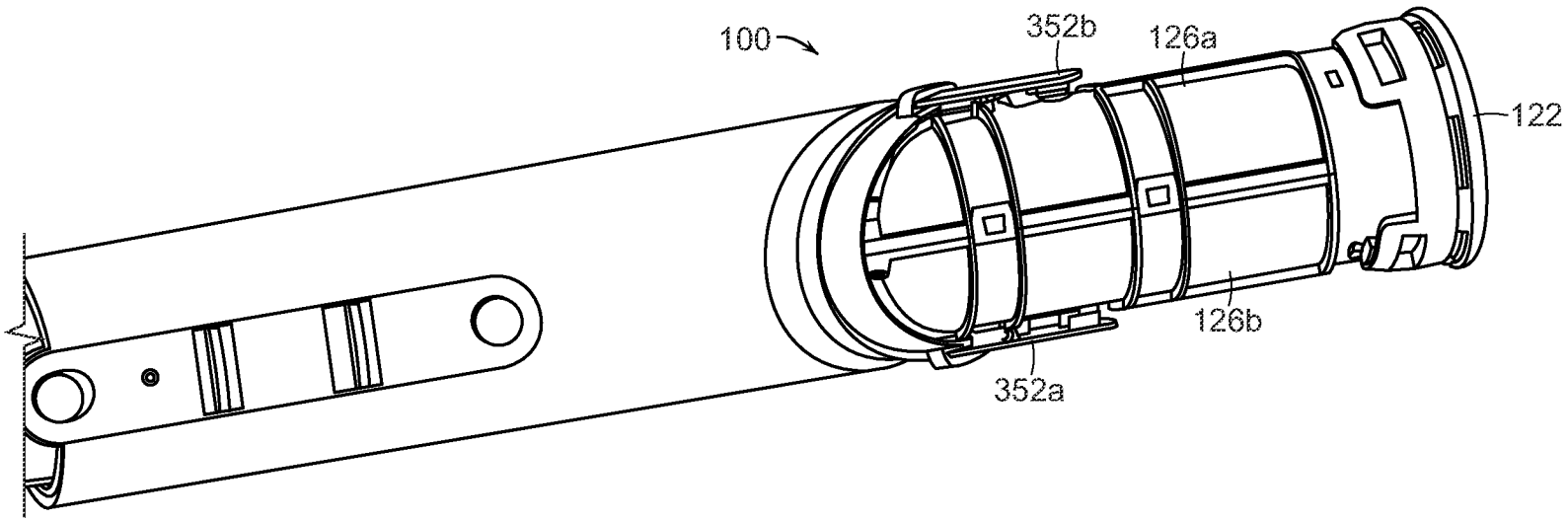
FIG. 34 is a another side perspective view showing the mating mechanism of FIG. 33.

Various features can also be provided to aid in preventing rotation of the attachment relative to the body of the appliance. For example, a sleeve attachment can include features on an inner surface, such as longitudinally oriented ribs on the inner surface, that can engage with one or more protrusions provided on an outer surface of the body housing 124. For example, as shown in FIG. 33, the body housing 124 of the appliance 100 includes a recess 350 that seats a first protrusion 352*a* at a location adjacent to the hinge joint 300. The first protrusion 352*a* can engage with a portion of an inner surface of an attachment that has been slid over the body housing 124. As shown in FIG. 34, in which the body housing 124 is removed, a second protrusion 352*b* can be positioned on an opposite side of the body and can protrude from the first body frame 126*a*. The first protrusion 340*a* is shown protruding from the second body frame 126*b*.

The hair care appliance 100 can include a plurality of interchangeable attachment mating assemblies. For example, a first attachment mating assembly can include a sleeving design to allow an attachment to be sleeved over an outlet end of the hair care appliance 100. A second attachment mating assembly can include a faceplate mating design such that an attachment abuts the outlet end of the hair care appliance. A third attachment mating assembly can include a mating collar configured with protrusions, such as lugs, which can be removably coupled with and secured within a mating portion of an attachment.

Figure 35B:
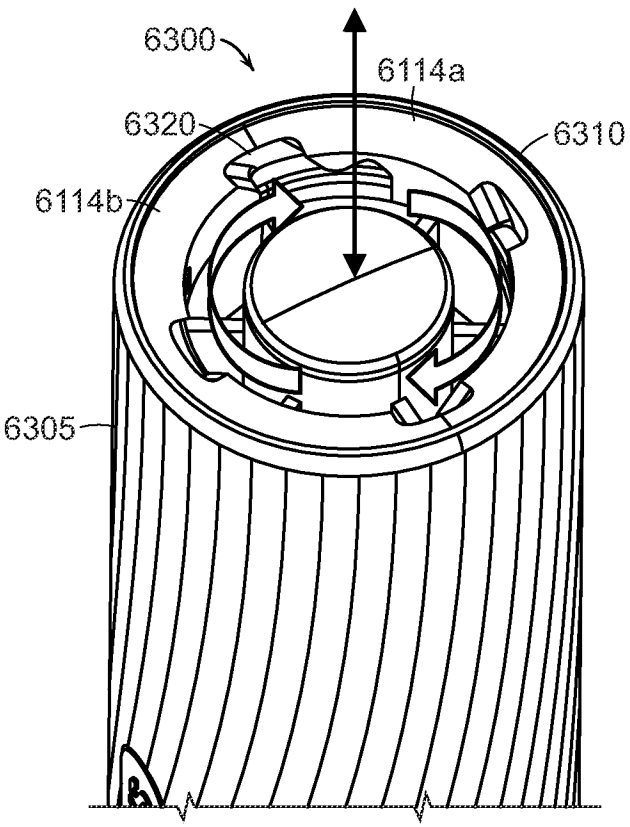
FIG. 35B is an end perspective of another embodiment of an attachment mating assembly of the hair care appliance.
Figure 35A:
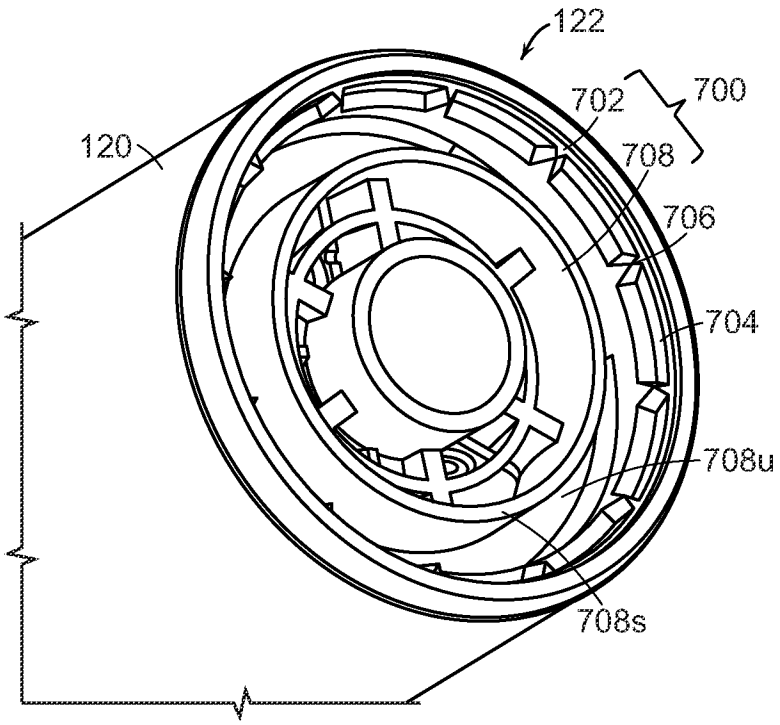
FIG. 35A is an end perspective view of the attachment mating assembly of FIG. 33.

FIG. 35A shows a close-up perspective view of an attachment mating assembly 700 configured at the outlet 122 of the hair care appliance 100. The attachment mating assembly 700 can be coupled to the first and second body frames 126*a*, 126*b*. As shown, the attachment mating assembly 700 includes a mating collar 702 and a mating plate 708. The mating collar 702 can include a plurality of recesses 704 arranged around the circumference of the mating collar 702. The recesses 704 can be configured to receive one or more engagement features of an attachment configured for use with the hair care appliance, as will be discussed in more detail below. The attachment can slide over the outlet 122 of the body 120 and the engagement features of the attachment can engage and be seated within the recesses 704 of the mating collar 702 to reduce rotation of the attachment relative to the body 120. Rotation can be reduced or limited by way of projections 706 bounding either side of a given recess 704.

Figure 62:
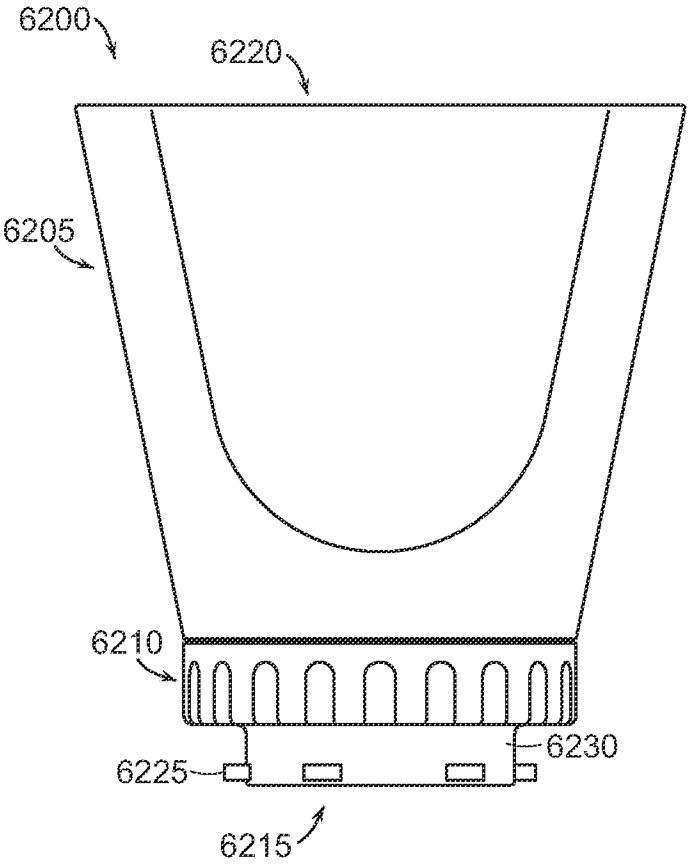
FIG. 62 is a side view of an exemplary embodiment of a concentrator attachment configured for use with a hair care appliance.

Another embodiment of an attachment mating assembly can 6310 be seen in FIG. 35B. The outlet end 6300 in the body 6305 of a hair care appliance similar to appliance 100 can include an attachment mating assembly 6310. The attachment mating assembly 6310 can include attachment mating plates 6114*a* and 6114*b*, each of which can include a plurality of slots 6320. When an attachment with attachment features, such as attachment features 6225 of a concentrator attachment 6200 shown in FIG. 62, is coupled to the outlet end 6300, a user can rotate the concentrator attachment 6200 to engage the attachment features 6225 within the slots 6114*a* and 6114*b* and secure the concentrator attachment 6200 to the hair care appliance 100.

The attachment mating assembly 700 can also include a mating plate 708 arranged inferiorly (e.g., upstream of the outlet 125) to the mating collar 702. The mating plate 708 can include an upper surface 708*u* onto which a surface of an attachment can abut. The mating plate 708 can also include a mating plate shoulder 708*s* extending from the upper surface 708*u*. The mating plate shoulder 708*s* can be sized and configured to insert into a receiving portion arranged at a coupling end of an attachment.

Figure 36:
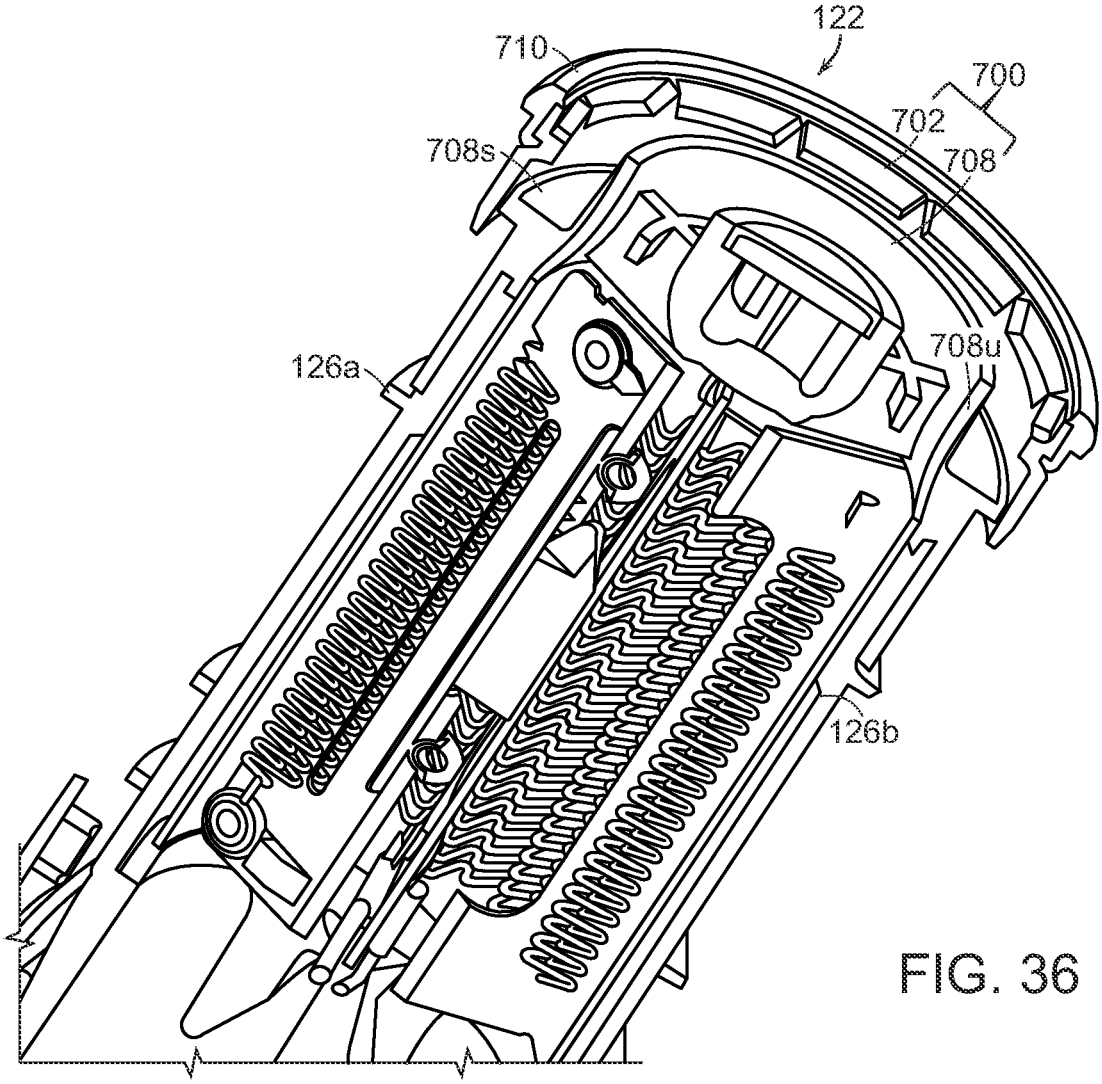
FIG. 36 is a cross-sectional perspective view of the attachment mating assembly of FIG. 35.

As shown in FIG. 36, the attachment mating assembly 700 can also include an outlet trim ring 710 coupled to the mating collar 702. The outlet trim ring 710 can include one or more surface finishes or applied materials. The mating plate 708 can couple to the first and second body frames 126*a*, 126*b* via a snap fit or friction fit or using other attachment technique.

Figure 37:
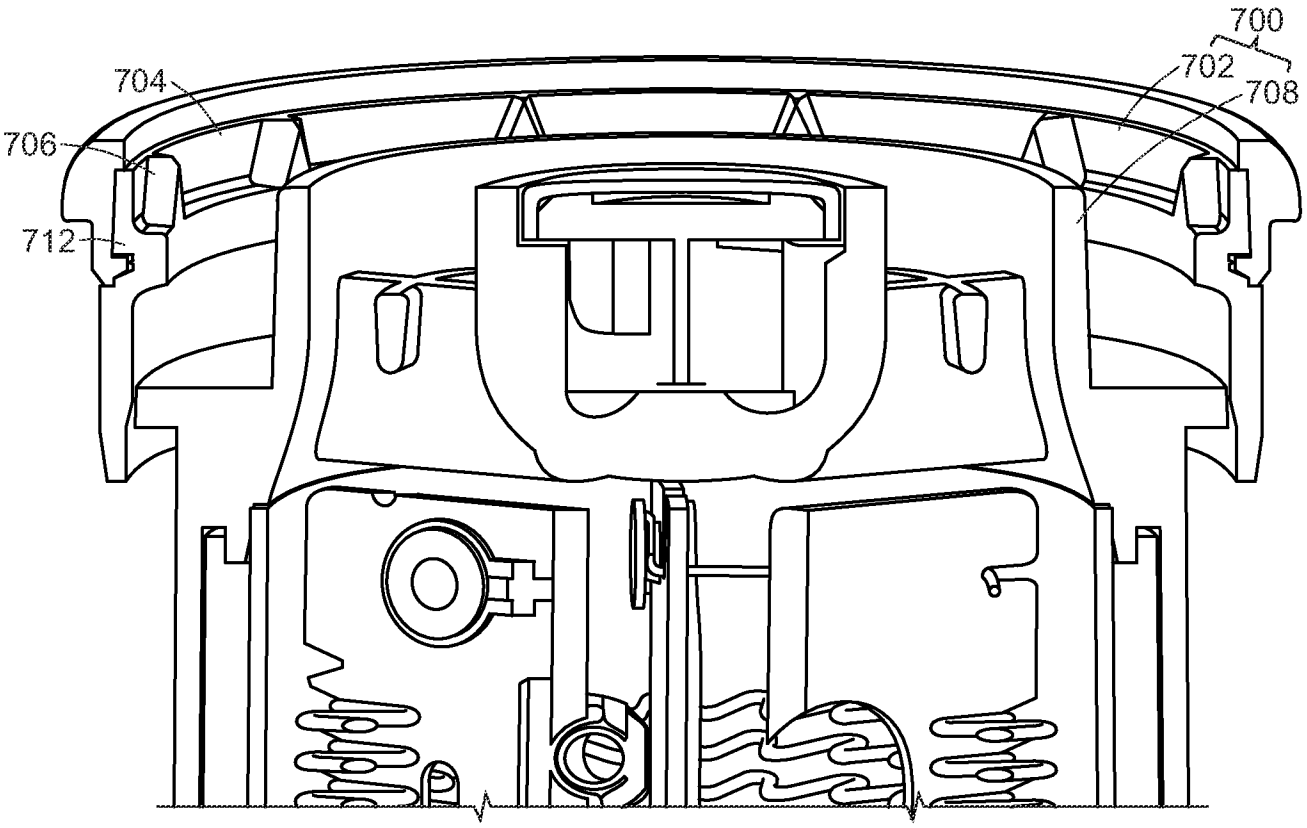
FIG. 37 is a cross-sectional side view of the attachment matching assembly of FIG. 35.

As shown in FIG. 37, the mating collar 702 can include an engagement shelf 712. The engagement shelf 712 can be circumferentially located on the mating collar 702 inferior (e.g., below) to the recesses 704 and the projections 706. The engagement shelf 712 can be sized and configured to receive one or more engagement features of an attachment. For example, a hook-shaped engagement feature of an attachment can engage the engagement shelf 712 to couple an attachment to the attachment mating assembly 700. In some embodiments, the engagement shelf 712 can be segmented into segments by one or more slots separating respective segments.

In other embodiments, the attachment mating assembly can include a mating collar with protruding features, such as lugs, to engage with a mating portion of an attachment to secure the attachment to the outlet end of the hair care appliance 100. The mating portion of the attachment can include slots in which the lugs can be received. The lugs of the mating collar can be engaged into openings of the slots of the mating portion of the attachment and the attachment can be rotated onto the outlet end of the hair care appliance 100 to cause the lugs to travel fully within the slots of the attachment mating portion.

Attaching or detaching an attachment onto the outlet of the hair care appliance can be performed using an attachment actuator assembly configured at the outlet end of the hair care appliance. The attachment actuator assembly can include a user-operable latch configured to secure or release the attachment to the hair care appliance 100. A user can retract the latch to attach and remove an attachment and can release the retracted latch to secure the attachment in place. The latch can be coupled to a tab insertable into an opening of at least one slot of the mating portion of the attachment. When the tab is inserted within the slot opening, rotation of the attachment relative to the outlet end of the hair care appliance is eliminated and the attachment is secured to the hair care appliance.

Figure 72:
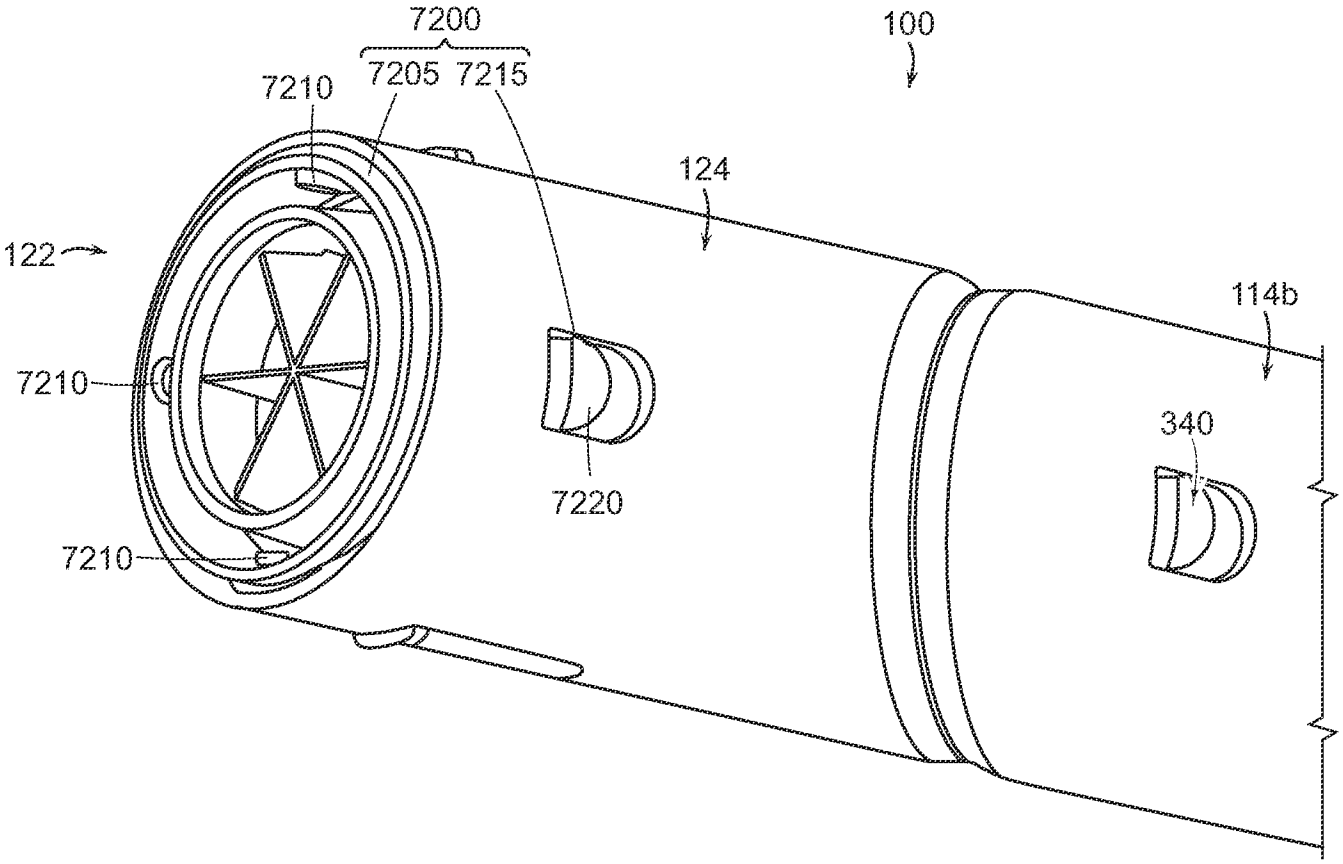
FIG. 72 is a side perspective view of another exemplary embodiment of an attachment mating assembly of a hair care appliance.
Figure 73:
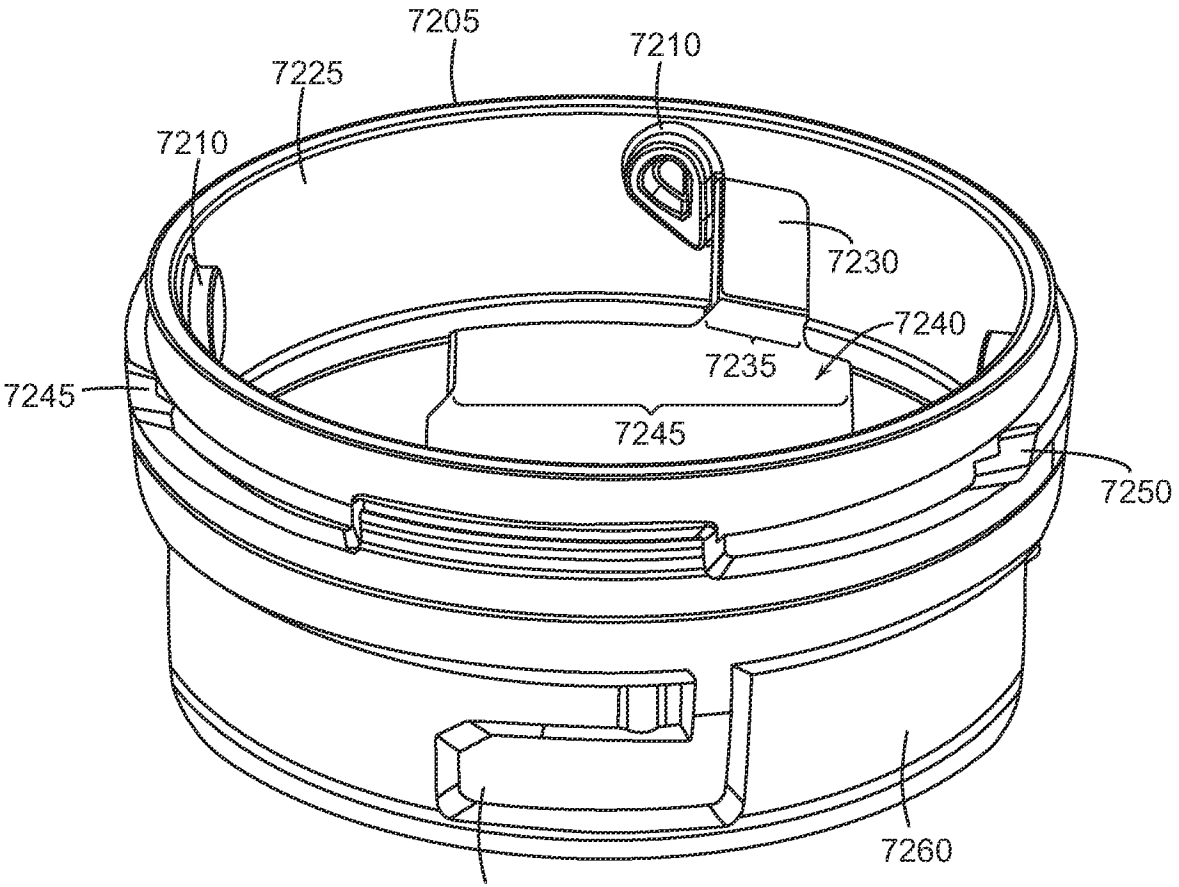
FIG. 73 is a perspective view of an attachment mating collar of the attachment mating assembly of FIG. 72.

FIG. 72 shows an exemplary embodiment of an attachment mating assembly 7200 of the hair care appliance 100. The attachment mating assembly 7200 includes a mating collar 7205 at an the outlet 122 and an attachment actuator assembly 7215 provided on the body housing 124. The mating collar 7205 can include one or more protrusions 7210. In some embodiments, the protrusions 7210 can be lugs and can protrude from an inner surface of the mating collar 7205. As shown in FIG. 73, the protrusions 7210 can protrude from an inner surface 7220 of the mating collar 7205. In some embodiments, the protrusions 7210 can have a tear-drop shape, although a variety of non-limiting shaped can be envisioned. The shape and dimensions of the protrusions 7210 can correspond to a shape and dimension of a corresponding receiving portion or slot that can be configured on a mating portion of an attachment of the hair care appliance 100. In some embodiments, 1, 2, 3, 4, 5, 6, 7, 8, 9, or 10 protrusions 7210 can be configured on the inner surface 7220 of the mating collar 7205. In some embodiments, the protrusions 7210 can be spaced apart along the inner surface 7225 by an equal distance between adjacent protrusions 7210. In some embodiments, the protrusions 7210 can be spaced apart along the inner surface by an unequal distance between adjacent protrusions 7210.

The mating collar 7205 also includes at least one recession 7230 configured to receive a tab or protruding portion of the attachment actuator assembly 7215. The recession 7230 can have a width 7235 corresponding to a width of the tab or protruding portion of the attachment actuator assembly 7215. As an attachment is mated with the mating collar 7205, the protrusions 7210 can travel into the slots configured on the mating portion of the attachment. Once travel is complete the user can release the latch 7220 of the attachment actuator assembly 7215 (such as the latch shown in FIG. 1) so that the tab portion of the attachment actuator assembly 7215 travels into the recession 7230 locking the attachment in place to prevent rotation of the attachment.

The mating collar 7205 can also include an opening 7240 along the circumference of the bottom portion of the mating collar 7205. The opening 7240 can receive the attachment actuator assembly 7215 therein. The opening 7240 can have a width 7245 corresponding to a width of the attachment actuator assembly 7215. The mating collar 7205 can also include one or more shoulder elements 7250 protruding from sides of the mating collar 7205 at one or more locations. The shoulder elements 7250 can be configured to allow the mating collar 7205 to friction fit or snap fit with an outlet ring, such as the outlet ring 7715 shown in FIG. 77. The mating collar 7205 can also include slots 7255 positioned at one or more locations around the circumference of the outer surface 7260 of the mating collar 7215. The slots 7255 can be configured to secure the mating collar 7205 to the body housing 124.

Figure 74:
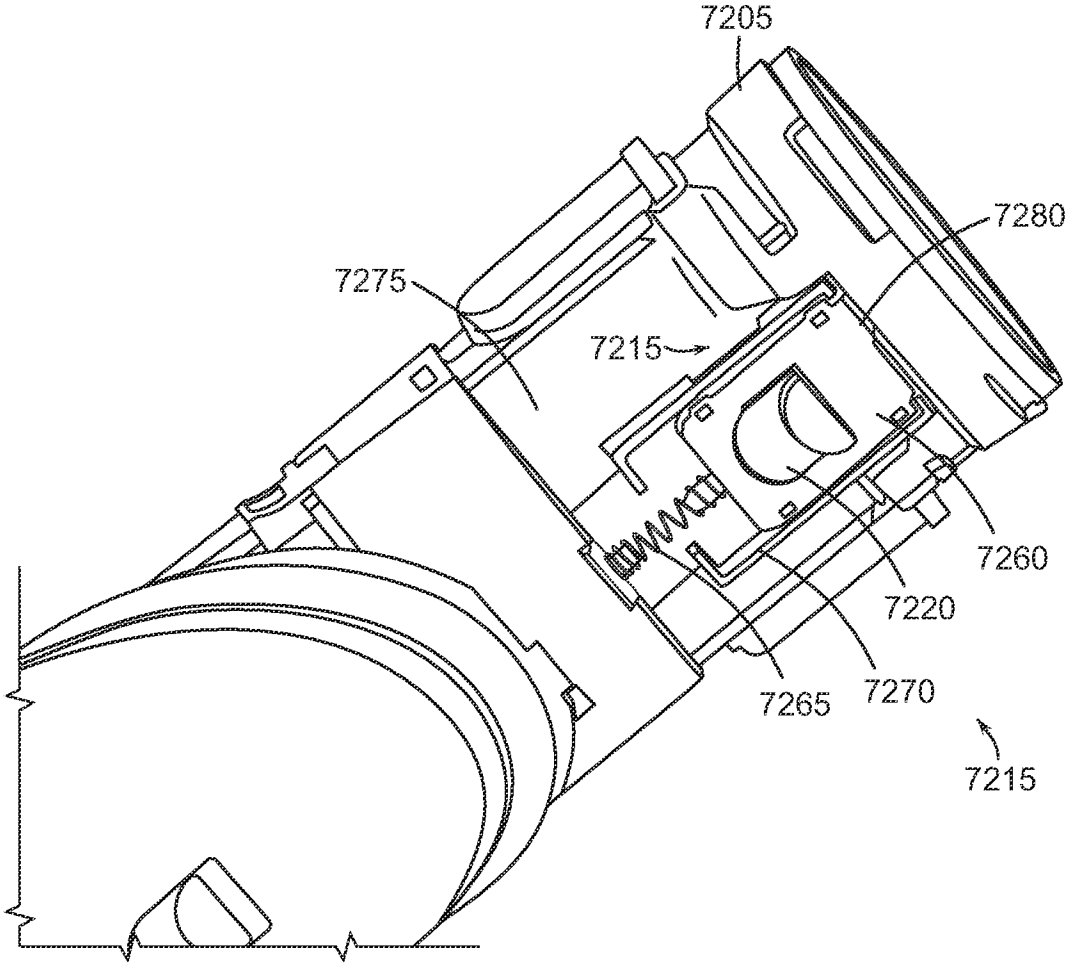
FIG. 74 is a side perspective view of an attachment actuator assembly and the attachment mating collar of the attachment mating assembly of FIG. 72.
Figure 75:
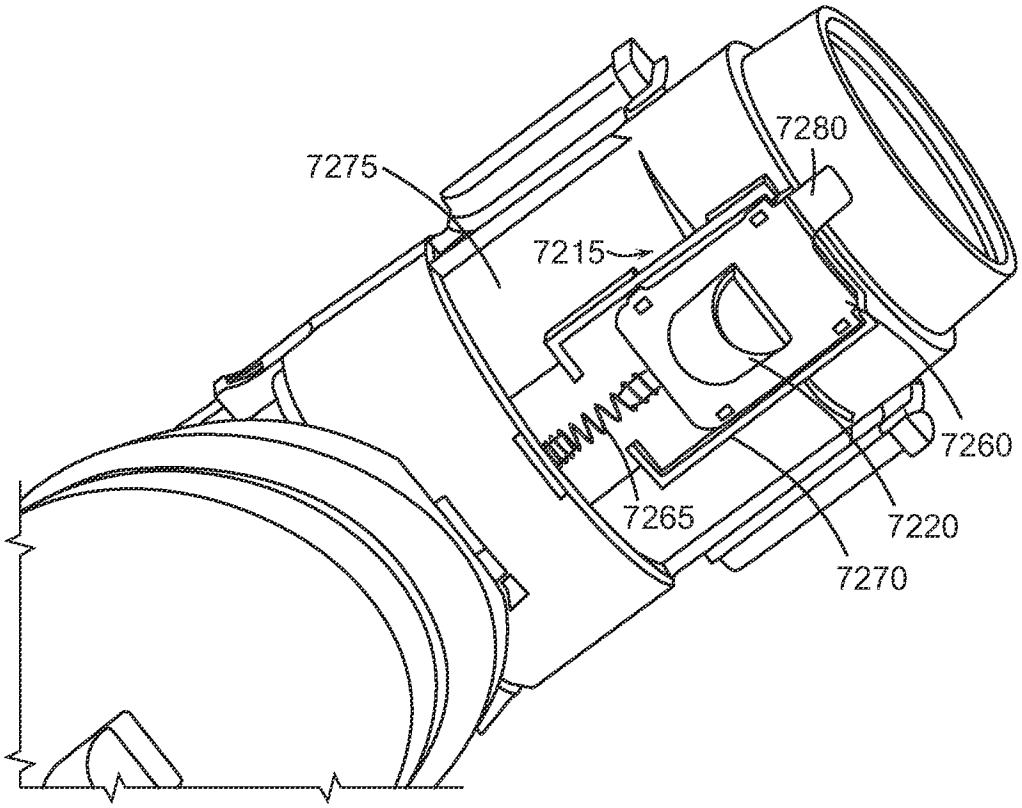
FIG. 75 is a side perspective view of the attachment actuator assembly of the attachment mating assembly of FIG. 72.

The attachment actuator assembly 7215 can include a latch 7220 as shown in FIG. 72. The latch 7220 can be coupled to a base 7260 of the attachment actuator assembly 7215 as shown in FIG. 74. In some embodiments, the latch 720 can be integrated with the base 7260. The base 7260 can be coupled to a compression element 7265 of the attachment actuator assembly 7215. Depressing the latch 7220 can cause the base 7260 to compress the compression element 7265 so that the base is retracted away from the mating collar 7205. In some embodiments, the compression element 7265 can be a spring as shown in FIG. 74. The base 7260 can travel within a body frame 7275 of the hair care appliance. The body frame 7275 can correspond to a first body frame 126*a* or a second body frame 126*b* as shown and described in relation to FIG. 7. The base 7260 can also include a protruding portion or tab 7280. In some embodiments, the protruding portion 7280 can be coupled to the base 7260. The tab 7280 can extend from the base 7260 into the mating collar 7205 so as to secure an attachment within the mating collar 7205. For example, after a user has coupled an attachment to the mating collar 7205, the user can release the latch 7220. As a result, the compressible element 7265 can extend to push the base 7260 toward the mating collar 7205 such that the tab 7280 extends into the recession 7230 shown in FIG. 73 and into the slot included in the mating portion of the attachment. In FIG. 75, the mating collar 7205 has been removed to illustrate the tab 7280 extending from the base 7260 of the attachment actuator assembly 7215. Retracting the latch 7220 can cause the tab 7280 to move away from and out of the mating collar 7205 so that the attachment can be removed from body housing 124.

Figure 76B:
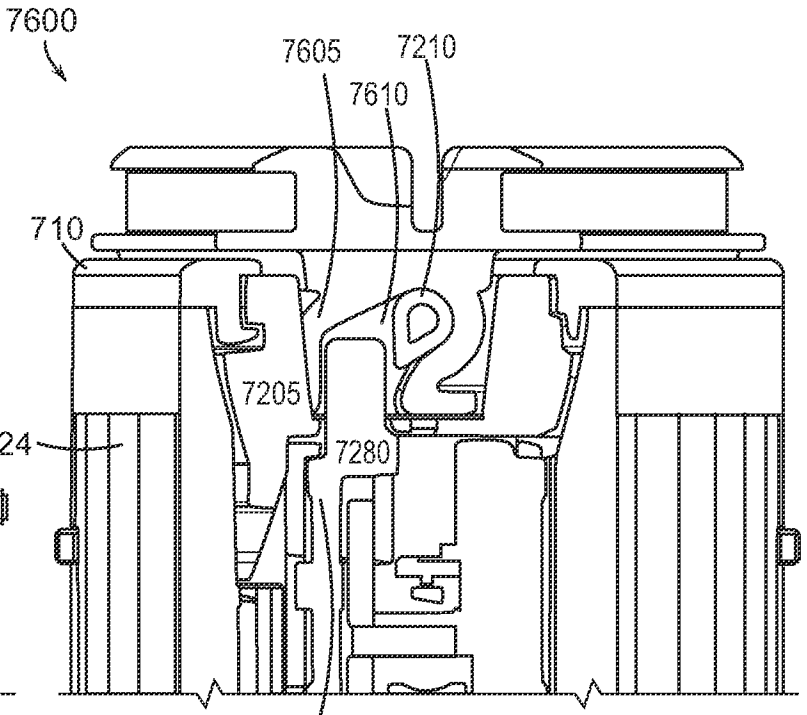
FIG. 76B is a cut-away cross-sectional view of the attachment actuator assembly coupled with attachment mating collar of FIG. 73.
Figure 76A:
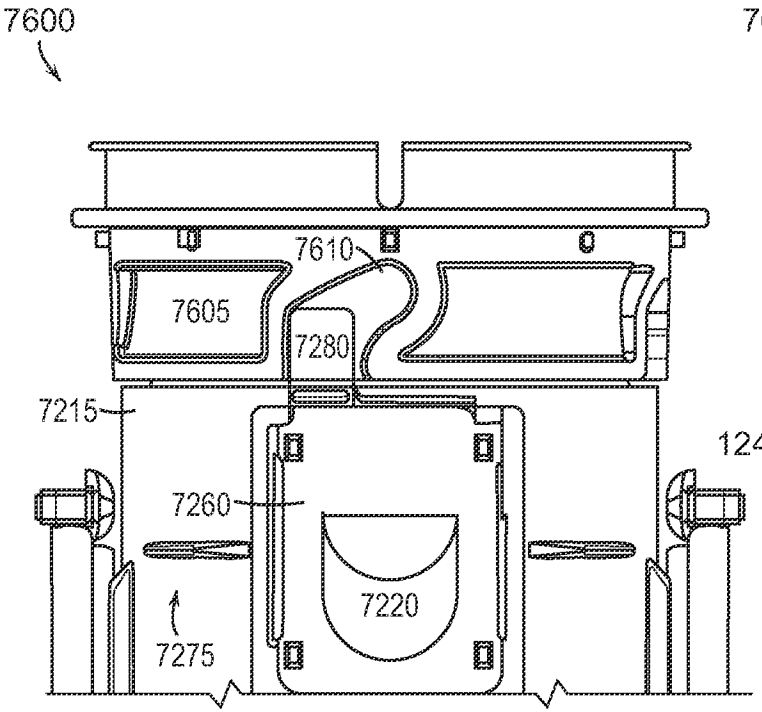
FIG. 76A is a cross-sectional view of the attachment actuator assembly coupled with the attachment mating collar of FIG. 73.

The attachment actuator assembly 7215 can be seen in more detail in FIG. 76A showing the attachment actuator assembly 7215 engaged with an attachment mating portion 7600 of an attachment according to embodiments described herein. As shown in FIG. 76A, the body housing 124 has been removed for illustration and the exterior of the attachment mating portion 7600 can be viewed. The attachment mating portion 7600 can include an attachment mating collar 7605. The attachment mating collar 7605 can include one or more slots 7610. The slots 7610 can include an opening at which the tab 7280 can be received. When the latch 7220 is released, the tab 7280 can extend or travel into the slot 7610 to secure the attachment mating portion 7600 to the outlet 122 of the body 120 of the hair care appliance 100. In FIG. 76B, a cut-away view of the attachment actuator assembly 7215 engaged with the attachment mating portion 7600 is shown. The cut-away view shows an internal perspective of the attachment actuator assembly 7215 engaged with the mating collar 7205, as well as the protrusions 7210 engaged with the attachment mating portion 7600. The user has rotated the attachment mating portion 7600 into contact with the mating collar 7205 such that the protrusions 7210 have traveled into a receiving end located at a terminal end of the slot 7610 as shown in FIG. 76B. Once the protrusions 7210 are engaged fully within the slot 7610, the user can release the latch 7220 causing the tab 7280 to extend or travel into the slot 7610 to fully secure the attachment mating portion 7600 (and thus, the attachment) to the mating collar 7205 of the hair care appliance 100. Rotation of the attachment relative to the body 120 can thus be reduced or eliminated.

Figure 77:
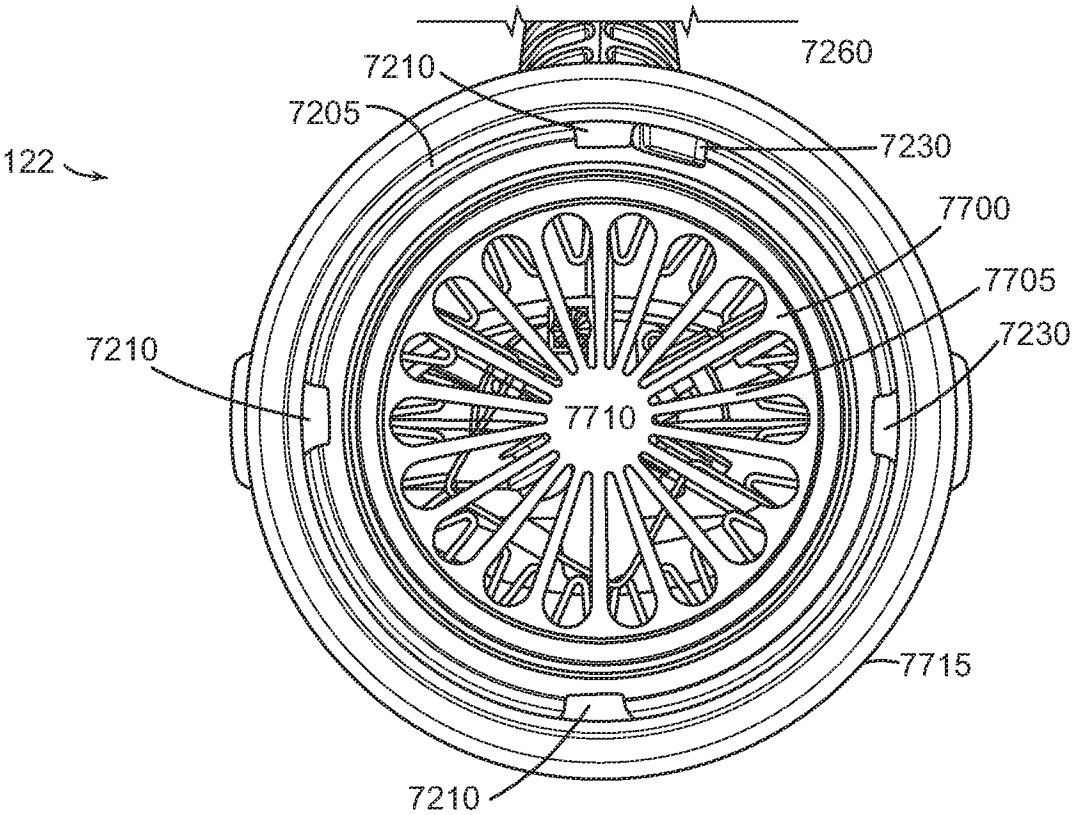
FIG. 77 is an end perspective view of an outlet grill of the attachment mating assembly of FIG. 72.

The hair care appliance 100 can also include a grill 7700 configured at the outlet 122 as shown in FIG. 77. The grill 7700 can include a plurality of vane elements 7705 extending radially from a center portion 7710. Although the vane elements 7705 of the grill 7700 are shown in a radial-shaped pattern, a variety of non-limiting patterns can be envisioned including a diagonal-shaped pattern, a mesh-shaped pattern or a concentric-shaped pattern of vane elements 7705. The outlet 122 can also include an outlet ring 7715. The outlet ring can couple to the mating collar 7205 via snap fitting.

Accessories

As explained above, the hair care appliance can be configured to mate to a number of different types of attachments or accessories via interchangeable mating assemblies of the hair care appliance 100. The attachments can be included in an accessory kit provided with or separately from the hair care appliance 100. FIGS. 38-68 illustrate various exemplary embodiments of attachments for use with the hair care appliance 100, however a person skilled in the art will appreciate that any attachment known in the art can be used with the appliance 100.

Figure 38:
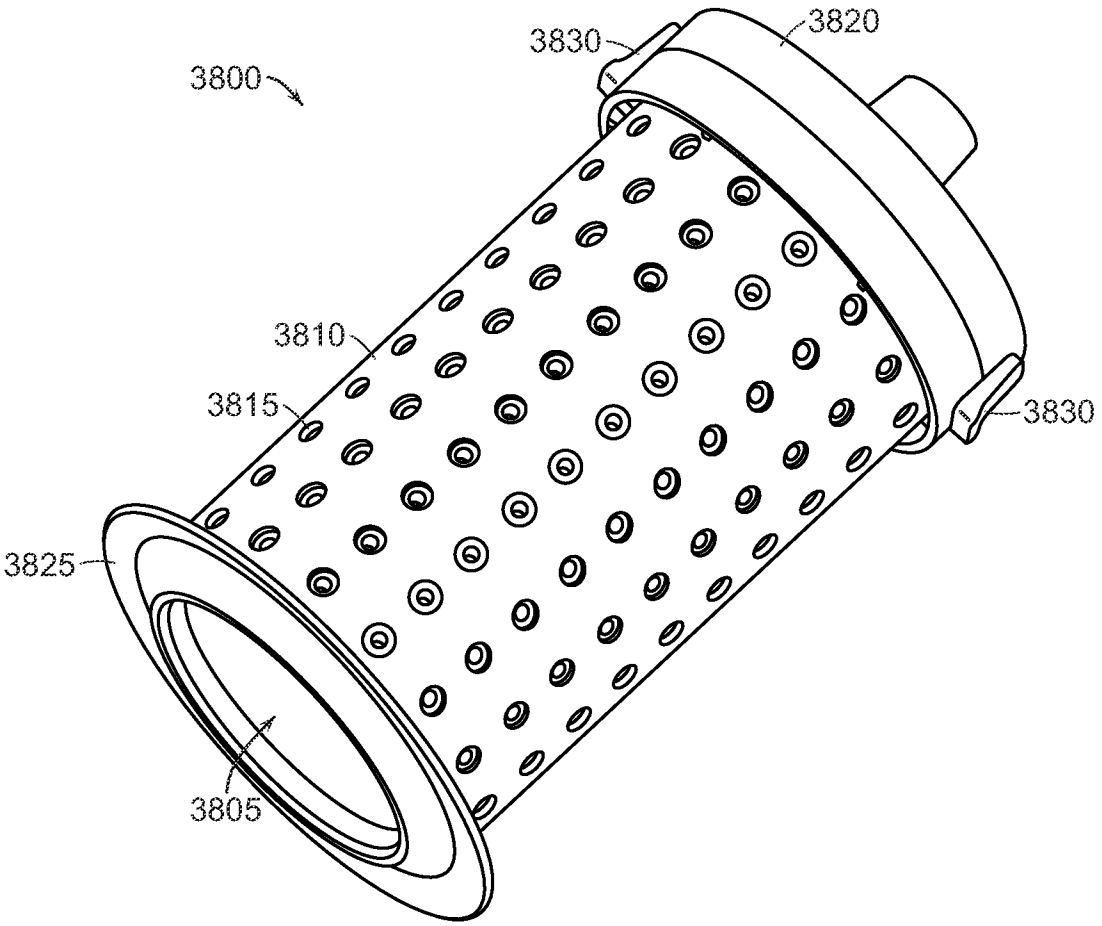
FIG. 38 is a perspective view of an exemplary embodiment of a round brush attachment configured for use with a hair care appliance.

FIG. 38 illustrates a round brush attachment 3800 having include an inlet 3805 at which a fluid flow can be received from the hair care appliance described herein. The round brush attachment 3800 can also include a cover 3810 with a plurality of holes 3815 arranged in the cover 3810. In some embodiments, the holes 3815 can be filled with brush bristles. The round brush attachment 3800 can also include an end cap 3820 and a base 3825. The end cap 3820 can include one or more release mechanisms 3830 configured to release latching mechanisms disposed within the round brush attachment 3800 from engagement with features of the attachment mating assembly 700 described in relation to FIGS. 35-37.

Figure 39:
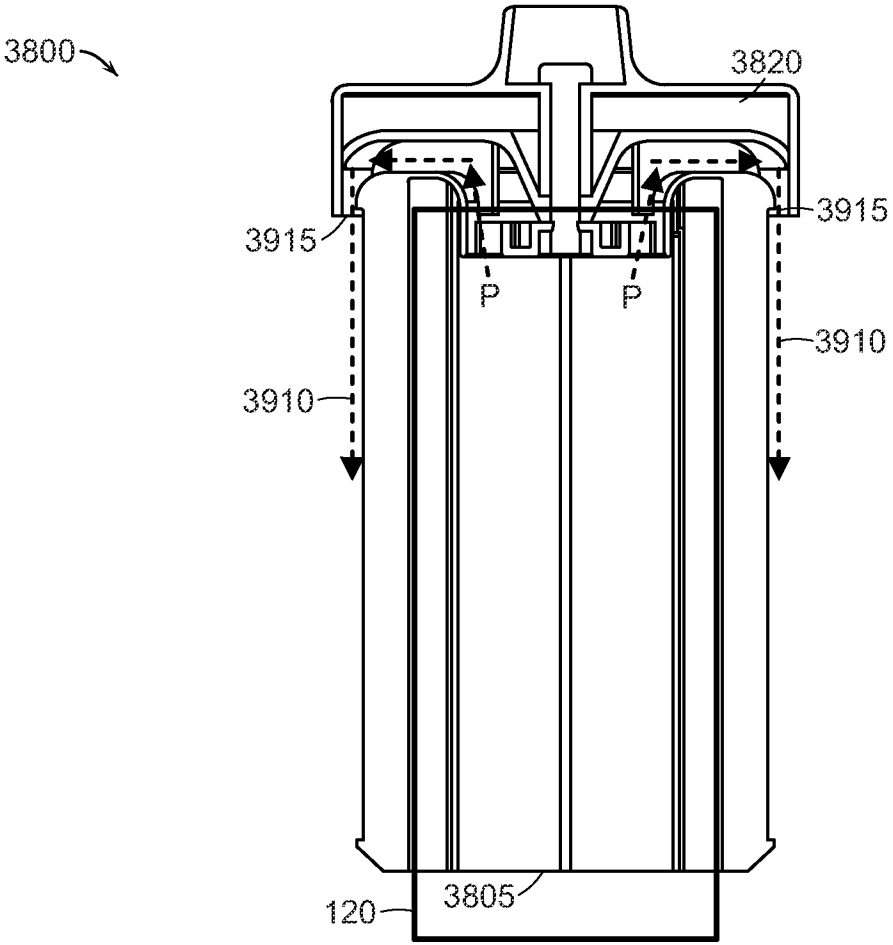
FIG. 39 is a cross-sectional view of the round brush attachment of FIG. 38.

As shown in FIG. 39, the round brush attachment 3800 can be sleeved over the body 120 of the hair care appliance 100. The brush attachment 3800 (as well as embodiments of other attachments described herein) can be sleeved over the body 120 so as to cover the rotational hinge joint 300. In this way, rotation of the attachment relative to the body 120 can be reduced. The fluid flow provided at the outlet 120 of the body can pass into the end cap 3820 via the fluid flow path P (shown via dashed lines) and out via an annular shaped outlet 3915 arranged on an inferior surface of the end cap 3820. The arrangement of the fluid flow path 3910 can advantageously direct a greater volume of fluid down the surface of the round brush attachment 3800 instead of outward away from the surface. Additionally, the arrangement of the fluid flow path 3910 is such that the fluid flow changes directions from a first direction within the round brush attachment 3800 to a second, opposite direction outside of the round brush attachment (e.g., down the exterior surface of the round brush attachment 3800). Redirecting the fluid flow path at the outlet 3915 in an opposite direction as it entered the round brush attachment 3800 can create an fluid curtain effect down the exterior surface of the round brush attachment 3800. This arrangement of the fluid flow path 3910 does not move hair way from the surface off the brush attachment during use. In some embodiments, a hand guard can be provided at the base 3825 of the round brush attachment 3800. The hand guard can prevent the fluid of the fluid flow path 3910 from contacting a user's hand as it travels down the exterior surface of the round brush attachment 3800.

Figure 40:
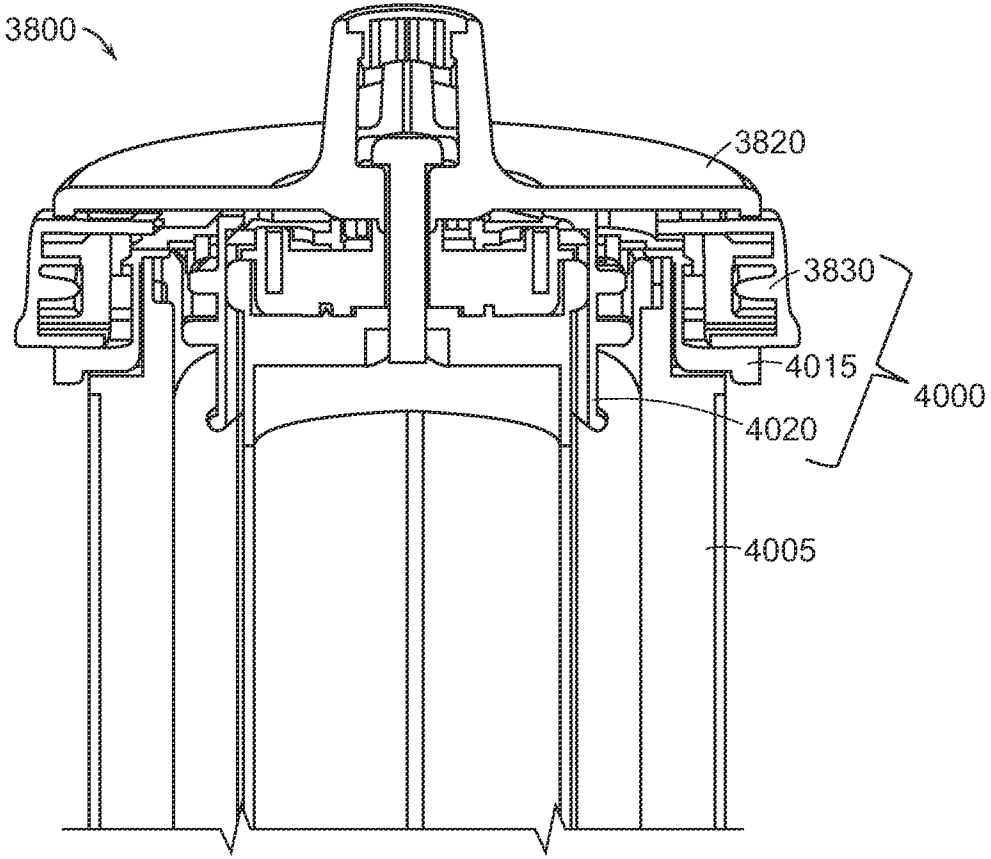
FIG. 40 is a cross-sectional view of the attachment mating assembly of the round brush attachment of FIG. 38.

As shown in FIG. 40, the attachment mating assembly 4000 can be positioned between the end cap 3820 and an attachment frame 4005. The attachment frame 4005 can form the body of the round brush attachment 3800 and can be sleeved over the outlet end of the body of the hair care appliance described herein. The attachment mating assembly 4000 can include one or more release mechanisms 3830 coupled to either side of a mating assembly plate 4015. The release mechanisms 3830 can be configured to release latching mechanisms 4020 from engagement with the attachment mating assembly 700 described in relation to the hair care appliance as shown in FIGS. 35-37. For example, the latching mechanisms 4020 can include hook-shaped features configured to engage with the engagement shelf 712 shown in FIG. 37.

Figure 41:
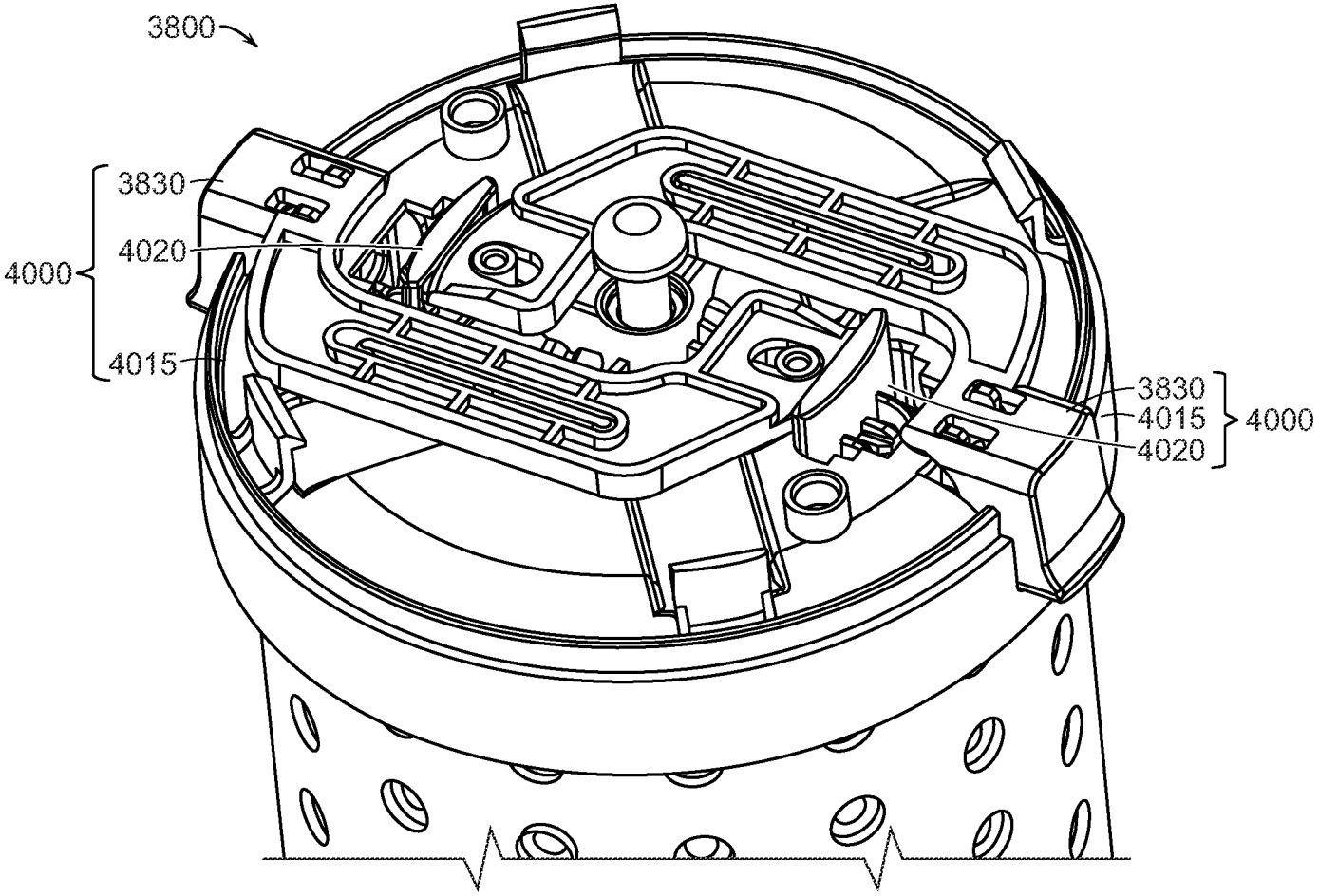
FIG. 41 is a top perspective view of a latching and release mechanism of the round brush attachment of FIG. 38.

As shown in FIG. 41, the end cap 3820 shown in FIGS. 38-40 has been removed for clarity. The release mechanisms 3830 can be arranged on an upper surface of the mating assembly plate 4015 and the latching mechanisms 4020 can be arranged on a bottom surface of the mating assembly plate 4015. Actuating the release mechanisms 3830 by pushing them toward the center of the round brush attachment 3800 will cause the latching mechanisms 4020 to also move toward the center of the round brush attachment. As a result, the hook-shaped engagement features on the latching mechanisms 4020 will move free of the engagement shelf 712 of the attachment mating assembly 700 in the body of the hair care appliance so that the attachment 3800 can be removed from the body of the hair care appliance. Although described in relation to the round brush attachment, in some embodiments, one or more of the attachment mating assemblies 4000 can be included on any of the attachments described herein.

Figure 42:
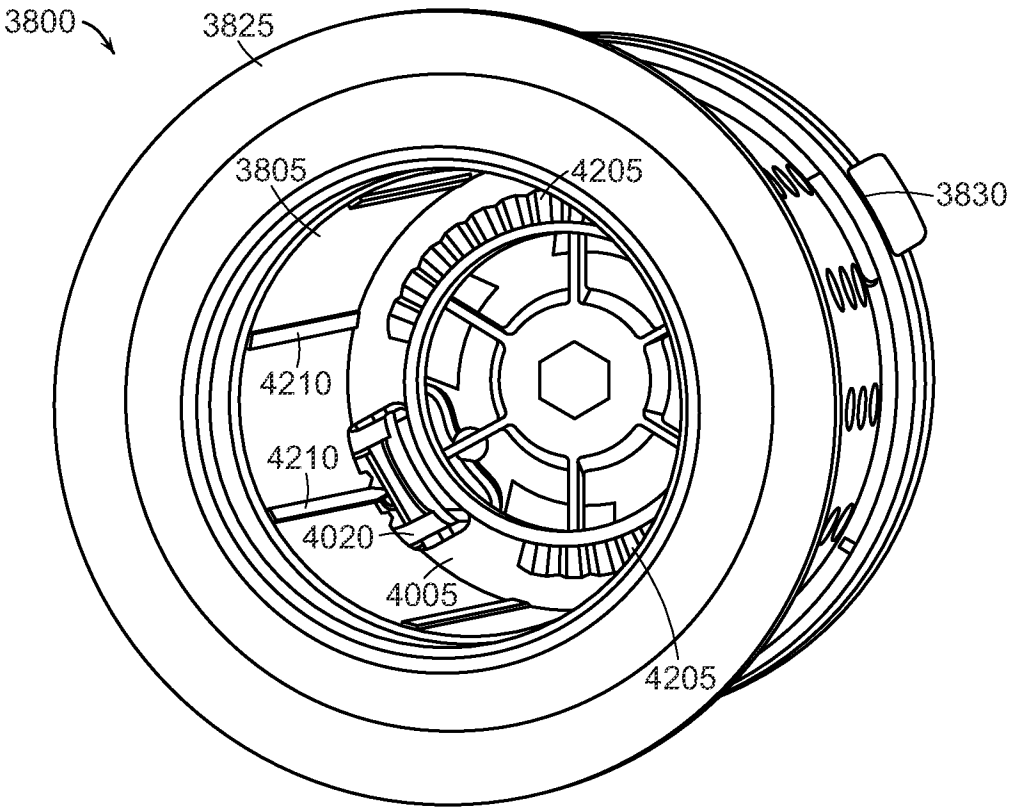
FIG. 42 is a bottom perspective view of engagement features of the round brush attachment of FIG. 38.

As shown in FIG. 42, the round brush attachment 3800 can include a plurality of protrusions 4205 protruding downward from an upper interior surface of the attachment frame 4005. In some embodiments, the protrusions 4205 can be configured on an engagement plate arranged between the attachment frame 4005 and the mating assembly plate 4015. In some embodiments, the protrusions can be formed on the mounting assembly plate 4015. The protrusions 4205 can engage with the recesses 704 of the attachment mating assembly 700 shown in FIGS. 35-37 and configured in the body of the hair care appliance 100 when the attachment is coupled to the hair care appliance. The protrusions 4205 when engaged within the recesses 704 of the attachment mating assembly 700 can advantageously limit rotation of the attachment relative to the body of the hair care appliance 100.

As further shown in FIG. 42, the round brush attachment 3800 can include a plurality of ribs 4210 extending longitudinally along an inner surface of the attachment frame 4005. The ribs 4210 can be configured and spaced so as to engage with the protrusions 340*a*, 340*b* configured on the body frames 126*a*, 126*b* and protruding through the body housing 124 as shown in FIGS. 33-34. When the round brush attachment 3800 is sleeved over the body housing 124 the ribs 4210 can engage with the protrusions 340*a*, 340*b* to advantageously limit rotation of the round brush attachment 3800 relative to the body of the hair care appliance described herein.

Although the configuration of the protrusions 4205 and the ribs 4210 are described in relation to the round brush attachment 3800, any attachment described herein can include a configuration of the protrusions 4205 and/or the ribs 4210 without limit.

Figure 43:
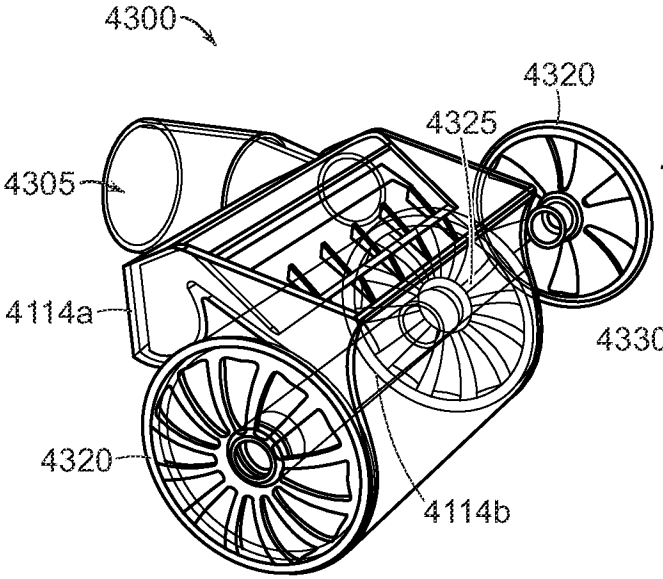
FIG. 43 is a perspective view of an exemplary embodiment of a curling attachment configured for use with a hair appliance.

FIG. 43 illustrates a curling attachment 4300 that can include an inlet 4305 fluidically coupled to a body 4114*a*. The inlet 4305 can couple with the outlet end of the hair care appliance 100 such that fluid expelled from the hair care appliance 100 via the outlet 122 enters the curling attachment 4300 at the inlet 4305. A spindle 4114*b* can be configured in the body 4114*a* and can be coupled to one or more wheels 4320. The wheels 4320 can allow a user to manually rotate the spindle 4114*b* to curl hair. A high velocity air slot 4325 can be provided in the top of the body 4114*a*.

Figure 44:
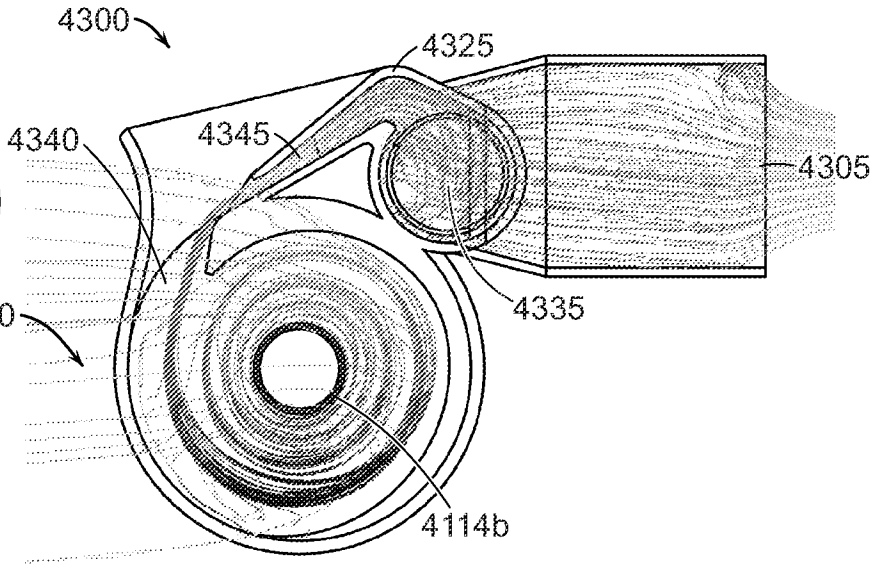
FIG. 44 is a cross-sectional view of a fluid flow through the curling attachment of FIG. 43.

As shown in FIG. 44, a fluid flow is illustrated by a plurality of flow lines extending between the inlet 4305 and the outlet 4330. Fluid flowing into the inlet 4305 is provided to a concentrating chamber 4335 before being directed to a curling chamber 4340 via a conduit 4345. The user can place their hair near the high velocity air slot 4325 at the top of the tool. The high velocity air can entrain the hair and cause it to wrap around the spindle 4114*b*. After leaving the hair to heat for 5-10 seconds, the user can then use the blow out feature 402 shown in the user interface 401 described in relation to FIG. 20 to help set the style. The hair is then pulled out of the curling attachment 4300. The spindle 4114*b* should freely rotate to prevent any binding.

Figure 45:
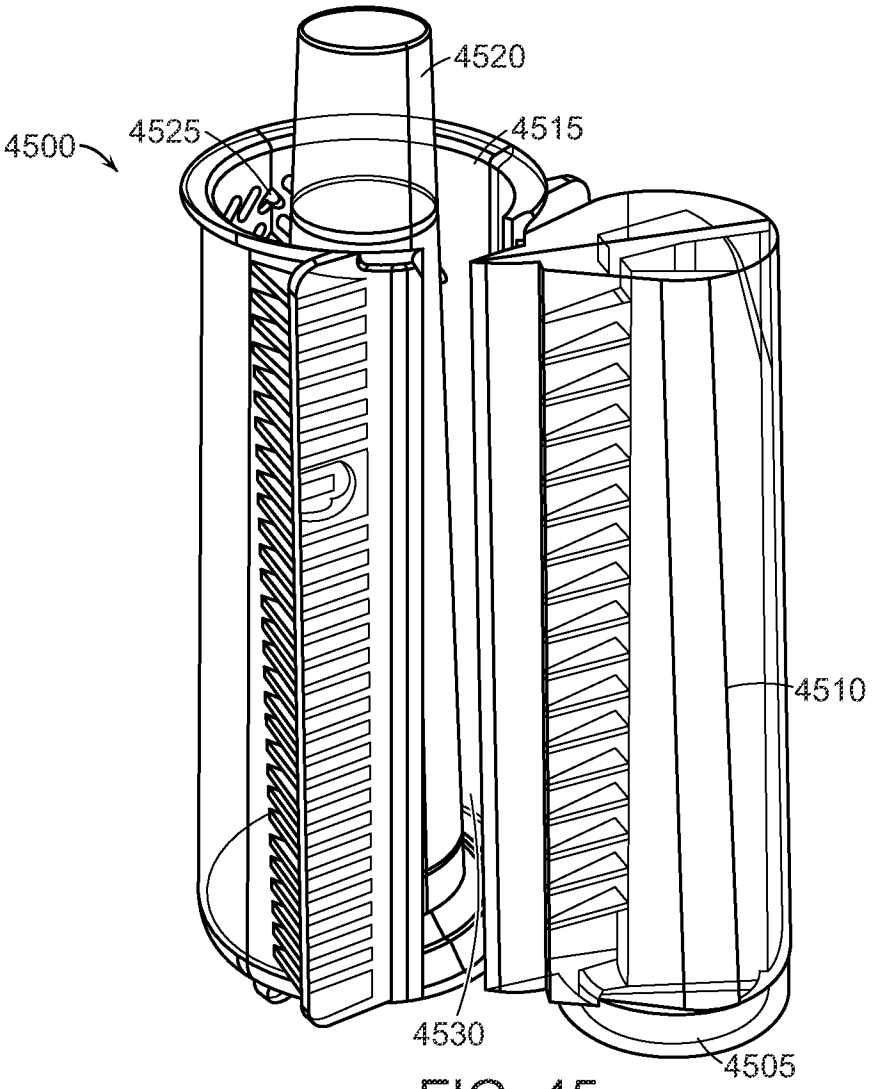
FIG. 45 is a perspective view of another exemplary embodiment of a curling attachment configured for use with a hair care appliance.

FIG. 45 illustrates a different embodiment of a curling attachment. The curling attachment 4500 shown in FIG. 45 can include an inlet 4505 at which a fluid flow from the hair care appliance 100 can be received. The inlet 4505 can be fluidically coupled to a concentrating body 4510. The concentrating chamber 4510 can fluidically couple to a curling chamber 4515. The curling chamber 4515 can include a spindle 4520 and an outlet 4525. In some embodiments, the spindle 4520 can have a tapered shape. The outlet 4252 can include a plurality of holes for the fluid flow entering the inlet 4505 to exhaust from the curling attachment 4505. The curling attachment 4500 can also include an opening 4530 into which a user can provide hair to be curled around the spindle 4520.

Figure 46:
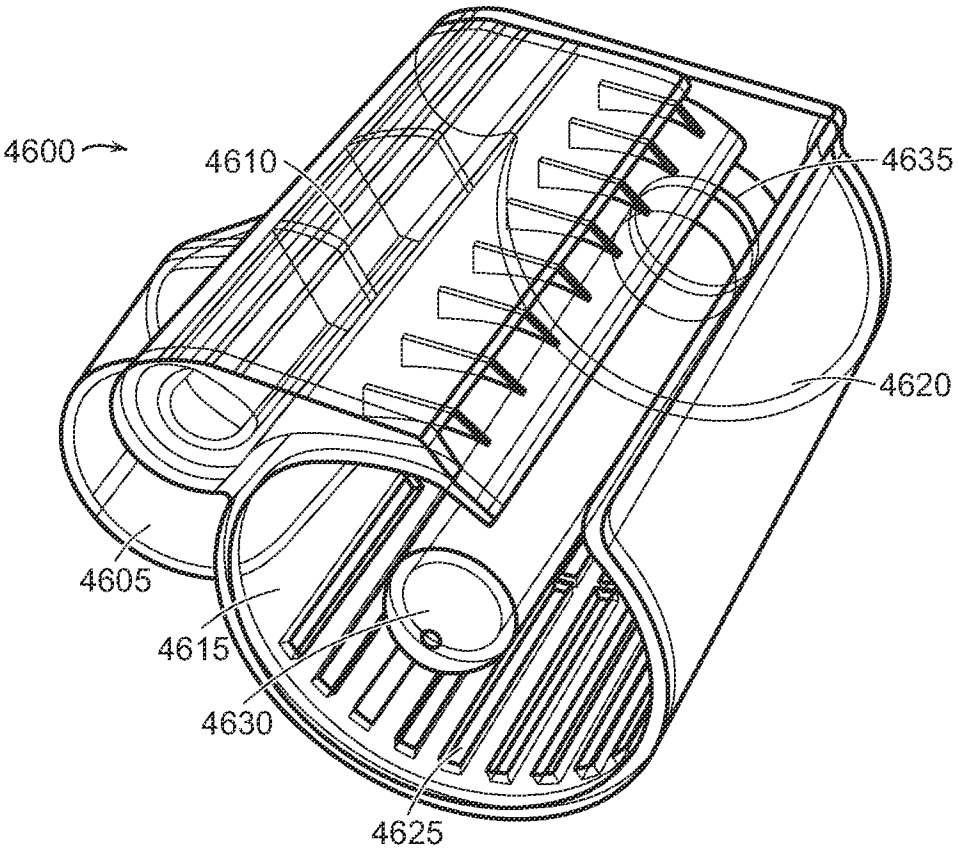
FIG. 46 is a perspective view of another exemplary embodiment of a curling attachment configured for use with a hair care appliance.

FIG. 46 illustrates another embodiment of a curling attachment 4600 having an inlet 4605 at which a fluid flow can be received from the hair care appliance 100. The fluid flow can enter a concentrating chamber 4610 and be provided to a curling chamber 4615. The curling chamber can be formed in a housing 4620 that includes a plurality of openings 4625 to exhaust the fluid flow from the curling attachment 4600. The curling attachment 4600 can include a spindle 4630 within the housing 4620. In some embodiments, the spindle 4630 can have a tapered shape on its length. Hair can be provided into the opening 4635 and can be curled around the spindle 4630.

Figure 48:
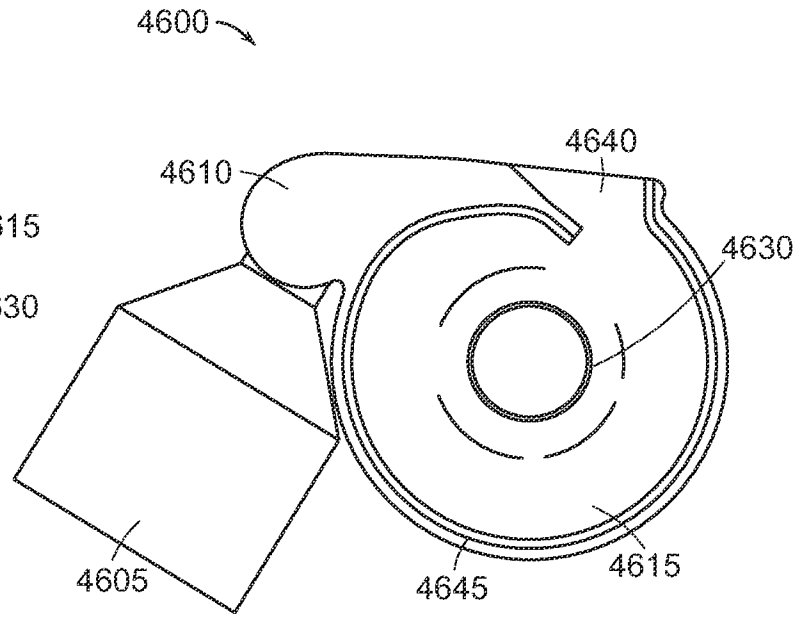
FIG. 48 is a side view of the curling attachment of FIG. 46.
Figure 47:
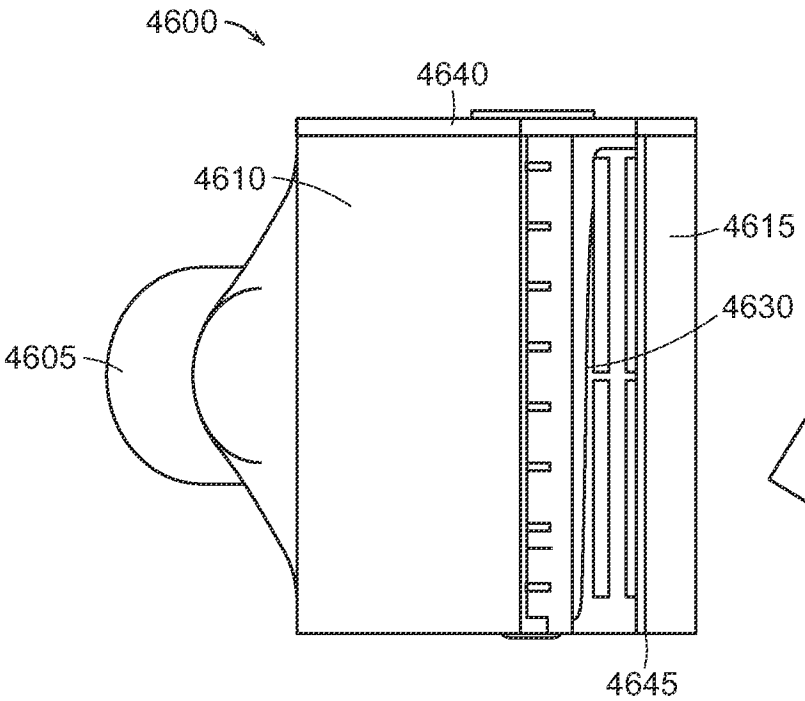
FIG. 47 is a top view of the curling attachment of FIG. 46.
Figure 49:
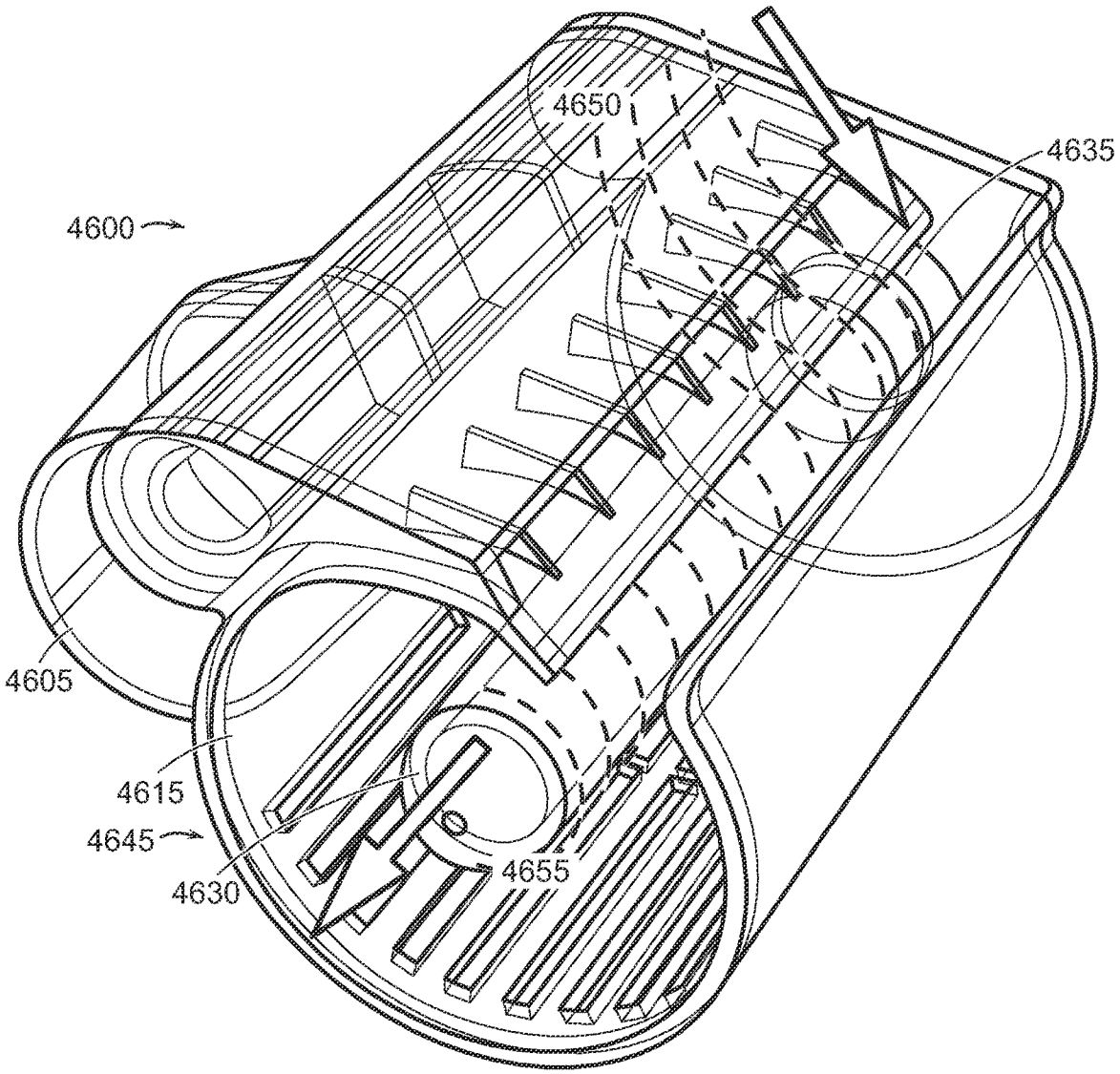
FIG. 49 is a perspective view of the curling attachment of FIG. 46 in operation.

In another embodiment, shown in FIG. 47, a curling attachment is provided and includes a plate 4640 coupled to an end of the concentrating chamber 4610 and the curling chamber 4615. The spindle 4630 can rotate relative to the plate 4630. The curling chamber 4615 can include an open end 4645 at which curled hair can be removed from the spindle 4630. As shown in FIG. 48, the spindle 4630 can extend from the plate 4640 into the curling chamber 4615. As shown in FIG. 49, uncurled hair 4650 can be provided into the opening 4635 and can be drawn into the opening as a result of the fluid flow provided to the inlet 4605 via the hair care appliance attached to the curling attachment 4600. As the fluid flow passes through the curling attachment 4600, the hair 4650 is drawn into the curling chamber 4615 and wraps around the spindle 4630 and can be curled. The curled hair 4655 can be removed from the curling chamber 4615 at the open end 4645.

Figure 50:
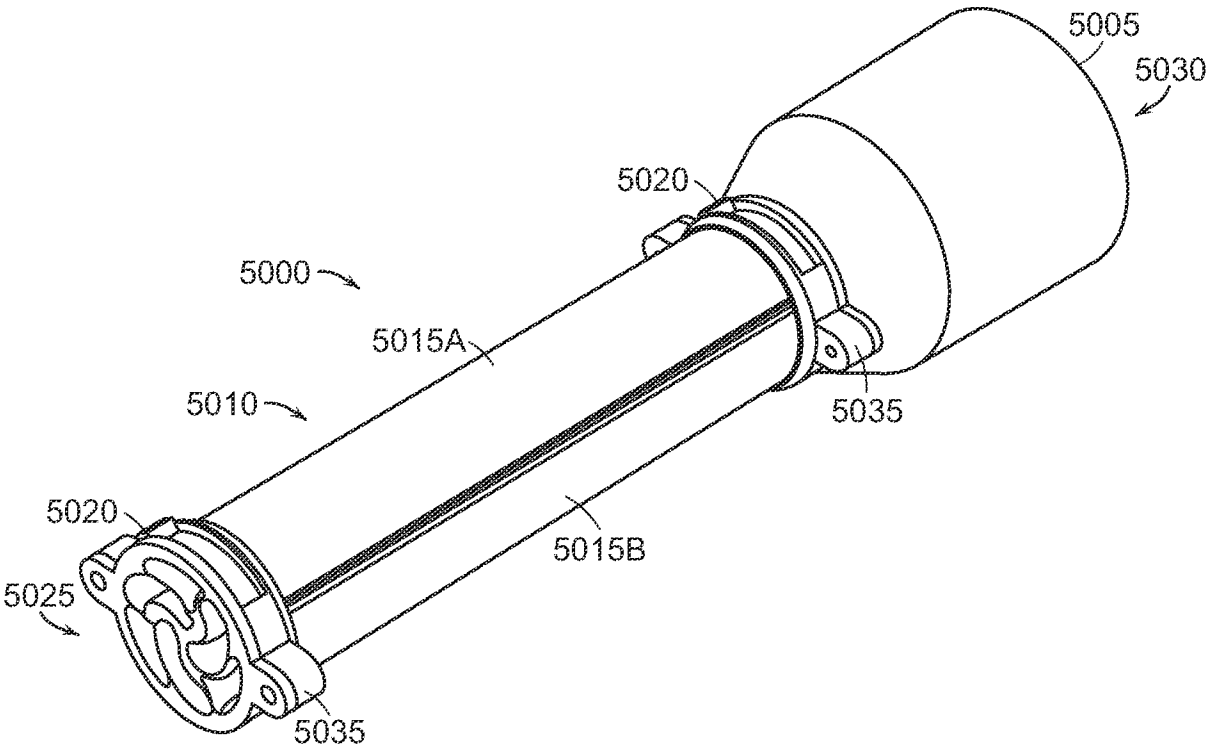
FIG. 50 is a perspective view of an exemplary embodiment of a barrel curling attachment configured for use with a hair care appliance.

FIG. 50 illustrates a barrel curling attachment 5000 that can be configured for use with the hair care appliance 100. The barrel curling attachment 5000 can include an inlet 5005 and a barrel 5010. The barrel 5010 can include a plurality of plates 5015, such as plates 5015A and 5015B. The plates 5015 can be configured to expand away from a central longitudinal axis of the barrel 5010. The fluid flow path can be along the central longitudinal axis of the barrel 5010. A scroll assembly 5020 can be arranged at the outlet end 5025 and the inlet end 5030. The scroll assembly 5050 can enable the plates 5015 to expand outward radially in order to expand the diameter of the barrel 5020. In this way, hair can be curled to different curl sizes based on a setting of the scroll 5020. The scroll assemblies 5020 can be individually set to different sizes so that the barrel is tapered from the outlet end 5025 to the inlet end 5030. The barrel curling apparatus 5000 can include a scroll assembly frame 5035 to which the scroll assembly 5020 can be mounted.

Figure 51:
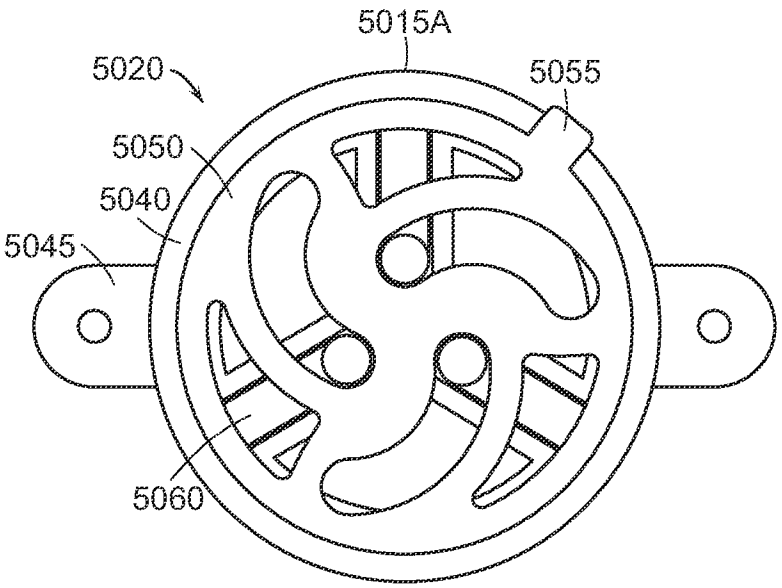
FIG. 51 is a cross-sectional end view of a scroll assembly of the barrel curling attachment of FIG. 50 in operation.

As shown in FIG. 51, the scroll assembly 5020 can be in an initial configuration corresponding to an unexpanded arrangement of the plates 5015. The scroll assembly 5020 can include a housing 5040 and one or more attachment tabs 5045 configured to couple the housing 5040 to the scroll assembly frame 5035. A scroll plate 5050 can be arranged within the housing 5040 and can include an adjustment tab 5055 thereon. A user can rotate the adjustment tab 5055 to cause the plate 5050 to rotate within the housing 5040. As the user rotates the adjustment tab 5055 (and thus rotating the plate 5050), extension elements 5060 can radially extend outward to move the plates 5015 away from the central longitudinal axis of the barrel curling attachment 5000.

Figure 52:
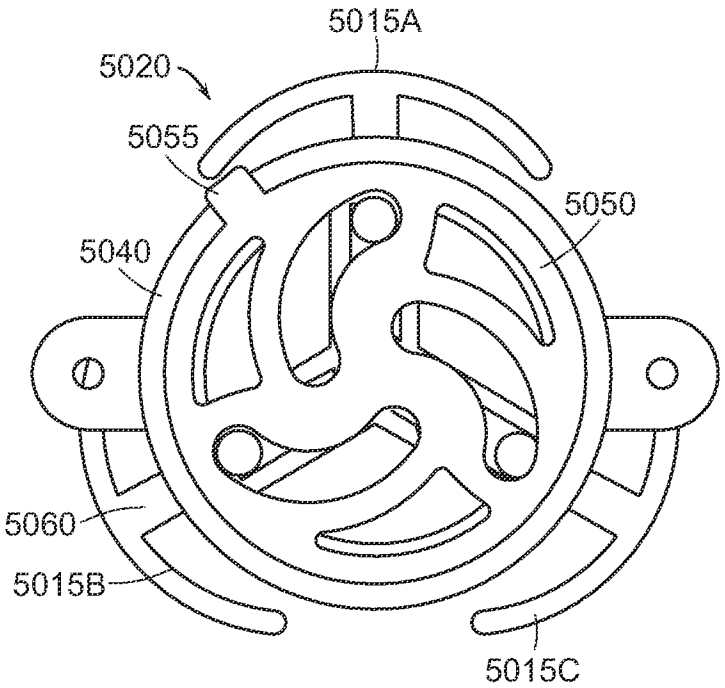
FIG. 52 is another cross-sectional end view of the scroll assembly of the barrel curling attachment of FIG. 50 in operation.

As shown in FIG. 52, the user has rotated the adjustment tab 5055 to a position opposite the position associated with the initial configuration shown in FIG. 51. Thus, the scroll assembly 5020 of FIG. 52 is shown in an expanded configuration. Rotation of the adjustment tab 5055 can cause the scroll plate 5050 to rotate and drive the extension elements 5060 radially outward. As a result, the plates 5015 are also extended radially outward. In this way, the outer diameter of the barrel curling attachment 5000 can be configurable by a user to allow for styling hair with a variety of curl sizes.

Figure 54:
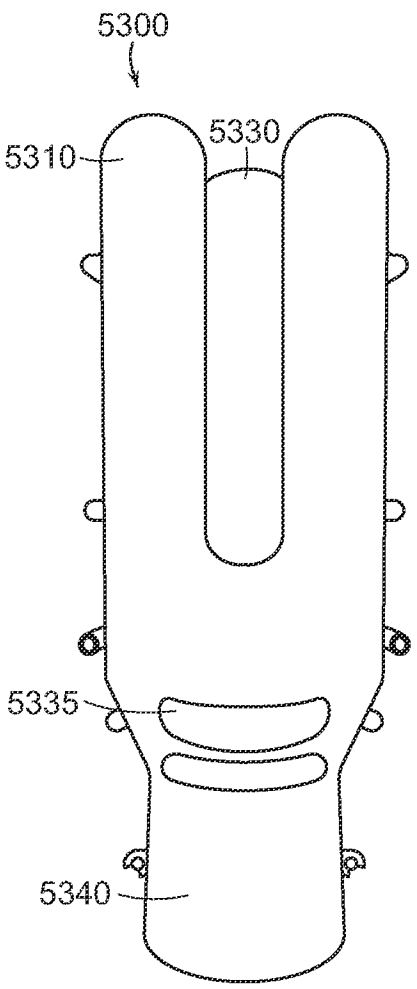
FIG. 54 is a side view of the wrapping barrel curling attachment of FIG. 53.
Figure 53:
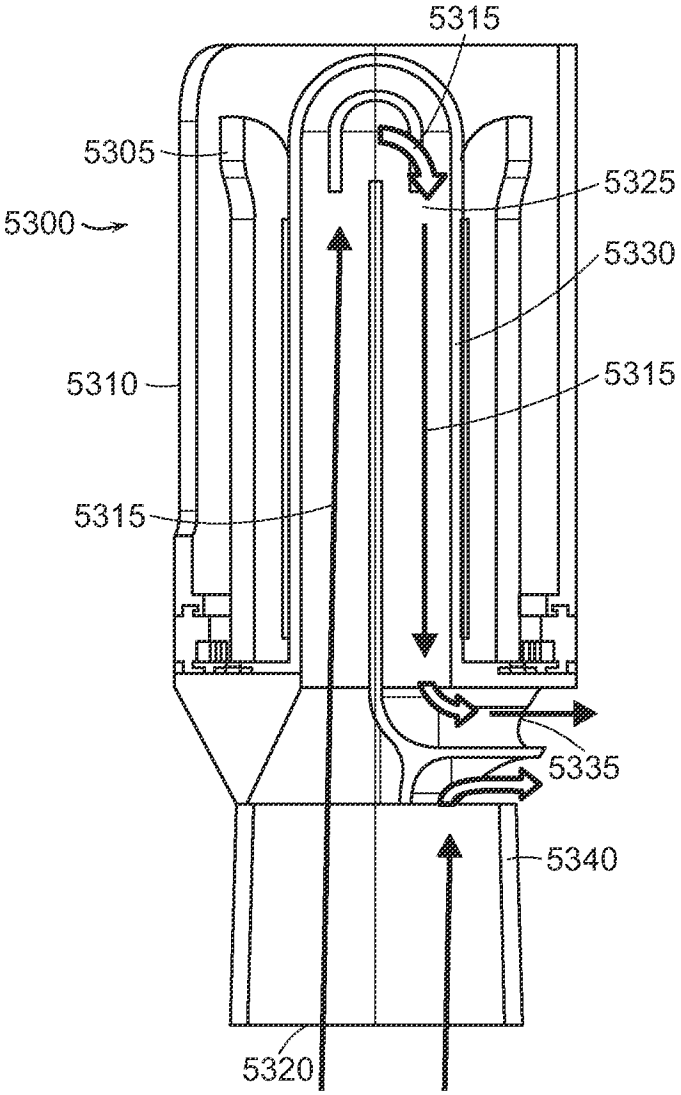
FIG. 53 is a cross-sectional view of an exemplary embodiment of a wrapping barrel curling attachment configured for use with a hair care appliance.

FIG. 53 illustrates an embodiment of a wrapping barrel curling attachment 5300 that can be configured with a rotating mechanism 5305 within a housing 5310. The wrapping barrel curling attachment 5300 can be configured to wrap hair into a coil so that the hair can be curled repeatedly. A fluid flow passage 5315 can extend from an inlet 5320 provided in an inlet housing 5340 of the wrapping barrel curling attachment 5300 through a flow passage chamber 5325 of a flow passage housing 5330 and to an exhaust 5335 configured on a side of the housing 5310. FIG. 54 is an image showing the wrapping barrel curling attachment 5300 of FIG. 53.

Figure 55:
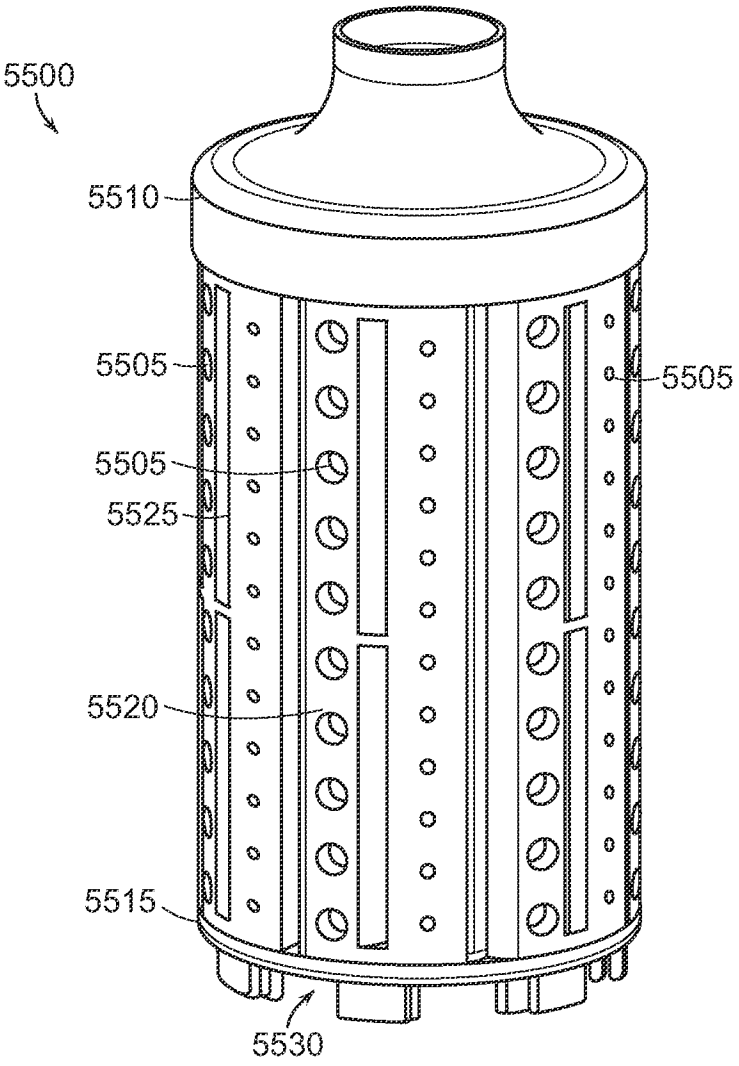
FIG. 55 is a perspective view of another exemplary embodiment of a round brush attachment configured for use with a hair care appliance.

FIG. 55 illustrates an embodiment of a round brush attachment 5500 that can include a plurality of plates 5505 extending between an end cap 5510 and a base 5515. The plurality of plates 5505 can include one or more holes 5520 and one or more slots 5525 configured on respective plates 5505. In some embodiments, brush bristles can be configured on one or more of the plates 5505. A variety of hole sizes and arrangements can be envisioned on the plates 5505 without limit. The round brush attachment 5500 can include a fluid flow pathway therein extending from an inlet 5530 through an inner volume of the round brush attachment 5500 and out via the holes 5520 and/or the slots 5525.

The plates 5505 can be arranged within the end cap 5510 and the base 5515 such that each of the plates 5505 can articulate in a rotational manner about the circumference of the round brush attachment 5500. For example, as a user pulls the brush attachment 5500 through their hair in a first direction, the plates 5505 can rotate clockwise with respect to a central longitudinal axis extending through the round brush attachment 5500. The plates 5505 can be parallel to the central longitudinal axis of the round brush attachment 5500. When the user pulls the brush attachment 5500 through their hair in a second direction, opposite to the first direction, the plates can rotate counter-clockwise with respect to the central longitudinal axis of the round brush attachment 5500. Based on the direction of rotation of the plates, the fluid flow pathway can exhaust the fluid out of the holes 5520 and/or the slots 5525.

Figure 56C:
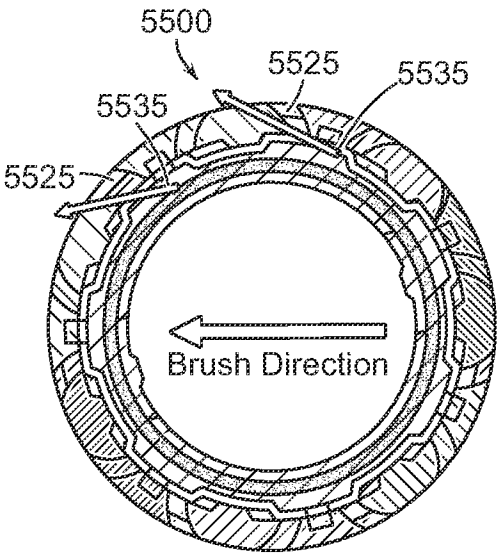
FIG. 56C is a cross-sectional view of the round brush attachment of FIG. 55 when used in a second direction.
Figure 56B:
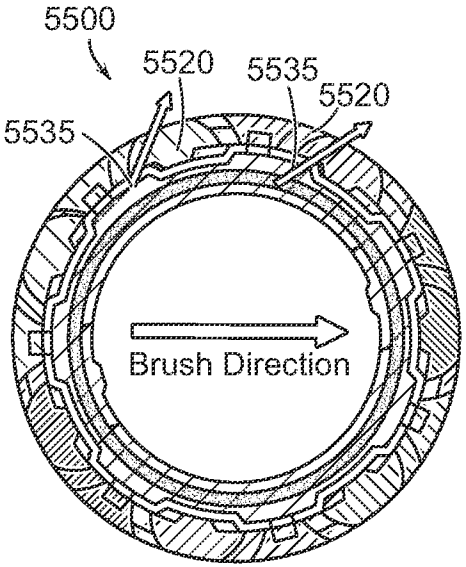
FIG. 56B is a cross-sectional view of the round brush attachment of FIG. 55 when used in a first direction.
Figure 56A:
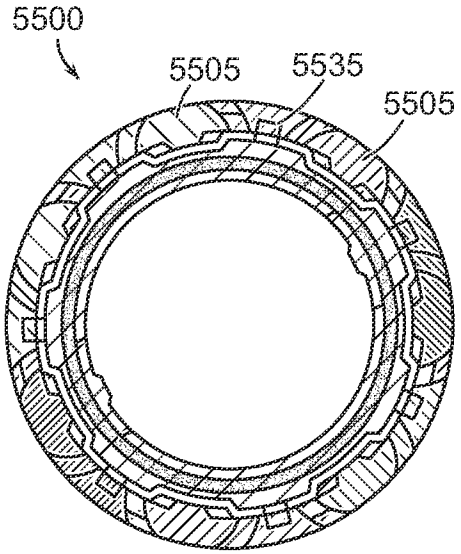
FIG. 56A is a cross-sectional view of the round brush attachment of FIG. 55 in neutral configuration.

As shown in FIG. 56A, the round brush attachment 5500 is shown in a neutral position. In this position, outlets 5535 arranged within the fluid flow pathway are blocked from providing the fluid flow through the plates 5505. As shown in FIG. 56B, when the round brush attachment 5500 is moved in a first direction the plates 5505 rotate clockwise to allow the outlets 5535 to open and the fluid flow is provided via the holes 5520. As shown in FIG. 56C, when the round brush attachment 5500 is moved in a first second the plates 5505 rotate counter-clockwise to allow the outlets 5535 to open and the fluid flow is provided via the slots 5525.

Figure 57:
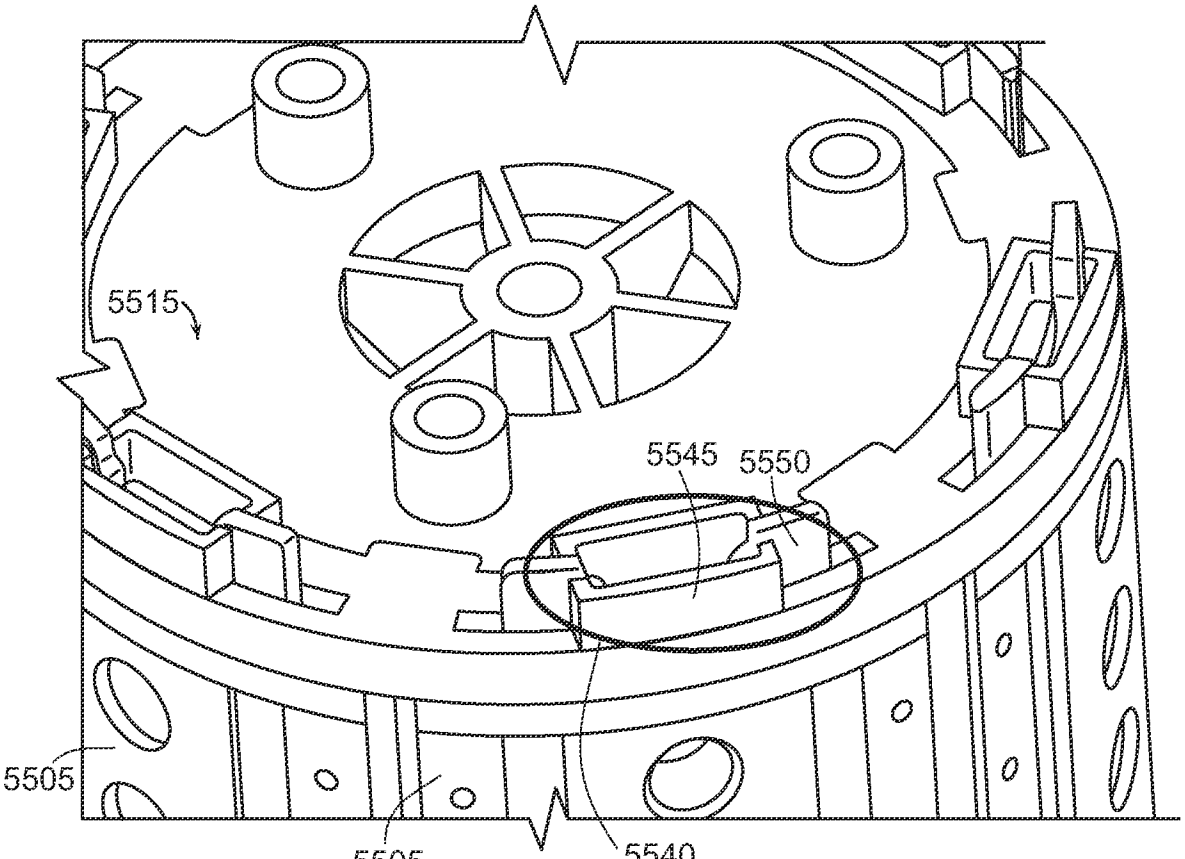
FIG. 57 is a top perspective top view of an alignment feature of the round brush attachment of FIG. 55.

As shown in FIG. 57, the base 5515 of the round brush attachment 5500 can include an alignment feature 5540 configured to limit circumferential rotation of the plates 5505. The alignment feature 5540 can include a retention frame 5545 configured to couple with end portions 5550 of the plate 5505 protruding through the base 5515 and into the retention frame 5545.

Figure 58:
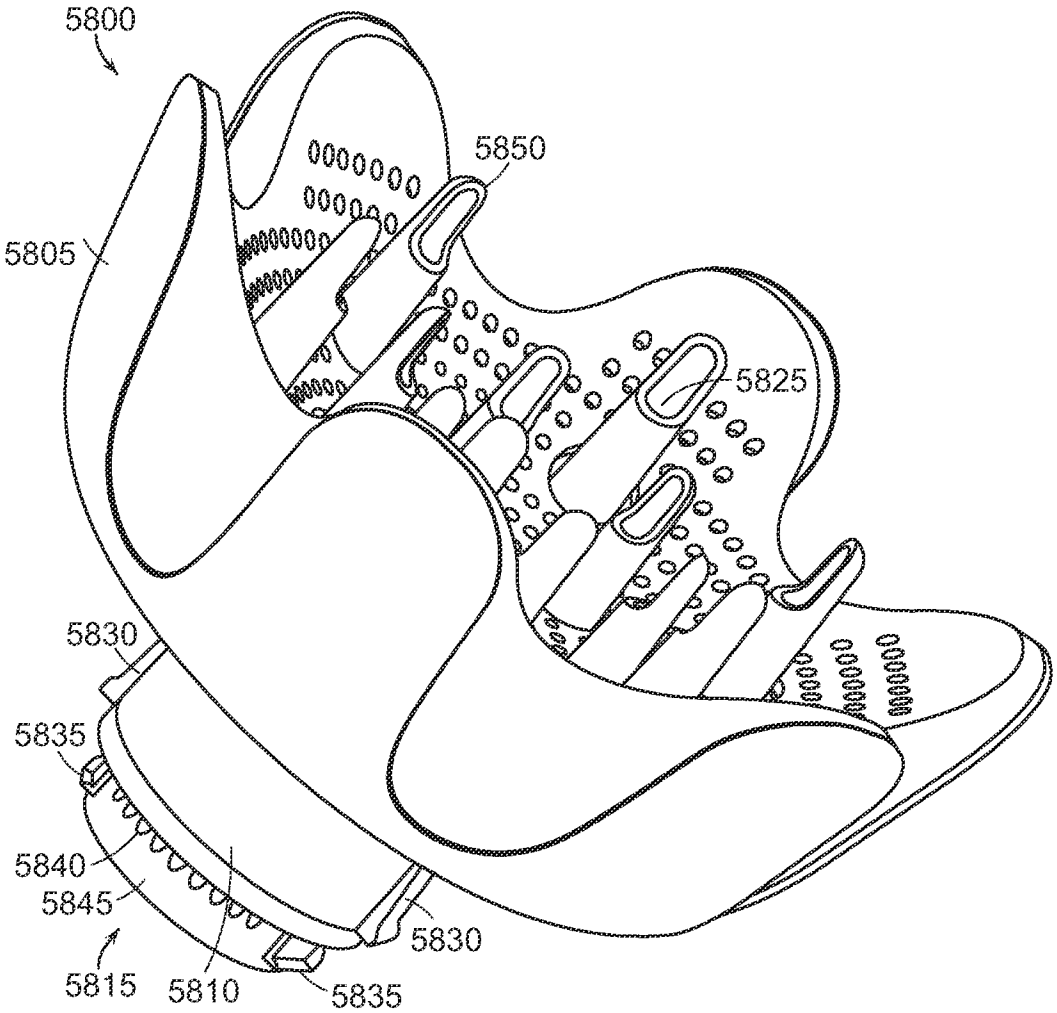
FIG. 58 is a side perspective view of an exemplary embodiment of a diffuser attachment configured for use with a hair care appliance.

FIG. 58 illustrates an embodiment of a diffuser 5800 that can include a body portion 5805 and a mating portion 5810. The body portion 5805 can be an outlet end of the diffuser 5800 at which a fluid flow received via the inlet opening 5815 of the mating portion 5810 can be provided for styling of hair. The body portion 5805 can include a plurality of projections 5820 extending away from an inner surface of the body portion 5820. One or more of the projections can include a hole 5825 for the fluid flow to exit the projection 5820.

The mating portion 5810 can include one or more release mechanisms 5830. The release mechanisms 5830 can release latching mechanisms 5835 from engagement with the engagement shelf 712 of the attachment mating assembly 700 described in relation to FIG. 35. Pressing the release mechanisms 5830 toward the center of the mating portion 5810 can cause the latching mechanisms 5835 to release from the engagement shelf 712. As further shown in FIG. 58, the mating portion can include a plurality of detents 5840 arranged on an inner collar 5845 of the mating portion 5810. The detents 5840 can be received within and engage with the recesses 704 of the attachment mating assembly 700 described in relation to FIG. 35. Once engaged, the detents 5840 can limit rotation of the diffuser 5800 relative to the body of the hair care appliance 100 described herein.

Figure 59:
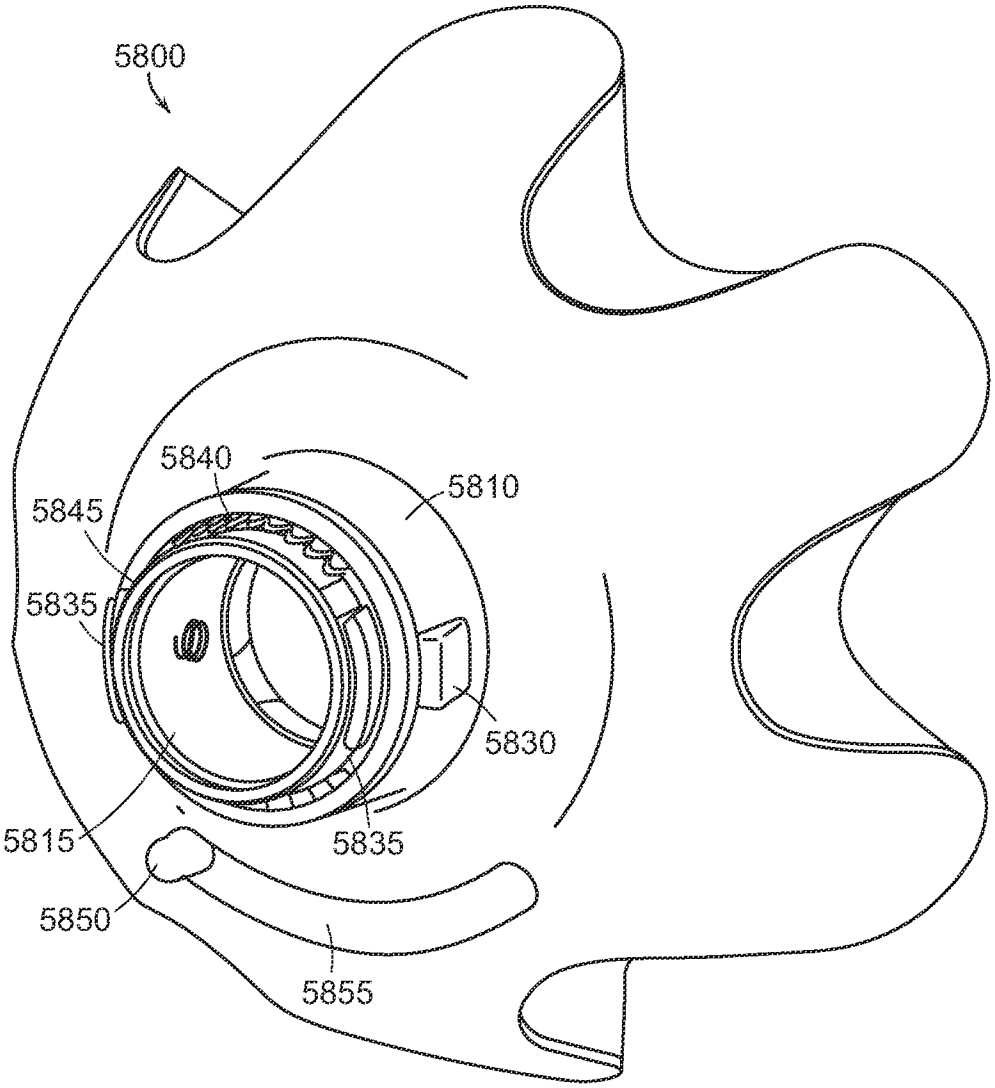
FIG. 59 is a bottom perspective view of the diffuser attachment of FIG. 58.

As shown in FIG. 59, the diffuser 5800 can include a flow adjustment 5850 configured to vary the fluid flow provided by the diffuser attachment 5800. A user can vary the fluid flow by adjusting the flow adjustment 5850 within the flow adjustment track 5855. The plurality of projections 5820 may move relative to the body portion, thereby increasing or decreasing the length of the plurality of projections 5820.

Figure 60:
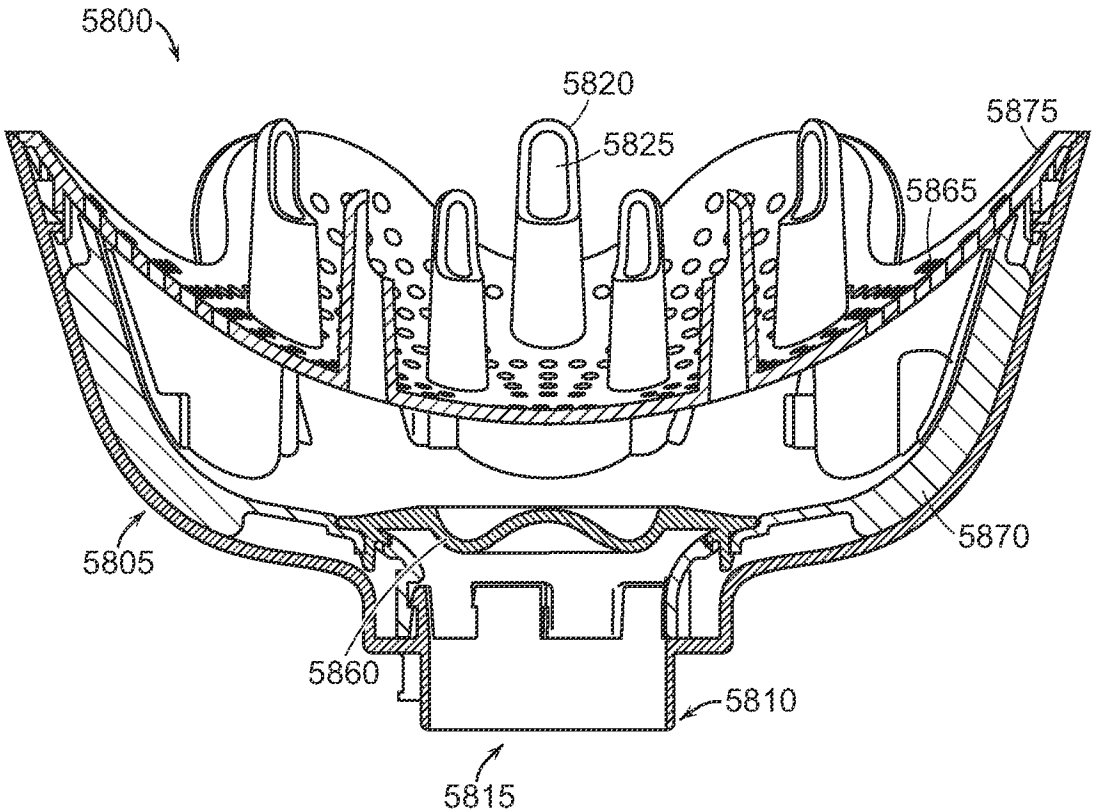
FIG. 60 is a cross-sectional view of the diffuser attachment of FIG. 58 showing a disc therein.
Figure 61:
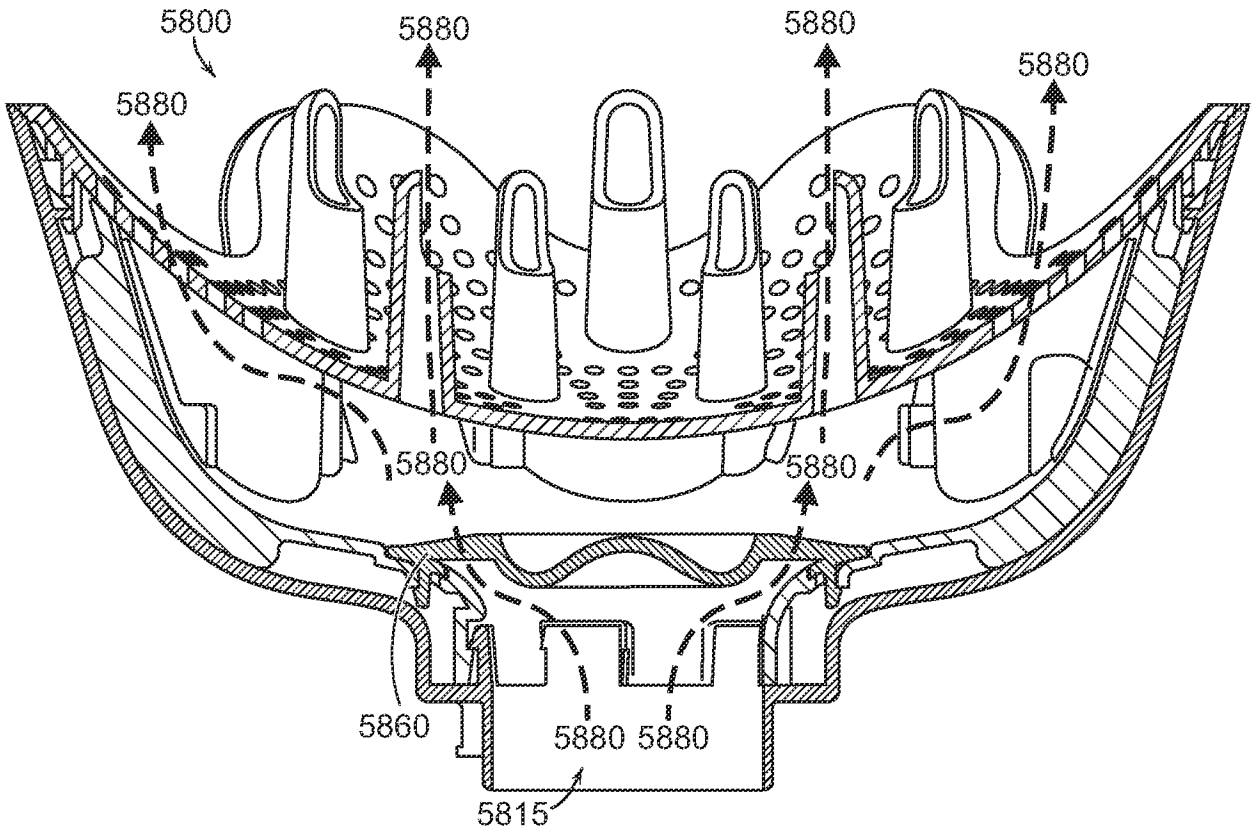

FIG. 60 shows a cross-sectional view of the diffuser attachment 5800. As shown, a disc 5860 can be profiled to have a particular shape configured to divert air toward the edges of the body portion 5805 of the diffuser 5800. In some embodiments, the disc 5860 is suspended from the central region of the body portion 5805. In this way, fluid flow is not directly provided into the central region of the body portion 5805 and is, instead, redirected toward the circumference of the body portion 5805 so that a more uniform fluid flow is provided via the projections 5820 and the holes 5825, 5865. The disc 5860 can be coupled to an inner frame 5870 via snap fit or friction fit. The inner frame 5870 can couple with the body portion 5805, the mating portion 5810, and a body portion cover 5875. The fluid flow path 5880 through the diffuser attachment 5800 can be seen in FIG. 61.

FIG. 62 illustrates an embodiment of a concentrator 6200 that can include a body portion 6205 and a mating portion 6210. A fluid flow path can be provided between an inlet 6215 of the mating portion 6210 and an outlet 6220 of the body portion 6205. The mating portion 6210 can include one or more attachment features 6225 which can project radially from a mating collar 6230 and can couple the concentrator 6200 with the attachment mating assembly 6300 shown in FIG. 35B. For example, the attachment features 6225 can be received in and secured within the slots 6114*a* and 6114*b*. The body portion 6205 may rotate relative to the mating portion 6210 such that the outlet position can be set by a user.

Figure 63:
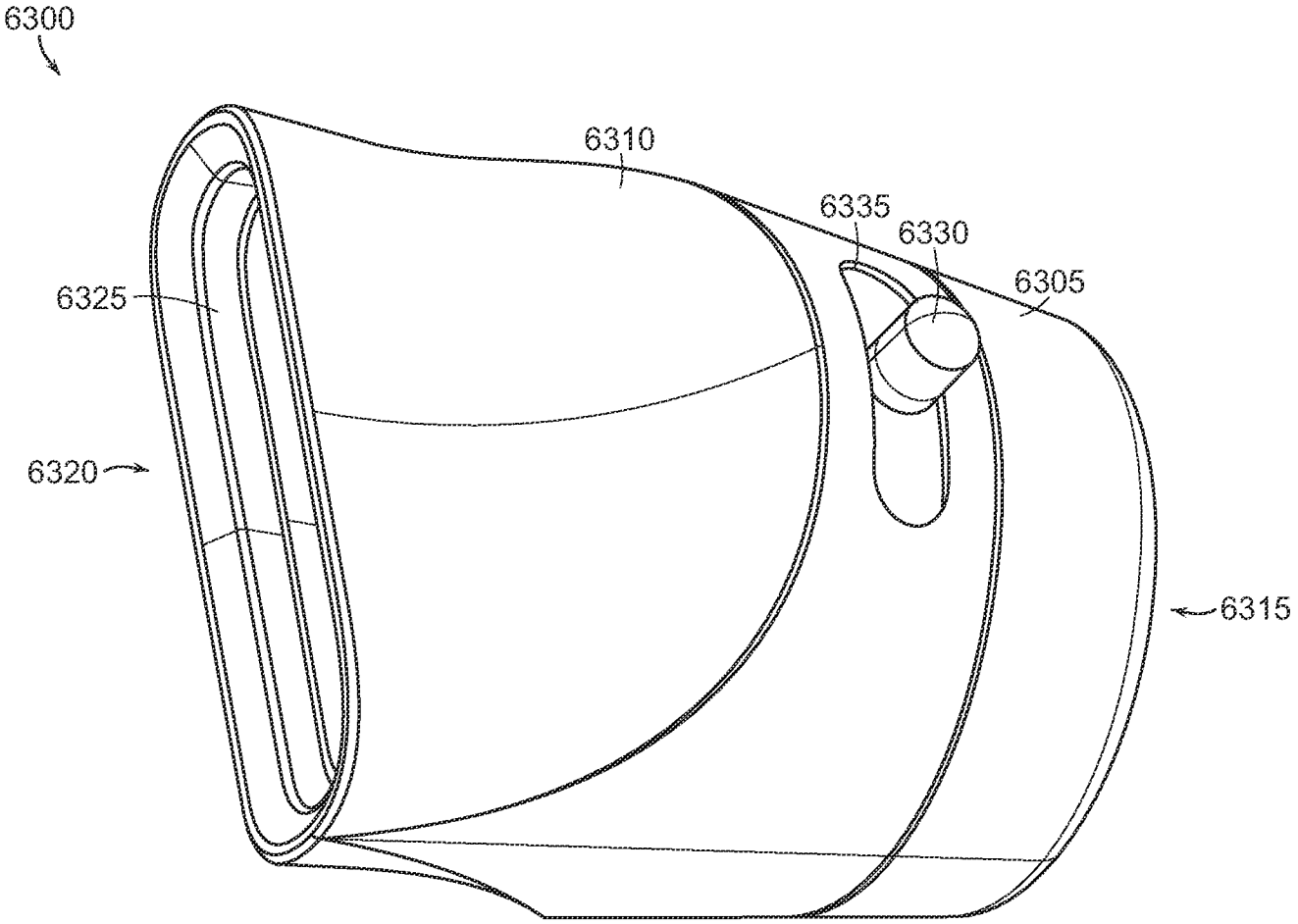
FIG. 63 is a stop side perspective view of another exemplary embodiment of a concentrator attachment configured for use with a hair care appliance.
Figure 64:
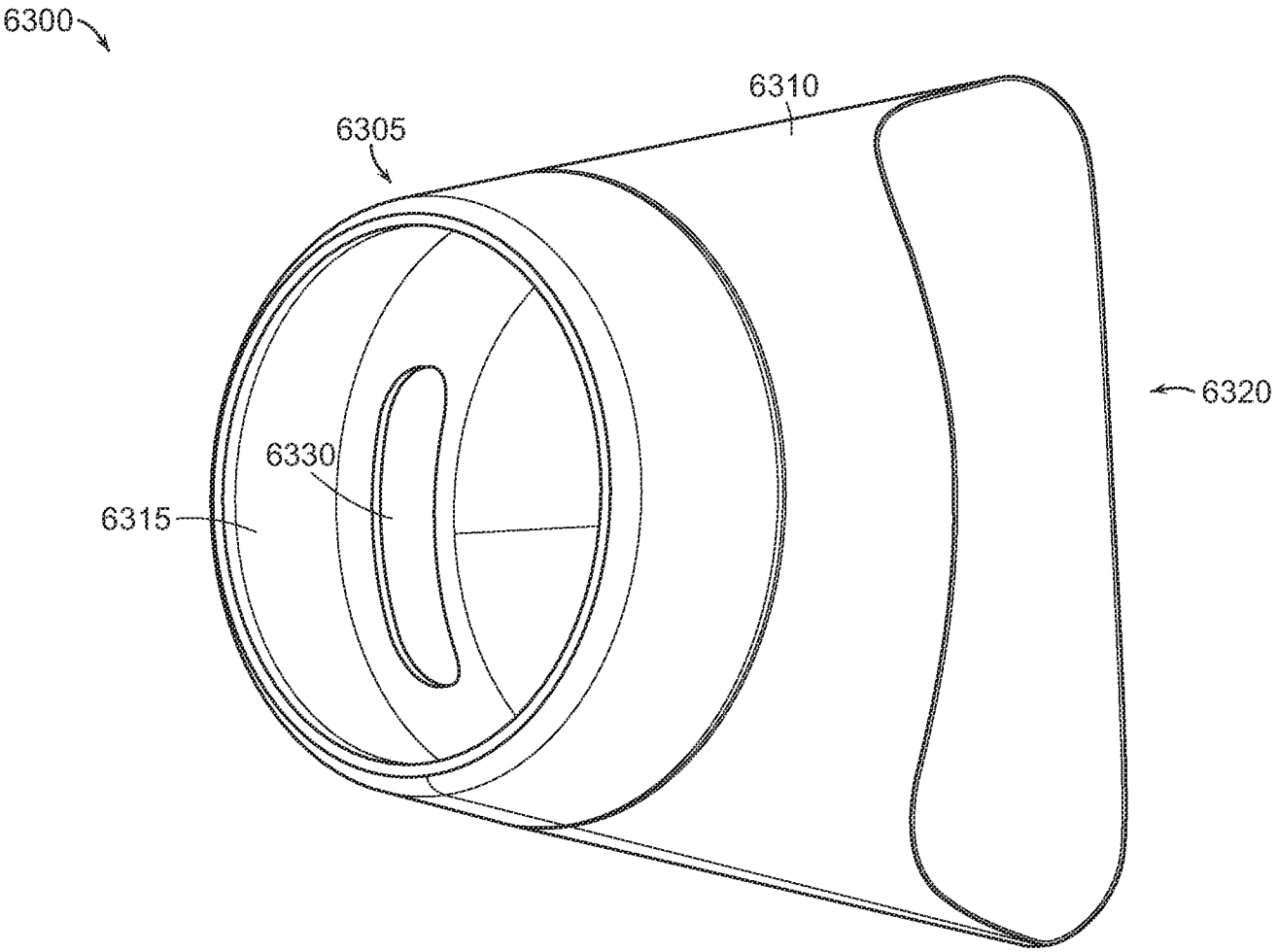
FIG. 64 is a bottom side perspective view of the concentrator attachment of FIG. 63.

FIG. 63 illustrates another embodiment of a concentrator 6300 that can include a mating portion 6305 and a body portion 6310. A fluid flow path can extend from an inlet end 6315 to an outlet end 6320. The fluid flow can be provided via the opening 6325. A variety of non-limiting shapes and dimensions of the opening 6325 can be envisioned. In this embodiment, the concentrator attachment 6300 can include a flow adjustment 6330 configured to vary the fluid flow provided by the concentrator attachment 6300. A user can vary the fluid flow by adjusting the flow adjustment 6330 within the flow adjustment track 6335. A bottom side perspective view of the concentrator attachment 6300 is shown in FIG. 64.

Figure 65:
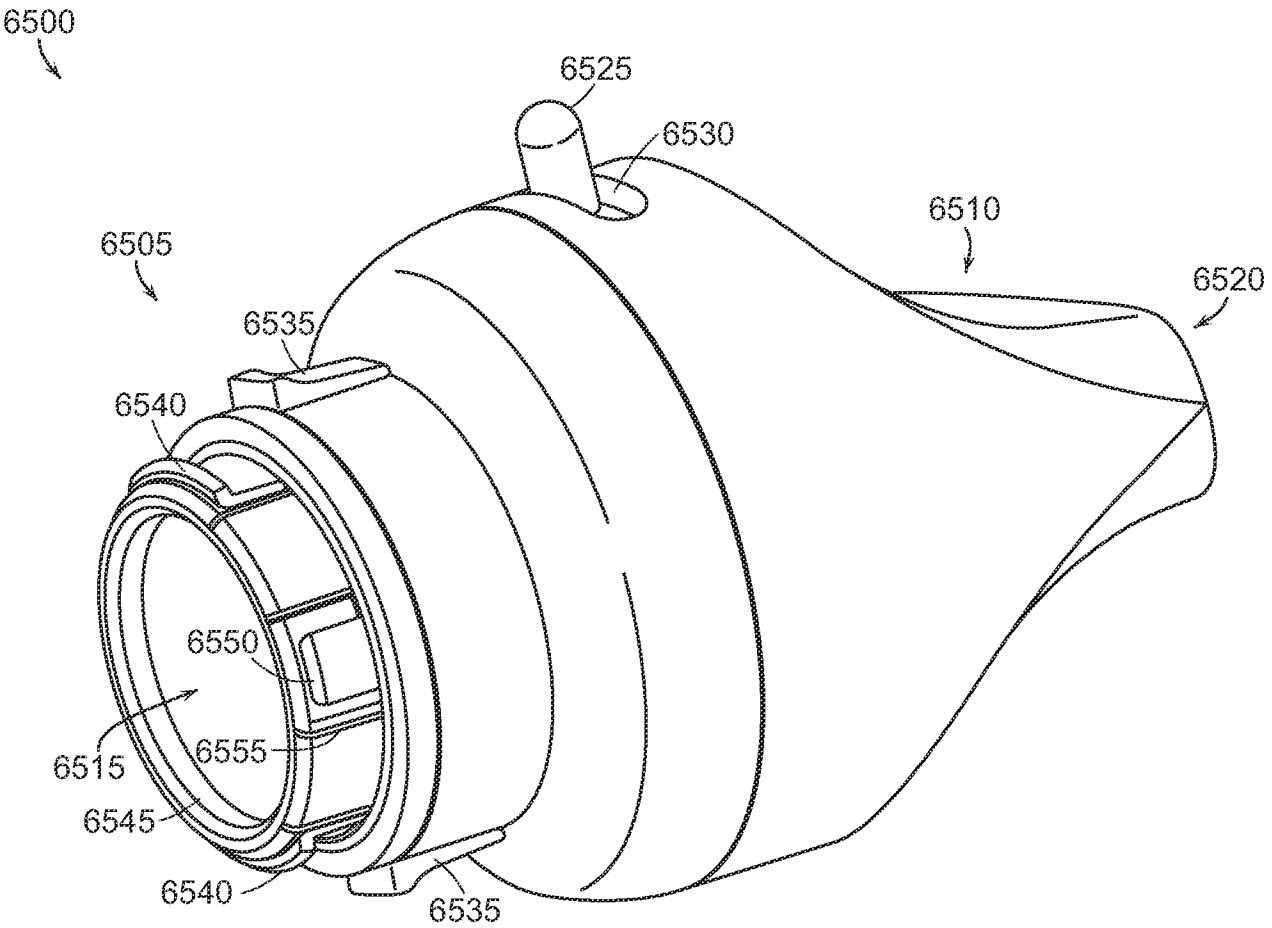
FIG. 65 is a side perspective view of another exemplary embodiment of a concentrator attachment configured for use with a hair care appliance.

As shown in FIG. 65, the concentrator attachment 6500 can include a mating portion 6505 and a body portion 6510. A fluid flow path can extend through the concentrator attachment 6500 from an inlet end 6515 to an outlet end 6520. A fluid flow can be provided via outlet end 6520. A variety of non-limiting shapes and dimensions of the outlet end 6520 can be envisioned. As further shown in FIG. 65, the concentrator attachment 6500 can include a flow adjustment 6525 configured to vary the fluid flow provided by the concentrator attachment 6500. A user can vary the fluid flow by adjusting the flow adjustment 6525 within the flow adjustment track 6530.

The mating portion 6505 can include one or more release mechanisms 6535 configured to release latching mechanism 6540 from the engagement shelf 712 of the attachment mating assembly 700 included in the hair care appliance described herein and illustrated in FIGS. 35-37. The mating portion 6505 can also include a mating collar 6545 that can be inserted into the attachment mating assembly 700. The mating collar 6545 can include one or more tab features 6550 which can engage with the engagement shelf 712 and/or slots that can be configured formed within the engagement shelf 712. The mating collar 6545 can also include one or more ribs 6550 configured to engage with slotted portions of the engagement shelf 712. The tab features 6545 and the ribs 6550 can limit or reduce rotation of the concentrator attachment 6500 relative to the body of the hair care appliance 100 described herein.

Figure 66:
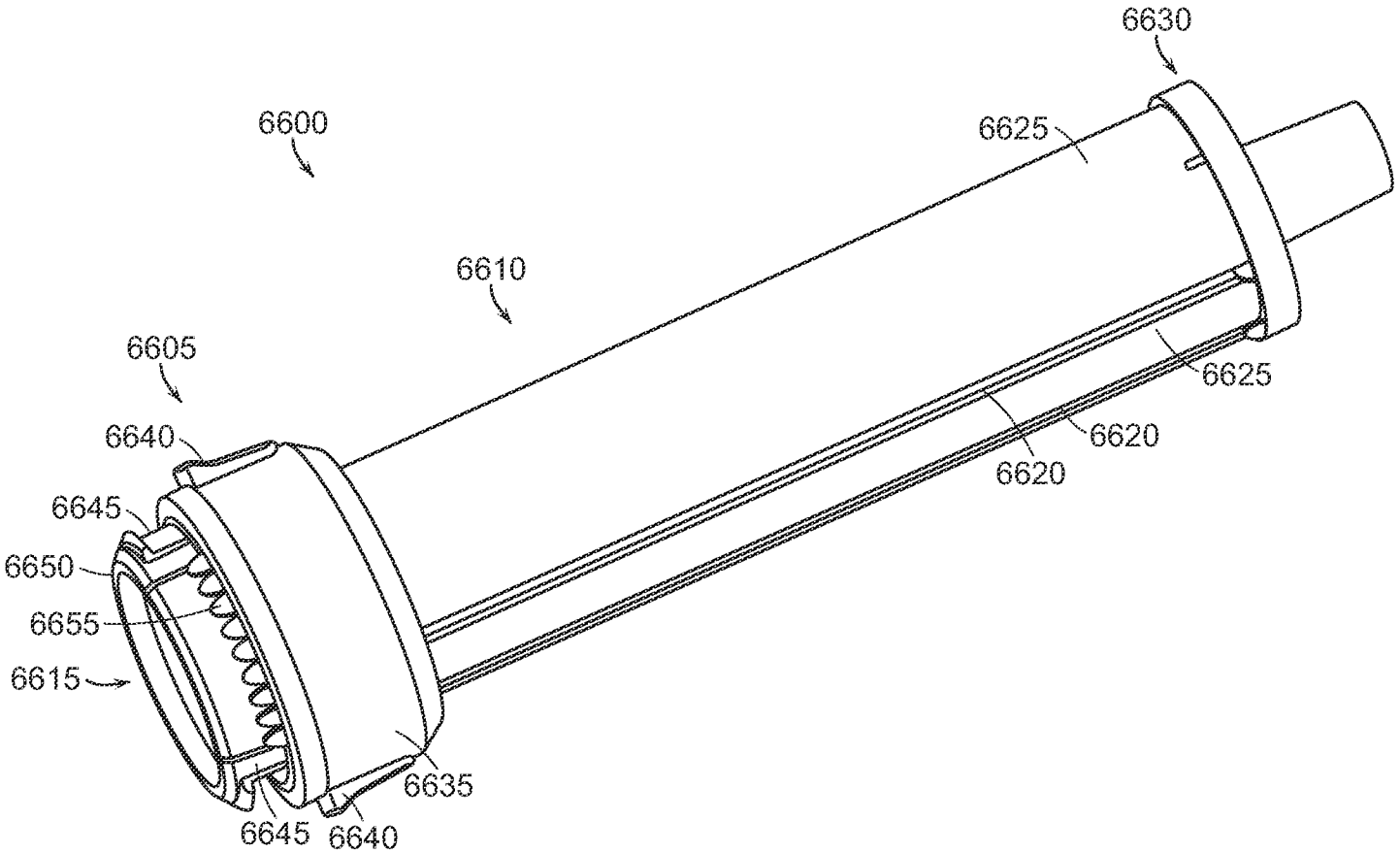
FIG. 66 is a perspective view of another exemplary embodiment of a curling attachment configured for use with a hair care appliance.

FIG. 66 illustrates an embodiment of a curling attachment 6600 that can include a mating portion 6605 and a body portion 6610. An inlet 6615 can be provided in the mating portion 6605. A fluid flow path can be provided between the inlet 6615 and outlets 6620. The outlets 6620 can be provided between plates 6625 extending along the central longitudinal axis of the curling attachment 6600. The plates 6625 can be secured between an end cap 6630 and a mating housing 6635. The plates 6625 can be configured to rotate clockwise and counter-clockwise relative to the central longitudinal axis of the curling attachment 6600 so that hair can be curled in multiple directions.

As further shown in FIG. 66, the curling attachment 6600 can include one or more release mechanisms 6640 arranged in the mating housing 6635. The release mechanisms 6640 can release the latching mechanisms 6645 from the engagement shelf 712 of the attachment mating assembly described in relation to FIGS. 35-37. Pressing the release mechanisms 6640 toward the mating housing 6635 will cause the latching mechanisms 6645 to release from the engagement shelf 712. As further shown in the FIG. 66, the mating portion 6605 can include a mating collar 6650. The mating collar 6650 can include a plurality of protrusions or detents 6655 which can engage with the recesses 704 of the attachment mating assembly described in relation to FIGS. 35-37. The engagement of the detents 6655 with the recesses 704 can limit or reduce rotation of the curling attachment 6600 relative to the body of the hair care appliance 100 described herein.

Figure 67:
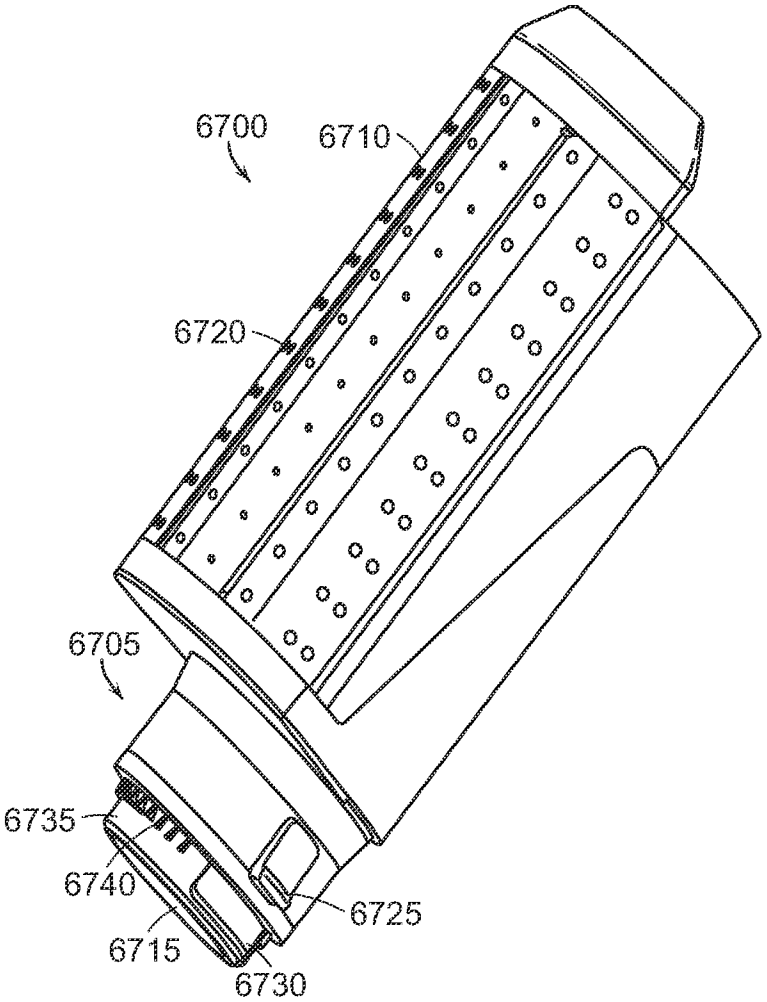
FIG. 67 is a side perspective view of an exemplary embodiment of a paddle brush attachment configured for use with a hair care appliance.

FIG. 67 shows one exemplary embodiment of a paddle brush attachment 6700 configured for use with the hair care appliance 100. As shown in FIG. 67, the paddle brush attachment 6700 can include a mating portion 6705 and a body portion 6710. A fluid flow path can extend through the paddle brush attachment 6700 from an inlet 6715 and out the holes 6720 in the body portion 6710. In some embodiments, one or more of the holes 6720 can include brush bristles. A non-limiting arrangement of holes 6720 and brush bristles can be envisioned on the body portion 6710. In some embodiments, the holes 6720 and brush bristles can be positioned on a single plane. In other embodiments, the holes 6720 and brush bristles may wrap around the face of the paddle brush attachment 6700.

As further shown in FIG. 67, the mating portion 6705 can include one or more release mechanisms 6725. The release mechanisms 6725 can release the latching mechanisms 6730 from the engagement shelf 712 of the attachment mating assembly described in relation to FIGS. 35-37. Pressing the release mechanisms 6725 toward a central longitudinal axis extending through the paddle brush attachment 6700 will cause the latching mechanisms 6730 to release from the engagement shelf 712. As further shown in the FIG. 67, the mating portion 6705 can include a mating collar 6735. The mating collar 6735 can include a plurality of protrusions or detents 6740 which can engage with the recesses 704 of the attachment mating assembly described in relation to FIGS. 35-37. The engagement of the detents 6740 with the recesses 704 can limit or reduce rotation of the paddle brush attachment 6700 relative to the body of the hair care appliance 100 described herein.

Figure 78:
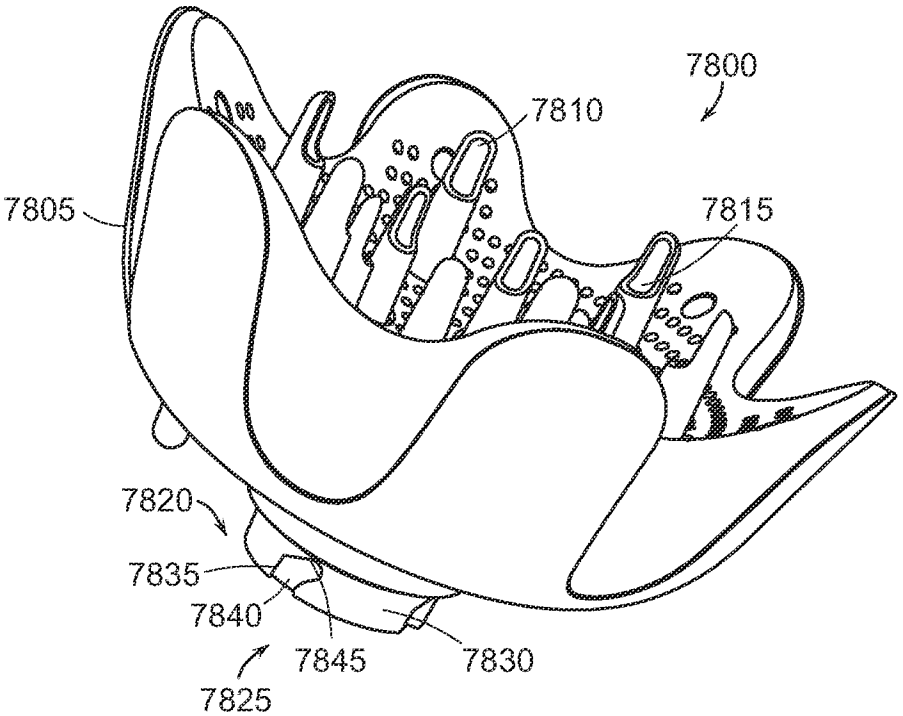
FIG. 78 is a top perspective view of another exemplary embodiment of a diffuser attachment configured for use with the attachment mating assembly of FIG. 72.

FIG. 78 illustrates an embodiment of a diffuser 7800 configured for use with the attachment mating assembly 7200 of FIG. 72. The illustrated diffuser 7800 includes a body portion 7805 and a mating portion 7820. The mating portion 7280 can correspond to the attachment mating portion 7600 described in relation to FIGS. 76A-76B. The body portion 7805 can be an outlet end of the diffuser 7800 at which a fluid flow received through opening 7825 of the mating portion 7820 can be provided for hair styling. The body portion 7805 can include a plurality of projections 7810 extending away from an inner surface of the body portion 7805. One or more of the projections 7810 can include a hole 7815 for the fluid flow to exit the projection 7810.

The mating portion 7820 can include a mating collar 7830 configured with one or more slots 7835. The slots 7835 can correspond to the slots 7610 described in relation to the attachment mating portion 7600 shown and described in FIGS. 76A-76B. The slots 7835 can include an opening 7840 and a receiving end 7845. The protrusions 7210 of the attachment mating assembly 7200 can be inserted into the openings 7840 of the slots 7835 and can travel to the receiving end 7845 as the user rotates the attachment onto the outlet end 122 of the body housing 124. When the protrusions 7210 have reached the receiving end 7845, the user can release the latch 7220 causing the tab 7280 to travel toward the outlet end 122 and to become positioned within the opening 7840 and the slot 7835. In this way, the tab 7820 can fill a portion of the slot 7835 such that the protrusion 7210 is blocked from rotating away from or out of the receiving end 7845. As a result, the attachment can be secured to the body housing 124 and rotation of the attachment relative to the body housing is significantly reduced or eliminated. Retracting the latch 7220 can cause the tab 7280 to travel out of the slot 7835 and as the user rotates the attachment for removal from the body housing 124, the protrusions 7210 can travel from the receiving end 7845 to the opening 7840 uncoupling the attachment from the body housing 124 of the hair care appliance 100. The attachment mating portion 7220 can be configured on any of the attachments described herein and is specifically shown in regard to embodiments of attachments shown in FIGS. 78-84B.

Figure 79:
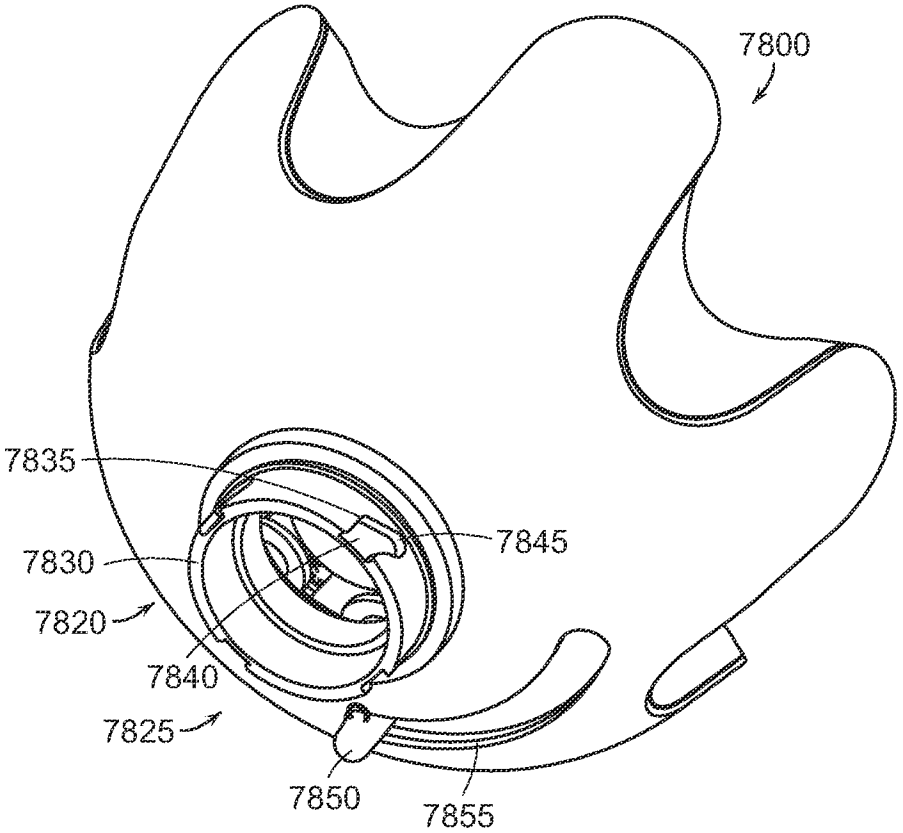
FIG. 79 is a bottom perspective view of the diffuser attachment of FIG. 78.

The diffuser 7800 can also include a flow adjustment 7850 configured to vary the fluid flow provided by the diffuser attachment 7800 as shown in FIG. 79. A user can vary the fluid flow by adjusting the flow adjustment 7850 within the flow adjustment track 7855.

Figure 80:
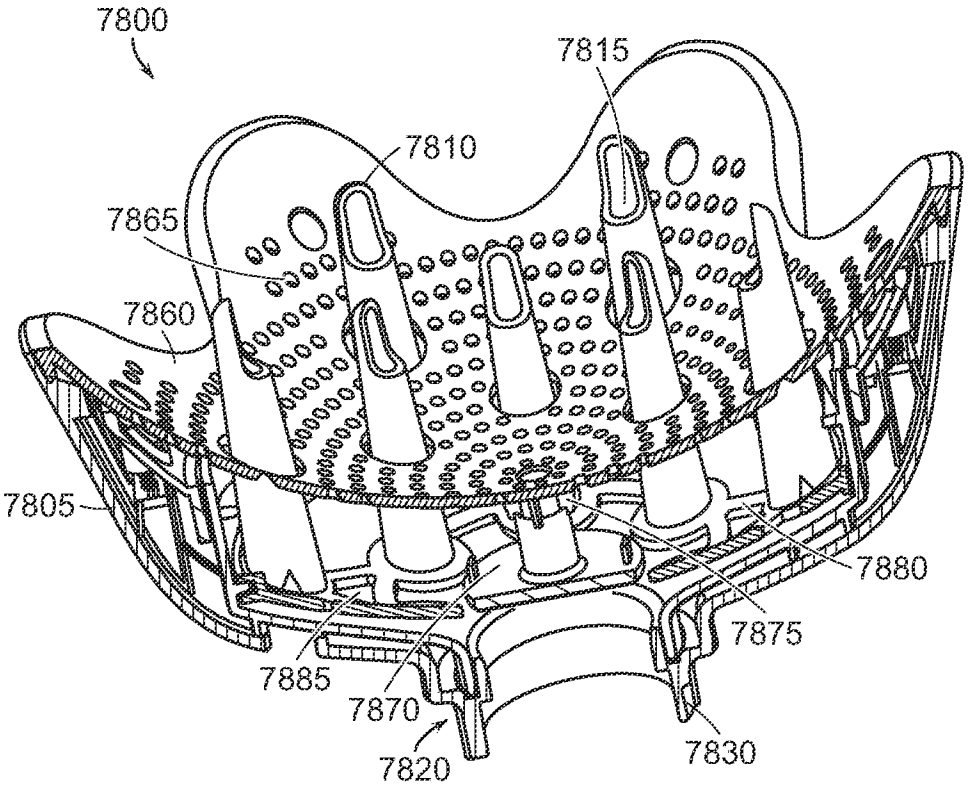
FIG. 80 is a cross-sectional top perspective view of the diffuser attachment of FIG. 78
Figure 81:
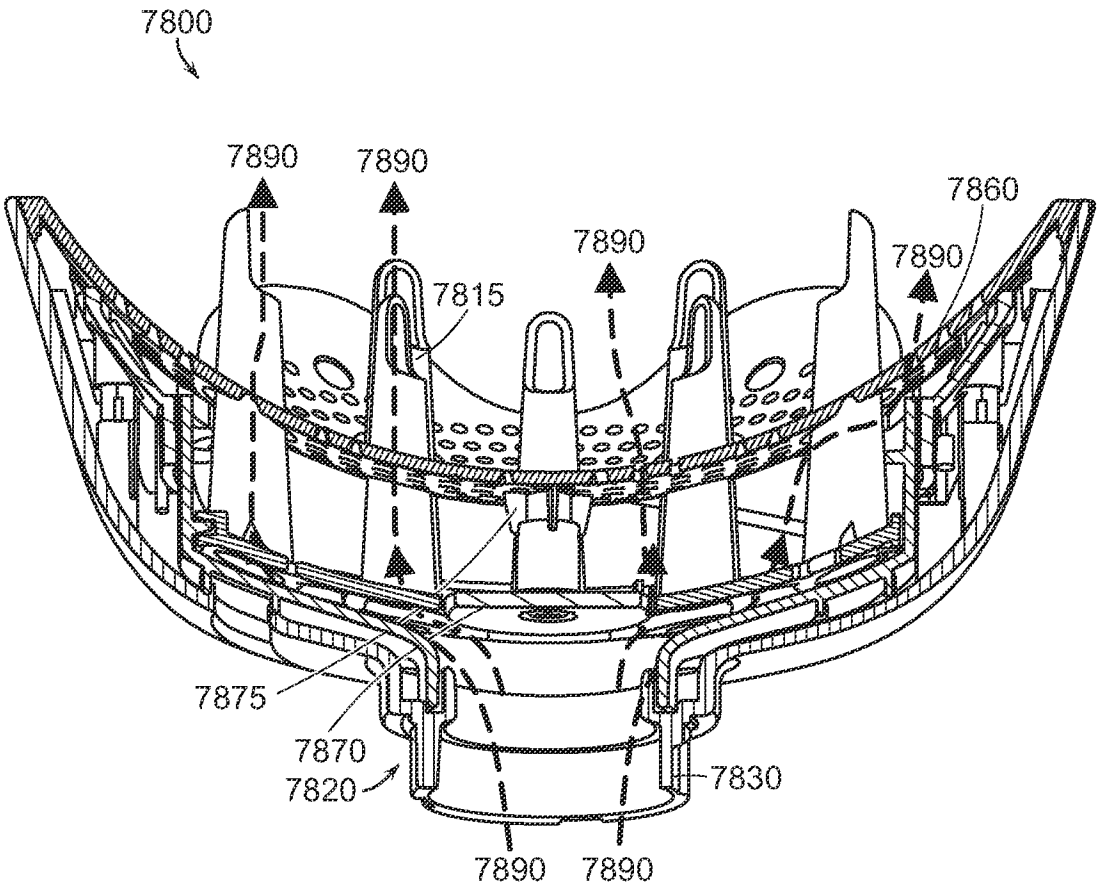
FIG. 81 is a cross-sectional view of the diffuser attachment of FIG. 78.

FIG. 80 shows a cross-sectional view of the diffuser attachment 7800. As shown, a baffle 7870 can be configured to divert air toward the edges of the body portion 7805 of the diffuser 7800. In some embodiments, the baffle 7870 can be disc shaped. In some embodiments, the baffle 7870 is suspended from the central region of the body portion 7805. In this way, fluid flow is not directly provided into the central region of the body portion 7805 and is, instead, redirected toward the circumference of the body portion 7805 so that a more uniform fluid flow is provided via the projections 7810 and the holes 7815, 7865. The baffle 7870 can be coupled to an extension element 7875 protruding from the lower surface of the body surface cover 7865. In this way, the baffle 7870 can be suspended from the lower surface of the body surface cover 7865. In some embodiments, the baffle 7870 can include holes therein as inlets or outlets for the air flow. In some embodiments, the baffle 7870 may not include any holes therein. The projections 7810 can be coupled via a frame 7880 provided within the body portion 7805. The frame 7880 can be formed as a lattice or matrix structure with openings 7885 therein for the fluid flow path to travel through the frame 7880. The fluid flow path 7890 through the diffuser attachment 7800 can be seen in FIG. 81.

Figure 82B:
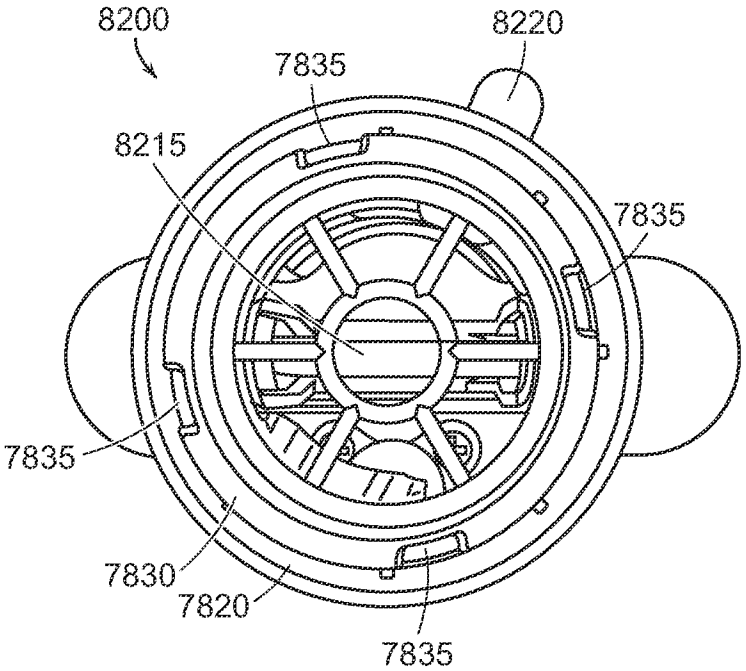
FIG. 82B is a bottom view of the concentrator attachment of FIG. 82A.
Figure 82A:
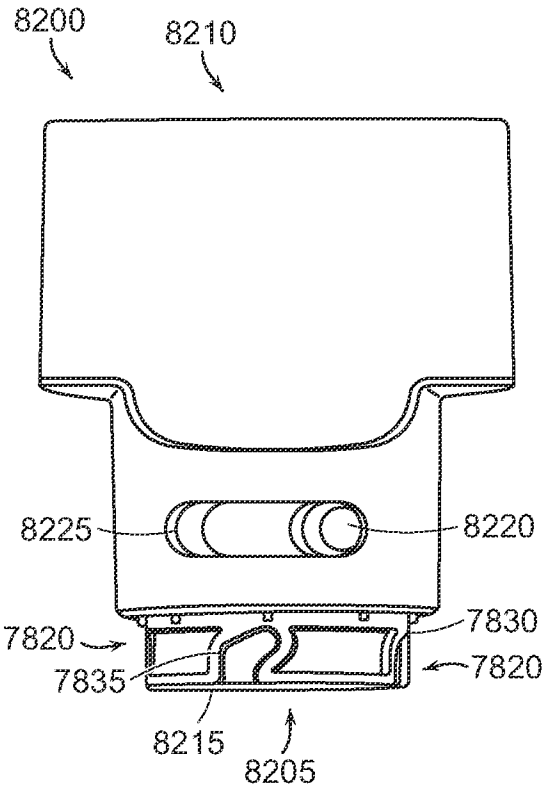
FIG. 82A is a side view of another exemplary embodiment of a concentrator attachment configured for use with a hair care appliance including the attachment mating assembly of FIG. 72.
Figure 82C:
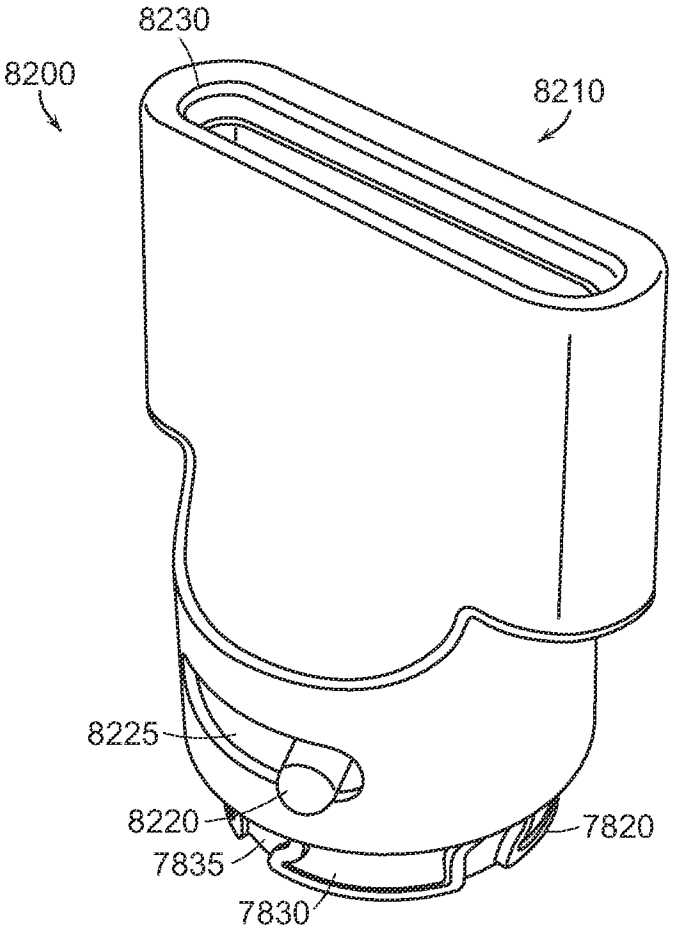
FIG. 82C is a side perspective view of the concentrator attachment of FIG. 82A.

FIG. 82A shows another exemplary embodiment of a concentrator attachment configured for use with a hair care appliance 100 including the attachment mating assembly 7200 of FIG. 72. A fluid flow path can extend from an inlet end 8205 to an outlet end 8210. The fluid flow can be provided via the opening 8210. A variety of non-limiting shapes and dimensions of the opening 8210 can be envisioned. In this embodiment, the concentrator attachment 8200 can include a flow adjustment 8220 configured to vary the fluid flow provided by the concentrator attachment 8200. A user can vary the fluid flow by adjusting the flow adjustment 8220 within the flow adjustment track 8225. A bottom perspective view of the concentrator attachment 8200 is shown in FIG. 82B. A side perspective view of the concentrator attachment 8200 is shown in FIG. 82C. As shown in FIG. 82C, the outlet end 8210 can include an opening 8230. A variety of non-limiting shapes and dimensions of the opening 8230 can be envisioned.

Figure 83B:
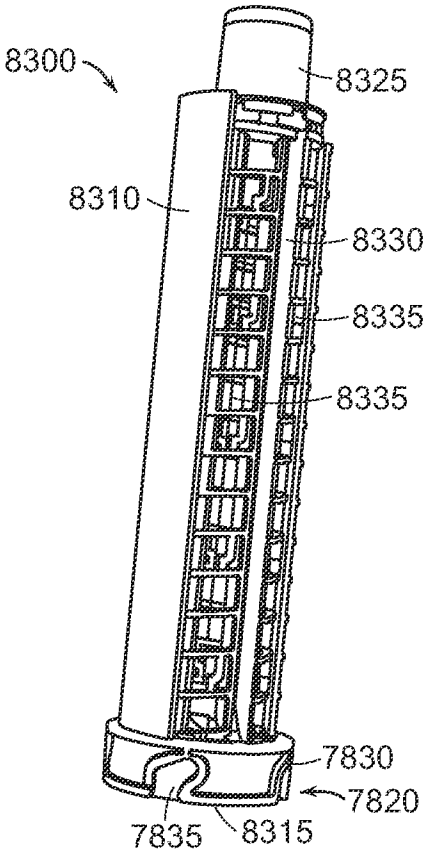
FIG. 83B is a cross-sectional view of the curling attachment of FIG. 83A.
Figure 83A:
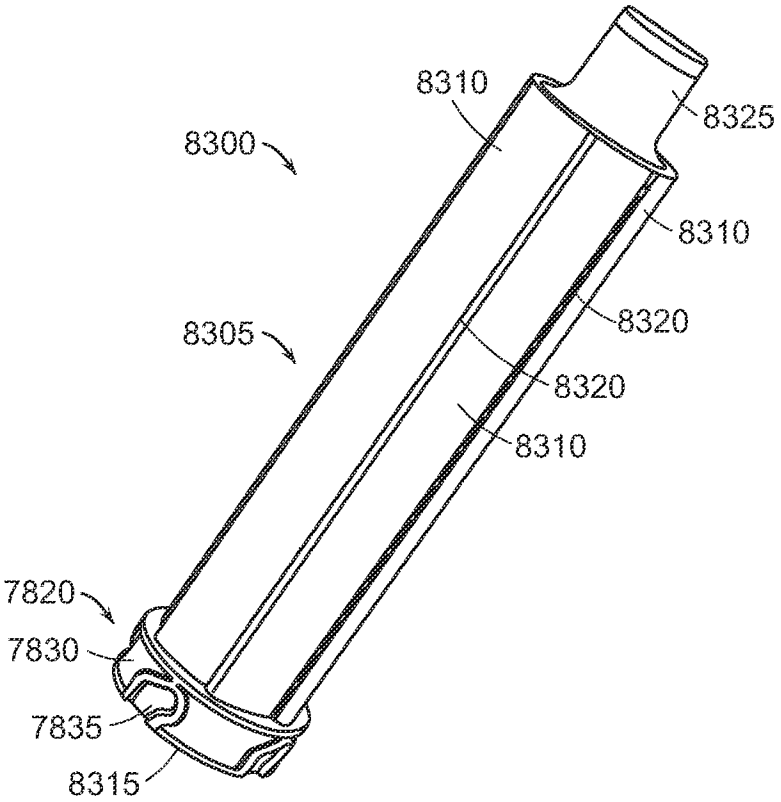
FIG. 83A is a perspective view of another exemplary embodiment of a curling attachment configured for use with a hair care appliance including the attachment mating assembly of FIG. 72.

FIG. 83A shows another exemplary embodiment of a curling attachment 8300 configured for use with a hair care appliance 100 including the attachment mating assembly 7200 shown and described in relation to FIG. 72. The curling attachment 8300 can include a mating portion 7820 and a body portion 8305. An inlet 8315 can be provided in the mating portion 7820. A fluid flow path can be provided between the inlet 8315 and outlets 8320. The outlets 8320 can be provided between plates 8310 extending along the central longitudinal axis of the curling attachment 8300. The plates 8310 can be secured between an end cap 8325 and the mating portion 7820. The plates 8310 can be configured to rotate clockwise and counter-clockwise relative to the central longitudinal axis of the curling attachment 8300 so that hair can be curled in multiple directions.

As shown in FIG. 83B, some of plates 8310 have been removed to illustrate an internal frame 8330 of the curling attachment 8300. The frame 8330 can include a plurality of outlets 8335 formed between frame elements of the frame 8330. The fluid flow path can be received via the inlet 8315, pass inside of the frame 8330, through the openings 8335 and out of the curling attachment 8300 via the outlets 8320. A variety of non-limiting shapes and dimensions of the frame 8330 and the openings 8335 formed by the frame elements can be envisioned.

Figure 84B:
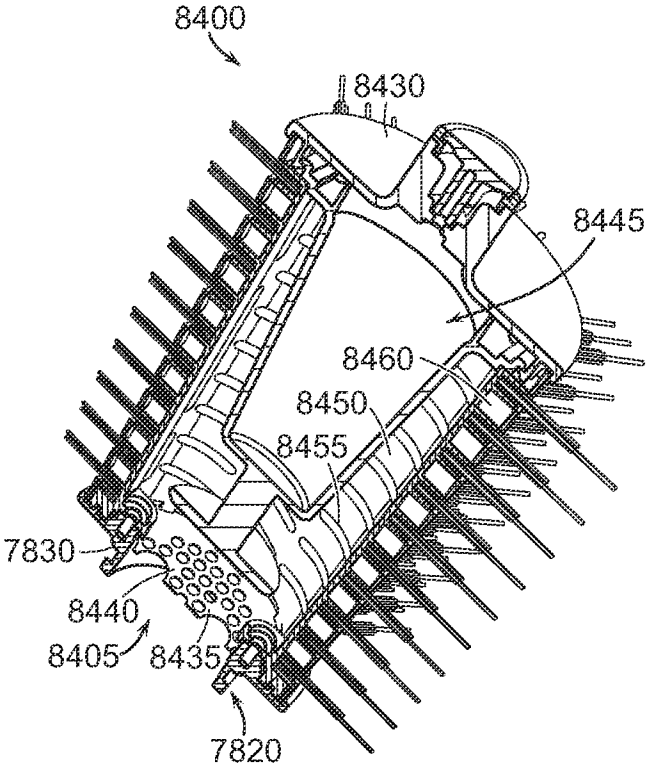
FIG. 84B is a cross-sectional perspective view of the round brush attachment of FIG. 84A.
Figure 84A:
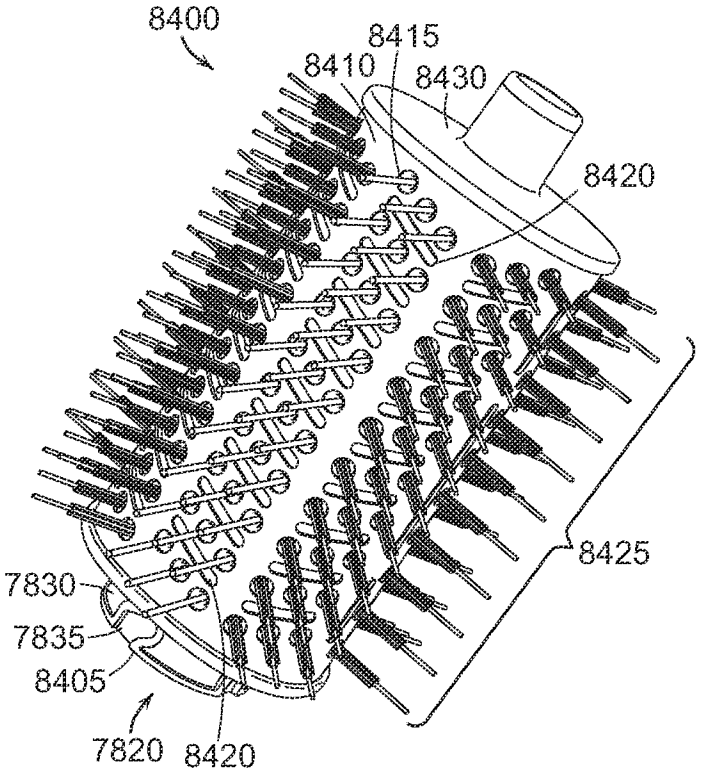
FIG. 84A is a perspective view of another exemplary embodiment of a round brush attachment configured for use with a hair care appliance including the attachment mating assembly of FIG. 72.

FIG. 84A shows another exemplary embodiment of a round brush attachment 8400 configured for use with a hair care appliance 100 including the attachment mating assembly 7200 shown and described in relation to FIG. 72. The round brush attachment 8400 can receive a fluid flow via the inlet 8405 from the hair care appliance 100. The round brush attachment 8400 can include a cover 8410 with a plurality of outlets, such as holes 8415 and slots 8420, formed in the cover 8410 through which the fluid flow can pass. The round brush attachment 8400 can include bristles 8425 protruding through the holes 8415. In some embodiments, one or more bristles 8425 can protrude through a hole 8415. The cover 8410 can be positioned between an end cap 8430 and the mating portion 7820.

The fluid flow received via the inlet 8405 can be diffused via a diffuser plate 8435 in including holes 8440 as shown in FIG. 84B illustrating a cross-sectional perspective view of the round brush attachment 8400 of FIG. 84A. A non-limiting variety of shapes, dimensions, and patterns of the holes 8440 can be envisioned. The inner body 8450 can include slots 8455 in a non-limiting variety of shapes, dimensions, and patterns. The fluid flow can be advantageously directed to the holes 8415 and slots 8420, 8455 via a baffle 8445. The baffle 8445 can be positioned within an inner body 8450 and can be coupled to or integrated with the end cap 8430. The inner body 8450 can be coupled to the mating portion 7820 and to the end cap 8430. A gap 8455 can be formed between an exterior surface of the inner body 8450 and an inner surface of the cover 8410. The gap 8455 can be dimensioned to advantageously provide the fluid flow through the holes 8415 and the slots 8420. In some embodiments, the baffle 8445 is a hollow structure that does not include an inlet or an outlet. In some embodiments, the baffle 8445 can be a solid structure that does not include an inlet or an outlet. In some embodiments, the baffle 8445 can be a hollow structure or a solid structure and can include at least one inlet and at least one outlet.

Figure 85B:
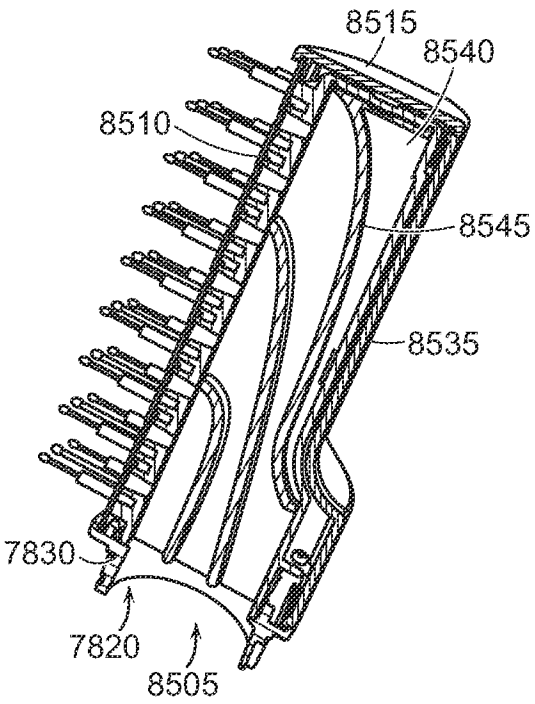
FIG. 85B is a cross-sectional perspective view of the paddle brush attachment of FIG. 84A.
Figure 85A:
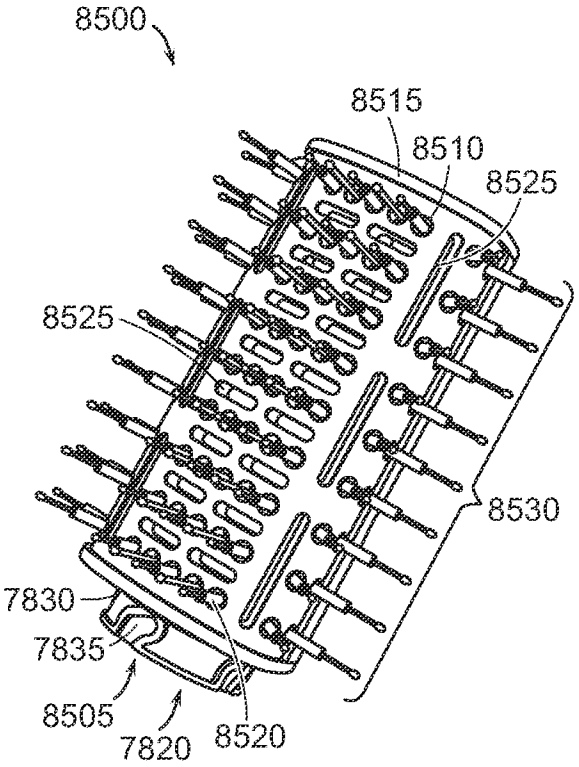
FIG. 85A is a perspective view of another exemplary embodiment of a paddle brush attachment configured for use with a hair care appliance including the attachment mating assembly of FIG. 72.

FIG. 85A shows another exemplary embodiment of a paddle brush attachment 8500 configured for use with a hair care appliance 100 including the attachment mating assembly 7200 of FIG. 72. The paddle brush attachment 8500 can include the mating portion 7820 and an inlet 8505. A cover 8510 can be coupled between the mating portion 7820 and an end cap 8515. The cover 8510 can include holes 8520 and slots 8525 configured as outlets of the paddle brush attachment 8500. A variety of non-limiting shapes, dimensions, and patterns of holes 8520 and slots 8525 can be envisioned. A plurality of bristles 8530 can extend through the cover 8510 via the holes 8520. A fluid flow path can extend through the paddle brush attachment 8500 from the inlet 8505 and out the holes 8520 and the slots 8525. In some embodiments, the holes 8520 and brush bristles 8530 can be positioned on a single plane. In other embodiments, the holes 8520 and brush bristles 8530 may wrap around the face of the paddle brush attachment 8500.

Figure 86:
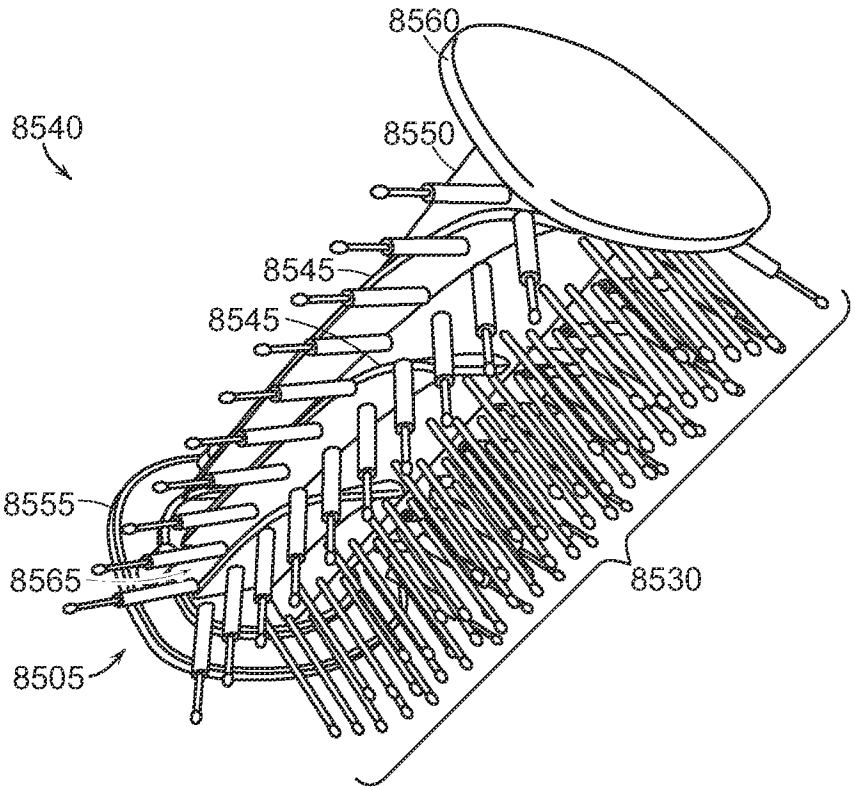
FIG. 86 is a perspective view of an exemplary embodiment of an air dividing structure of the paddle brush of FIG. 85A.

The fluid flow path through the paddle brush attachment 8500 can be directed toward the face and sides of paddle brush attachment by a diverter 8540 shown in FIG. 85B illustrating a cross-sectional perspective view of the paddle brush attachment 8500. The diverter 8540 can be positioned within the paddle brush attachment between the cover 8510 and a housing 8535. The diverter 8540 can include a plurality of curved vanes 8545 to direct the fluid flow within the paddle brush attachment 8500. As shown in FIG. 86, the diverter 8540 can include a frame 8550 extending between a base 8555 and a head 8560. The base 8555 can include an opening 8565 in correspondence with the inlet 8505. A variety of non-limiting shapes, numbers, and dimensions of the frame 8550 and the vanes 8545 can be envisioned to advantageously divert the fluid flow received at the opening 8555 along the frame 8550 and toward the holes 8520 and slots 8525 in the cover 8510.

The attachment mating mechanisms and assemblies of the improved hair care appliance described herein produce a number of advantages. For example, the attachment can be secured to the hair care appliance using a dual-mating technique. Firstly, attachment mating mechanisms at the outlet of the body housing (e.g., the hook-shaped features formed as segmented concentric rings or protrusions of the mating collar) can interface with mating mechanisms of an attachment (e.g., longitudinally oriented ridges or slots) to couple to and reduce rotation of the attachment and the body. An attachment actuator assembly can eliminate rotation of the attachment relative to the body housing by actuating to insert a tab into a slot a slot of the mating portion of the attachment. Secondly, an attachment can be configured to extend over the outlet in a sleeved configuration. Additionally, the sleeve can enable a more compact design of the hair care appliance when an attachment is secured to the outlet and can enhance the user experience as a result of the compact design.

Certain exemplary embodiments have been described to provide an overall understanding of the principles of the structure, function, manufacture, and use of the systems, devices, and methods disclosed herein. One or more examples of these embodiments have been illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described embodiments. Accordingly, the present application is not to be limited by what has been particularly shown and described, except as indicated by the appended claims. All publications and references cited herein are expressly incorporated by reference in their entirety.

What is claimed is:

1. A hair care appliance, comprising:

a handle and a body coupled to one another at a hinge joint such that the body is movable relative to the handle between a straight configuration in which the body is aligned with a longitudinal axis of the handle, and a bent configuration in which the body extends along an axis that is transverse to the longitudinal axis of the handle, the hinge joint including a retainer separate from and snap-fit on an end of the handle, a handle hinge plate separate from the handle and the retainer, the handle hinge plate snap-fit on the end of the handle, and a body hinge plate separate from the body and the retainer, the body hinge plate snap-fit on an end of the body and juxtaposed adjacent to the handle hinge plate, the body hinge plate and the handle hinge plate rotatable around the retainer having an opening extending through a center thereof and defining an airflow path between the handle and the body.

2. The hair care appliance of claim 1, further comprising a fan assembly disposed within the handle and configured to draw air in through an inlet in the handle and to direct air into the body through the central opening in the handle hinge plate and the body hinge plate.

3. The hair care appliance of claim 1, further comprising a heater assembly disposed within the body.

4. The hair care appliance of claim 3, wherein the heater assembly includes wiring arranged at a periphery of the central opening extending through the handle hinge plate and the body hinge plate.

5. The hair care appliance of claim 1, wherein the handle includes a handle frame assembly having the handle hinge plate snap-fit thereon, and wherein the body includes a body frame assembly having the body hinge plate snap-fit thereon.

6. The hair care appliance of claim 5, wherein the handle frame assembly includes a first handle frame and a second handle frame coupled to one another along the longitudinal axis of the handle by at least one attachment mechanism.

7. The hair care appliance of claim 5, wherein the body frame assembly includes a first body frame and a second body frame coupled to one another along the longitudinal axis of the body by at least one attachment mechanism.

8. The hair care appliance of claim 7, wherein first body frame and the second body frame are coupled to one another via a flexible annular element arranged at an end of the body.

9. The hair care appliance of claim 1, wherein the hinge joint comprises a snap hinge assembly.

10. The hair care appliance of claim 9, wherein the retainer, the handle hinge plate and the body hinge plate form a snap hinge assembly extending between the handle and the body.

11. The hair care appliance of claim 1, wherein the retainer is formed from a low friction material.

12. The hair care appliance of claim 10, wherein the snap hinge assembly includes a gasket surrounding the retainer.

13. The hair care appliance of claim 1, further comprising a latch configured to maintain the body in each of the straight configuration and the bent configuration.

14. The hair care appliance of claim 13, further comprising a release button configured to release the latch to enable the body to move between the straight and bent configurations.

15. The hair care appliance of claim 1, wherein the hinge joint is configured to enable rotation of the body relative to the handle when a torque of at least about 0.1 N is applied thereto.

16. A hair care appliance, comprising:

an elongate handle having an air inlet in a first end and an air outlet in a second end, the handle including a fan assembly disposed therein and configured to draw air into the air inlet and to direct air out the air outlet, a retainer ring separate from and snap-fit onto the second end, and a handle hinge plate separate from the elongate handle and the retainer ring, the handle hinge plate snap-fit on the second end such that the retainer ring extends through an opening of the handle hinge plate;

a body having an air inlet configured to receive air from the air outlet on the handle, and an air outlet configured to expel air from the body, the body having a body hinge plate separate from the retainer ring and the body and snap-fit thereon the body such that the retainer ring extends through an opening of the body hinge plate, the body hinge plate defining a seam-free surface that is rotatable around the retainer ring and opposite a seam-free surface on a handle hinge plate that is rotatable around the retainer ring, the retainer ring, the body hinge plate, and the handle hinge plate forming a snap hinge assembly coupling the elongate handle and the body and defining an air flow path therethrough between the air outlet on the handle and the air inlet on the body.

17. The hair care appliance of claim 16, wherein an amount of force required to rotate the body into an angled configuration with the handle is between about 6.2 N and 6.7 N.

18. The hair care appliance of claim 16, wherein an amount of force required to rotate the body into a straight configuration with the handle is between about 4.5 N to 5.3 N.

19. The hair care appliance of claim 16, wherein the handle hinge plate is located at a first end of the handle and the body hinge plate is located on a second end of the body, the first end of the handle opposite the second end of the body.

20. The hair care appliance of claim 19, wherein the handle hinge plate is coupled to at least one handle fame via a first plurality of snap-fit features and the body hinge plate is coupled to at least one body frame via a second plurality of snap-fit features.

* * * * *